US008540341B2

(12) United States Patent
Yamamoto

(10) Patent No.: US 8,540,341 B2
(45) Date of Patent: Sep. 24, 2013

(54) MAINTENANCE DEVICE, POWER TRANSMISSION SWITCHING DEVICE, AND LIQUID EJECTING APPARATUS

(75) Inventor: Taisuke Yamamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/410,107

(22) Filed: Mar. 1, 2012

(65) Prior Publication Data

US 2012/0224002 A1 Sep. 6, 2012

(30) Foreign Application Priority Data

Mar. 2, 2011 (JP) ..... 2011-045366
Mar. 2, 2011 (JP) ..... 2011-045367

(51) Int. Cl.
*B41J 2/165* (2006.01)
*B41J 2/175* (2006.01)

(52) U.S. Cl.
USPC ..... 347/32; 347/30; 347/85

(58) Field of Classification Search
None
See application file for complete search history.

(56) References Cited

U.S. PATENT DOCUMENTS

| | | | | |
|---|---|---|---|---|
| 5,625,385 | A * | 4/1997 | Suzuki | 347/24 |
| 5,988,788 | A * | 11/1999 | Suzuki et al. | 347/30 |
| 6,123,407 | A * | 9/2000 | Muraki | 347/24 |
| 6,132,027 | A * | 10/2000 | Suzuki et al. | 347/33 |
| 6,318,835 | B2 * | 11/2001 | Nakahara | 347/30 |
| 6,364,449 | B1 * | 4/2002 | Takahashi et al. | 347/30 |
| 6,467,872 | B1 * | 10/2002 | Yamada et al. | 347/30 |
| 6,533,387 | B2 * | 3/2003 | Simmons et al. | 347/32 |
| 6,568,789 | B2 * | 5/2003 | Lin et al. | 347/33 |
| 6,729,720 | B2 * | 5/2004 | Miki et al. | 347/104 |
| 6,742,862 | B2 * | 6/2004 | Yamada et al. | 347/30 |
| 6,913,340 | B2 * | 7/2005 | Tanaka et al. | 347/29 |
| 6,916,080 | B2 * | 7/2005 | Okamoto | 347/29 |
| 6,929,346 | B2 * | 8/2005 | Balcan et al. | 347/32 |
| 7,246,874 | B2 * | 7/2007 | Hirakata et al. | 347/29 |
| 7,452,065 | B2 * | 11/2008 | Ogawa | 347/92 |
| 7,556,340 | B2 * | 7/2009 | Umeda et al. | 347/29 |
| 7,654,634 | B2 * | 2/2010 | Hiruma | 347/29 |
| 7,837,293 | B2 * | 11/2010 | Hayashi et al. | 347/30 |
| 2002/0033859 | A1 * | 3/2002 | Mitsuzawa et al. | 347/23 |
| 2002/0067388 | A1 * | 6/2002 | Shimizu et al. | 347/33 |
| 2002/0186271 | A1 * | 12/2002 | Yamada et al. | 347/30 |
| 2006/0176346 | A1 * | 8/2006 | Momose | 347/85 |
| 2010/0118082 | A1 * | 5/2010 | Tojo | 347/30 |

FOREIGN PATENT DOCUMENTS

| | | |
|---|---|---|
| JP | 06-115096 | 4/1994 |
| JP | 2010-201911 | 9/2010 |

* cited by examiner

*Primary Examiner* — Matthew Luu
*Assistant Examiner* — Patrick King
(74) *Attorney, Agent, or Firm* — Workman Nydegger

(57) ABSTRACT

A maintenance device includes: a tube pump which suctions internal spaces of a cap via each of suction passages; a selective blocking mechanism which has a slider that establishes engagement with a carriage in a movement midway area of the carriage positioned on the path of movement to a maintenance area and is moved by being linked with the carriage, selectively blocks the suction passages according to movement of the slider, and releases the engagement between the slider and the carriage while maintaining a blocked state of the selected suction passage; and a separation and approach movement unit which establishes and releases the engagement between the slider and the carriage by moving the slider to approach or be separated from the carriage.

7 Claims, 30 Drawing Sheets

MAINTENANCE DEVICE, POWER TRANSMISSION SWITCHING DEVICE, AND LIQUID EJECTING APPARATUS

CROSS REFERENCES TO RELATED APPLICATIONS

The entire disclosure of Japanese Patent Application Nos. 2011-45367, filed Mar. 2, 2011, and 2011-45366, filed Mar. 2, 2011 are expressly incorporated by reference herein.

BACKGROUND

1. Technical Field

The present invention relates to a maintenance device which performs maintenance of a liquid ejecting head, a liquid ejecting apparatus including the maintenance device, a power transmission switching device which switches power transmission from a driving source, and a liquid ejecting apparatus including the power transmission switching device.

Hitherto, an ink jet type printer has been widely known as a kind of liquid ejecting apparatus. This printer is provided with a liquid ejecting head in a carriage which is reciprocated, and performs printing by ejecting ink which is an example of a liquid from nozzles which are open to a nozzle formation surface of the liquid ejecting head onto a medium such as a sheet transported in a direction intersecting a movement direction of the carriage.

In such a printer, in general, maintenance for maintaining ejection characteristics for appropriately ejecting ink from the nozzles of the liquid ejecting head, that is, maintenance of the liquid ejecting head is performed. For example, after the carriage is moved to a non-printing area other than a printing area where the ink is ejected onto the sheet for printing, a cap is caused to abut on the nozzle formation surface of the liquid ejecting head so as to cover the opening portions of the nozzles. In addition, by causing a cap internal space formed between the nozzle formation surface and the cap in the abutting state to be in a negative pressure state through a rotating operation of a suction pump, for example, ink thickened in the nozzles is suctioned from the nozzles and is discharged via a tube which is a suction passage connected to the cap. In this manner, maintenance for appropriately ejecting ink from the nozzles is performed.

In this maintenance, the printer may select nozzles that need to be suctioned for maintenance. That is, for example, the nozzle formation surface is partitioned into a plurality of areas in units of nozzle rows according to colors of ink ejected from the nozzles constituting the nozzle rows, and each of the partitioned areas is covered with the cap. In addition, by causing the cap internal space formed with an area in the nozzle formation surface covered with the cap to be in the negative pressure state, the nozzles formed in the area are subjected to the maintenance.

As a printer having such a configuration, in JP-A-2010-201911, a technique for selecting and squeezing a tube by a blocking member which is provided in a liquid ejecting head and is reciprocated as a carriage is reciprocated, and selecting a cap internal space to be in a negative pressure state is suggested. According to the technique of JP-A-2010-201911, since the reciprocation of the carriage is used, it is possible to selectively block tubes which are suction passages without enlarging a movement range of the carriage. Therefore, without an increase in size, a printer capable of selectively suctioning a plurality of cap internal spaces is obtained.

Besides, a process for wiping unnecessary ink that is adhered to opening portions of the nozzles using a wiping member that is raised so as to be engaged with the liquid ejecting head, and the like are performed. In addition, as a driving source for rotating such a suction pump or raising the wiping member, a typical motor is used.

Therefore, when a plurality of operations can be performed by a single motor, the number of motors (driving sources) used can be reduced, and thus it is possible to suppress an increase in the size of the printer. Here, for example, in JP-A-6-115096, a printer is disclosed which switches a gear that is engaged with a driving gear of a motor to any driving gear of a gear for driving a paper feeding mechanism that transports a sheet and a gear for driving a suction mechanism that drives a suction pump, using a moving operation of a carriage in areas other than a printing area, which are on both sides of a sheet. As such, by switching transmission of rotation power of a single motor using the moving operation of the carriage in the areas other than the printing area, the rotation driving of the single motor can be switched without an additional power transmission switching device, thereby further suppressing the increase in the size of the printer.

However, in the suggested technique of JP-A-2010-201911, the blocking member is moved along with the reciprocation of the carriage in a non-printing area in which a cap abuts on the liquid ejecting head and forms the cap internal space. Therefore, the carriage cannot be moved while maintaining the state where the squeezed tube is selected. In addition, when the carriage is moved to the non-printing area from the printing area, as the cap is raised by operating a raising mechanism using the movement of the carriage as a driving force, the cap abuts on the nozzle formation surface.

Therefore, in JP-A-2010-201911, in a case where so-called idle suction is performed for suctioning the inside of the cap while the cap is separated from the nozzle formation surface, when the carriage is moved in a direction to the printing area from the non-printing area so as to lower the cap, the blocking member is accordingly moved in the direction to the printing area as such. As a result, the state of selectively squeezing the tube which is the suction passage is released, so that the insides of all the caps are suctioned at the same time and thus suction force is dispersed. Therefore, there is a problem in that discharging characteristics of the ink in the caps are degraded. In addition, during the reciprocation of the carriage in the non-printing area, in addition to a load caused by the raising movement of the cap, a load caused by the reciprocation of the blocking unit is increased. Therefore, there is a concern that an excessive load is applied to the motor for reciprocating the carriage. Accordingly, there is also a problem in that the motor for use has to be a large motor which has a high rated current so as to obtain a high torque.

In addition, in the suggested technique of JP-A-6-115096, the driving gear for the suction mechanism can be driven only in the state where the carriage is positioned in an area other than the printing area. That is, for example, in the case where the carriage is moved to the printing area, there is a problem in that the driving gear of the motor is not maintained in the switched state of driving the driving gear for the suction mechanism and returns to the state of being always engaged with the driving gear of the paper feeding mechanism.

SUMMARY

An advantage of some aspects of the invention is that it realizes a maintenance device capable of moving a carriage while suppressing an increase in a load during movement of the carriage and maintaining a state where a cap internal space is selected to be in a negative pressure state, and provides a liquid ejecting apparatus including the maintenance device.

In addition, another advantage of some aspects of the invention is that it realizes a power transmission switching device capable of reliably switching transmission of power of a driving source using a moving operation of the carriage and maintaining the switched power transmission state, and provides a liquid ejecting apparatus including the power transmission switching device.

According to an aspect of the invention, there is provided a maintenance device including: a carriage which is provided to support a liquid ejecting head that ejects a liquid from a plurality of nozzles and to be reciprocated; a cap which approaches the liquid ejecting head as the carriage is moved to a maintenance position where maintenance of the liquid ejecting head is performed, abuts on the liquid ejecting head so as to surround the nozzles, and forms a plurality of internal spaces between the cap and the liquid ejecting head; a suction unit which suctions each of the internal spaces of the cap via a suction passage corresponding to each of the internal spaces; a selective blocking unit which has a movement member which is moved by being linked with the carriage in a state of being engaged with the carriage in a movement midway area positioned on the path of the carriage moving to the maintenance position, selectively blocks the suction passages according to movement of the movement member, and releases engagement between the movement member and the carriage while maintaining a blocked state of the selected suction passage; and a separation and approach movement unit which establishes or releases the engagement between the movement member and the carriage by moving the movement member so as to approach or be separated from the carriage.

According to this configuration, in the area which is on the path of the movement to the maintenance area where suction is performed by causing the cap to abut thereon, the internal space of the cap is selected to be in a negative pressure state, and the carriage can be moved to the maintenance area while maintaining the blocked state of the suction passage corresponding to the selected internal space. As a result, maintenance of the liquid ejecting head can be appropriately performed without a reduction in the suction characteristics of the cap. In addition, when the movement midway area where the suction passage to be blocked is selected is caused not to overlap with an area where the carriage is moved to abut on the liquid ejecting head, an increase in the load caused by the movement of the carriage can be suppressed.

In the maintenance device according to the aspect of the invention, the movement member may be provided with an engagement portion that is able to be engaged with the carriage in the movement midway area of the carriage and a blocking member that is displaced so as to selectively block the suction passages, the selective blocking unit may include a cam member having a cam surface formed to guide the blocking member to a selection position corresponding to the selection of the suction passage to be blocked according to reciprocation of the movement member, and the separation and approach movement unit may drive the selective blocking unit to approach or be separated from the carriage in a state where the blocking member is positioned at the selection position.

According to this configuration, since the position of the movement member in the case where the engagement between the carriage and the movement member is released is specified by selection positions, when the engagement portion of the movement member is engaged with the carriage thereafter, the carriage can be easily engaged with the engagement portion. In addition, by switching the suction passage to be blocked by reciprocation of the movement member, the selection positions can be the same position in the movement direction of the movement member. Therefore, regardless of the selected state of the suction passage, the carriage and the movement member can be engaged with each other at a fixed position in the movement midway area.

In the maintenance device according to the aspect of the invention, an impelling unit which impels the movement member so as to guide the blocking member toward the selection position may further be included.

According to this configuration, when the engagement between the carriage and the movement member is released, the movement member is impelled by the impelling unit so that the blocking member is moved to a direction of the selection positions. As a result, for example, in the case where the engagement between the carriage and the movement member is released on the path of the movement of the carriage, the position of the movement member is moved to a position that can be specified in the movement direction of the movement member by the impelling unit, so that in the case where the engagement portion of the movement member is engaged with the carriage, the carriage can be easily engaged with the engagement portion.

In the maintenance device according to the aspect of the invention, in the selective blocking unit, a movement restriction unit which restricts the movement of the movement member in a direction in which the carriage is moved from the maintenance area to the movement midway area may be formed at the selection position to which the blocking member is guided.

According to this configuration, by engaging the carriage moved to the maintenance area with the engagement portion of the movement member in the movement restricted state by the selective blocking unit, the carriage can be restricted so as not to move in the direction toward the movement midway area from the maintenance area. Therefore, the engagement portion of the movement member can be caused to function as a lock unit of the carriage.

In the maintenance device according to the aspect of the invention, the movement midway area of the carriage may include an area where the liquid is ejected onto a medium from the liquid ejecting head.

According to this configuration, during the process of ejecting the liquid onto the medium, using the moving operation of the carriage, the internal space of the cap to be suctioned can be selected in advance. Therefore, after ending printing, nozzles which are objects of maintenance can be immediately suctioned for maintenance.

According to another aspect of the invention, there is provided a liquid ejecting apparatus including: a liquid ejecting head which ejects a liquid onto a medium; and the maintenance device having the configurations described above.

In the liquid ejecting apparatus having this configuration, the same effects as those of the maintenance device are exhibited. That is, the cap of which the internal space is to be suctioned is selected using the reciprocation of the carriage while suppressing an increase in the load of the driving source, so that the liquid ejecting head can be subjected to maintenance without degradation of suction characteristics.

According to still another aspect of the invention, there is provided a power transmission switching device including: a rotation unit which is rotated as a driving source is rotated; a rotation shaft which has a shaft portion extending along an axial direction of the rotation unit and in which a protruding portion protruding in a direction intersecting the axial direction of the shaft portion is formed; an engagement member in which a first engagement portion and a second engagement portion that are able to be engaged with the protruding portion in a rotation direction of the rotation shaft are formed at positions separated in the axial direction, and which allows relative rotation of the protruding portion so as to cause the protruding portion to be engaged with any of the first and second engagement portions by being moved in a first direction along the axial direction, and maintains engagement between the protruding portion and any of the first and second engagement portions so as to be rotated along with the protruding portion by being moved in a second direction opposite to the first direction; a displacement member which abuts on the engagement member and is displaced so as to move the engagement member to a position where the rotation of the protruding portion is allowed in the first direction along the axial direction; a clutch member which is moved in the first direction and is engaged with the rotation unit as the displacement member is moved, so as to receive the rotation of the rotation unit and be rotated about the rotation shaft, and is moved along the axial direction so as to maintain engagement with the rotation unit when the protruding portion is engaged with the second engagement portion and so as to release the engagement with the rotation unit when the protruding portion is engaged with the first engagement portion; and a second direction impelling member which impels the clutch member in the second direction.

According to this configuration, by displacing the displacement member, the clutch member can be caused to be rotatably driven or not to be rotatably driven by the driving force from the driving source. Therefore, for example, when the clutch member is moved in the axial direction by moving the displacement member using the moving operation of the carriage, whether or not the power of the driving source is transmitted can be switched between by absence or presence of the rotation of the clutch member. In addition, the engagement member is impelled so that the state of engagement between the protruding portion and any of the first and second engagement portions is always maintained by the second direction impelling unit via the clutch member. Therefore, the power transmission state of the switched driving source can be maintained regardless of the movement position of the carriage.

In the power transmission switching device according to the aspect of the invention, the displacement member may be a lever member which is displaced so as to move the engagement member in the first direction as one end side thereof is moved and thus the other end side thereof abuts on the engagement member.

According to this configuration, for example, the engagement member can be pressed using the moving operation of the carriage that is moved at a position distant from the power transmission switching device. In addition, the engagement member can be moved in the reverse direction to the movement direction of the carriage. Moreover, in the case where the one end side is moved by the movement of the carriage, an increase in the load that occurs when the carriage is moved with respect to the load of the other end side for moving the engagement member can be suppressed.

In the power transmission switching device according to the aspect of the invention, a first direction impelling member may further be included which is inserted between the clutch member and the engagement member, impels the clutch member in the first direction with an impelling force stronger than that of the second direction impelling member by being compressed, thereby moving the clutch member in the first direction along with the engagement member against the impelling force of the second direction impelling member.

According to this configuration, for example, even in a case where the clutch member is in a state of abutting on a position where it is not engaged with the rotation unit so as not to move in the first direction before moving to a position where it can be engaged with the rotation unit during the movement in the first movement, the clutch member can be reliably engaged with the rotation unit in the rotation direction in the following manner. That is, when the engagement member is moved in the first direction approaching the clutch member by the displacement member, the first direction impelling member is in a compressed state, and when the rotation unit and the clutch member are caused to rotate relative to each other in this state, the state of the clutch member abutting on the position where it is not engaged with the rotation unit is released. Then, the clutch member is moved in the first direction as the compressed first direction impelling member is elongated, such that the rotation unit and the clutch member can be engaged with each other in the rotation direction.

In the power transmission switching device according to the aspect of the invention, in the rotation unit, a driving-side protruding portion protruding toward the clutch member side from the rotation unit side along the axial direction may be formed, and in the clutch member, a driven-side protruding portion may be formed which protrudes toward the rotation unit side from the clutch member side along the axial direction, and is rotated by being engaged with the driving-side protruding portion when the rotation unit is rotated about the rotation shaft.

In this configuration, through the movement of the clutch member in the first direction, the driven-side protruding portion is moved in the axial direction of the rotation shaft so as to be engaged with the driving-side protruding portion in the rotation direction, so that driving transmission between the rotation unit and the clutch member can be performed. Therefore, since the movement amount in the axial direction is enough for the occupied space needed for the engagement, the space needed for the engagement is suppressed, and rotation is transmitted by the engagement between the protruding portions, so that the possibility that rotation is stably transmitted is increased.

In the power transmission switching device according to the aspect of the invention, the clutch member may be provided with a spur gear which is rotated about the rotation shaft in synchronization with rotation of the clutch member, a slide member which is engaged with the spur gear and in which a linear gear that is moved along the direction intersecting the axial direction as the spur gear is rotated is formed in a partial area range may be provided, and teeth of the linear gear positioned at least at an end of the partial area range may be impelled in a direction to be engaged with the spur gear so as to always maintain engagement with the spur gear.

According to this configuration, the power of the driving source is transmitted by the rotation of the clutch member as needed so as to reliably move the slide member. Therefore, for example, in a case where an object member is moved upward and downward by the slide member, the slide member can be reliably moved to move the object member upward and downward without being limited by the movement position of the carriage.

In the power transmission switching device according to the aspect of the invention, the slide member may have an elastic deformation portion which is elastically deformed along with movement, and may be impelled in the direction to be engaged with the spur gear so as to cause the linear gear to always maintain the engagement with the spur gear by a restoring force of the elastic deformation portion.

According to this configuration, the slide member is formed in one body without an impelling unit being configured as an additional component, so that the power transmission switching device can be suppressed from being complicated.

According to a yet another aspect of the invention, there is provided a liquid ejecting apparatus including: a liquid ejecting head which ejects a liquid onto a medium; a carriage which is configured to be provided with the liquid ejecting head and to be reciprocated; and the power transmission switching device having the configuration described above.

According to the liquid ejecting apparatus having the configuration described above, the same effects as those of the power transmission switching device are exhibited. In particular, using the movement of the carriage, a member that transmits the power of the driving source for driving can be switched.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
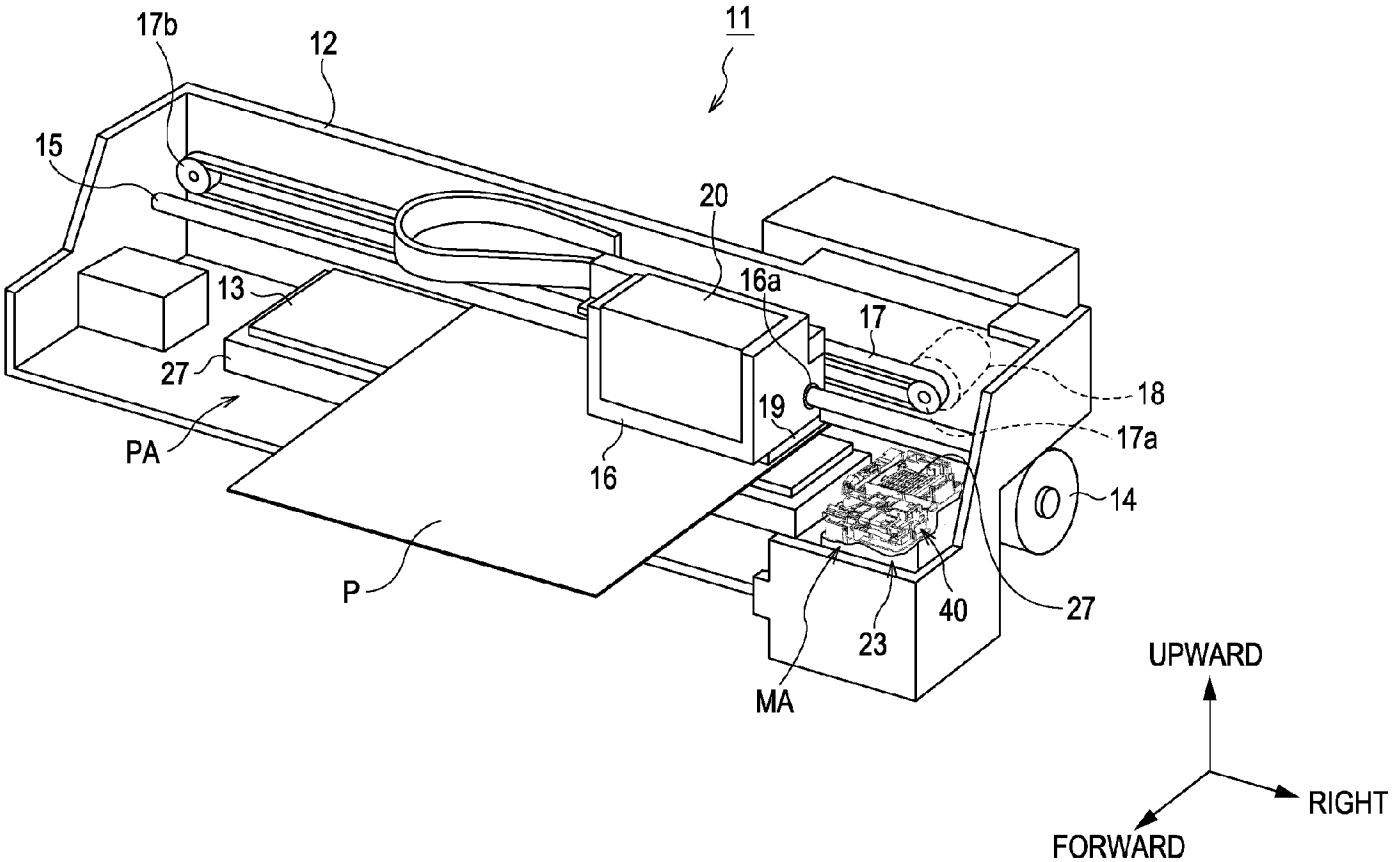
FIG. 1 is a perspective view illustrating the schematic configuration of a printer having a maintenance device according to an embodiment of the invention.

Embodiments that embody the invention as an ink jet type printer which is an example of a liquid ejecting apparatus will now be described with reference to the drawings. For ease of the following description, as illustrated in FIG. 1, the direction of gravity in the vertical direction is a downward direction, and a direction opposite to the direction of gravity is an upward direction. In addition, a transportation direction which intersects the vertical direction and in which a sheet P fed to a printer is transported during image formation is a forward direction, and a direction opposite to the transportation direction is a rearward direction. Moreover, directions which intersect both the vertical direction and transportation direction and in which a carriage is reciprocated, that is, scanning directions are respectively a right direction and a left direction as viewed from the forward direction.

As illustrated in FIG. 1, in a printer 11 as a liquid ejecting apparatus, at a lower part in a frame 12 having a substantially rectangular box shape, a support member 13 extends for supporting a sheet P which is an example of a medium along the longitudinal direction during printing. In addition, on the support member 13, according to driving of a paper feeding motor 14 provided under the rear surface of the frame 12, the sheet P is fed by a paper feeding mechanism (not shown) from the rearward side to the forward side on the support member 13.

Above the support member 13 in the frame 12, a guide shaft 15 is provided along the longitudinal direction of the support member 13. A carriage 16 is supported by the guide shaft 15 so as to reciprocate along the axial direction of the guide shaft 15. That is, the carriage 16 is provided with a support hole 16*a* so as to penetrate the guide shaft 15 in the axial direction, and the guide shaft 15 is inserted through the support hole 16*a*. Therefore, the carriage 16 is supported so as to reciprocate in the axial direction of the guide shaft 15, that is, the scanning direction (the left and right direction).

On the inner surface of the rear wall of the frame 12, at positions corresponding to both end portions of the guide shaft 15, a driving pulley 17*a* and a driven pulley 17*b* are rotatably supported. An output shaft of a carriage motor 18 which is a driving source to reciprocate the carriage 16 is connected to the driving pulley 17*a*, and an endless type timing belt 17 of which a part is connected to the carriage 16 is suspended between the driving pulley 17*a* and the driven pulley 17*b*. Therefore, the carriage 16 is moved in the axial direction of the guide shaft 15 (the left and right direction) via the endless type timing belt 17 by driving force of the carriage motor 18 while being guided by the guide shaft 15.

The lower surface of the carriage 16 is provided with a liquid ejecting head 19, and ink cartridges 20 for supplying a plurality of colors (in this embodiment, four colors including black, cyan, yellow, and magenta) of ink to the liquid ejecting head 19 are detachably mounted on the carriage 16.

On the lower surface of the liquid ejecting head 19, a plurality of (in this embodiment, four) nozzle rows 22A to 22D (see FIG. 2) in which a plurality of nozzles are lined up in the forward and rearward direction are arranged in parallel in the left and right direction. In this embodiment, regarding the nozzle rows 22A to 22D, the nozzle rows 22A, 22B, 22C, and 22D are sequentially arranged from the left side. In addition, the ink in the ink cartridge 20 is supplied from the ink cartridge 20 to the liquid ejecting head 19 by driving of a pressurizing unit such as a piezoelectric element (not shown) included in the liquid ejecting head 19, and is ejected from the nozzles of the nozzle rows 22A to 22D included in the liquid ejecting head 19.

That is, as illustrated in FIG. 1, in the printer 11, an area corresponding to the support member 13 on which the sheet P is supported during transportation is a printing area PA. In addition, while the carriage 16 is reciprocated in the left and right direction in the printing area PA, the piezoelectric element (not shown) provided in the liquid ejecting head 19 is driven, such that the ink is ejected onto the sheet P fed onto the support member 13, thereby performing printing. In this case, black ink is ejected from each of the nozzles constituting the nozzle row 22A, cyan ink is ejected from each of the nozzles constituting the nozzle row 22B, yellow ink is ejected from each of the nozzles constituting the nozzle row 22C, and magenta ink is ejected from each of the nozzles constituting the nozzle row 22C.

However, in this embodiment, a non-printing area deviated from the printing area PA which is positioned on the right from left and right sides of the support member 13 is a maintenance area MA for performing maintenance of the liquid ejecting head 19 such as cleaning. The liquid ejecting head 19 is moved to a predetermined position in the maintenance area MA, and a maintenance device 23 that maintains ink ejection characteristics of the nozzles is provided.

The maintenance device 23 is raised as the carriage 16 is moved to the maintenance area MA and has a cap 27 which is in a state of abutting on the liquid ejecting head 19 so as to surround the nozzles in the maintenance area MA. In addition, in the abutting state, a plurality of (here, two) internal spaces (hereinafter, referred to as "cap internal spaces") formed between the liquid ejecting head 19 and the cap 27 are suctioned via flexible tubes which are suction passages for pressure reduction, and ink is suctioned from the nozzles so as to maintain the liquid ejecting head 19. When the ink is suctioned, the maintenance device 23 of this embodiment has a plurality of (here, two) suction passages for the respective cap internal spaces, and includes a selective blocking unit (selective blocking unit) 40 that blocks the suction passages by squeezing the tubes according to selection of the cap internal space to be subjected to pressure reduction.

Next, the maintenance device 23 of this embodiment will be specifically described.

First, the schematic configuration of the maintenance device 23 will be described with reference to FIG. 2. In addition, in FIG. 2, the left side from the broken lines schematically illustrates the maintenance device 23 in a state where the carriage 16 is moved in the left and right direction, and the right side from the broken lines schematically illustrates the maintenance device 23 in a state where the carriage 16 is moved in a direction perpendicular to the figure.

Figure 2:
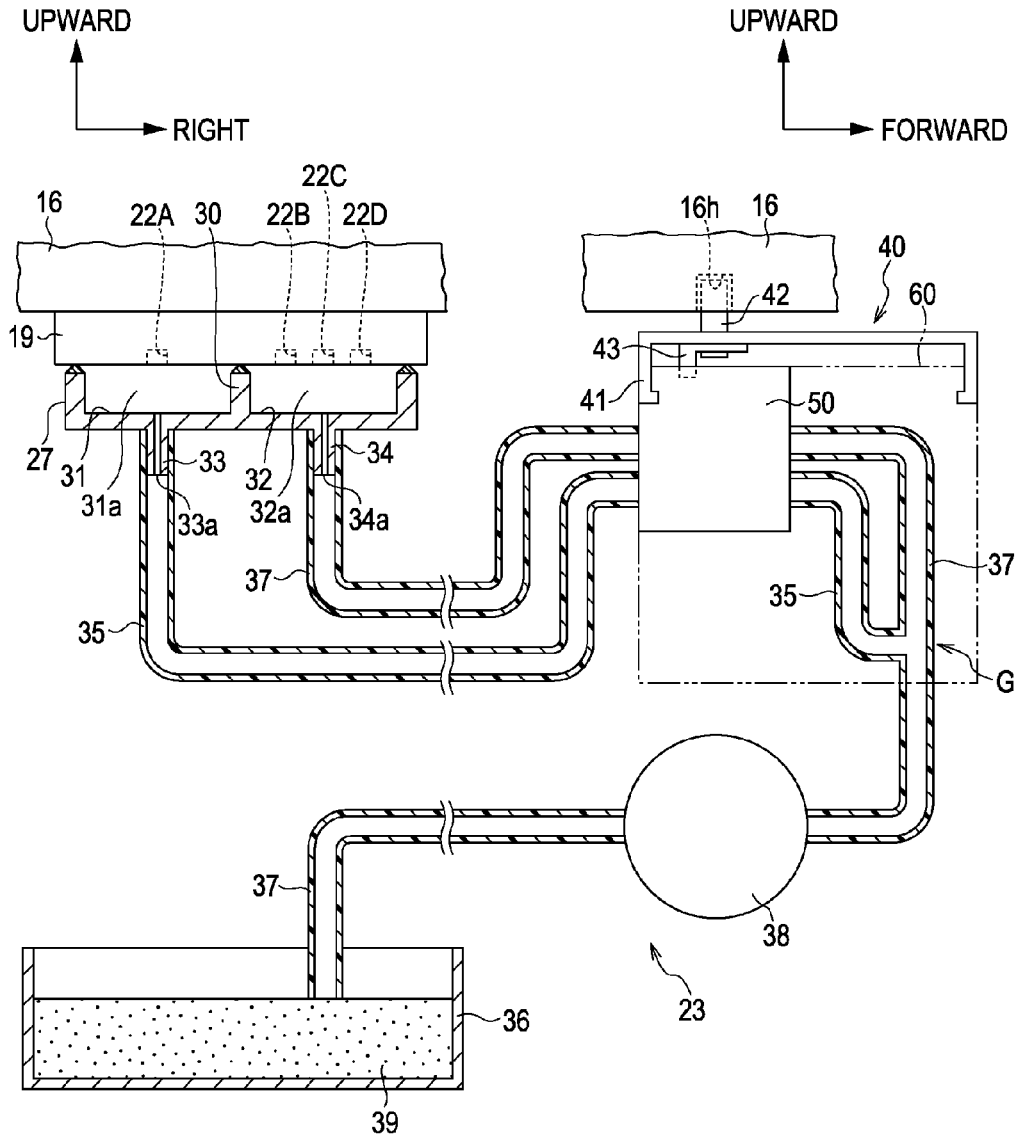
FIG. 2 is a schematic configuration diagram of the maintenance device of the embodiment.

As illustrated in FIG. 2, in the cap 27, a partition wall 30 partitions the inside of the cap 27 into left and right two chambers. In the cap 27, a part on the left with respect to the partition wall 30 is a first cap portion 31, and a part on the right with respect to the partition wall 30 is a second cap portion 32. In addition, in a state where the carriage 16 is moved to an upward position of the maintenance device 23 in the maintenance area PA and the cap 27 is raised, the first cap portion 31 surrounds the nozzle row 22A and forms the first cap internal space 31*a* with the liquid ejecting head 19. In addition, the second cap portion 32 surrounds the nozzle rows 22B to 22D and forms the second cap internal space 32*a* with the liquid ejecting head 19.

A first protruding portion 33 protrudes downward from the bottom wall of the first cap portion 31, and a first discharge path 33*a* for discharging the ink from the first cap portion 32 is formed to penetrate the first protruding portion 33 in the upward and downward direction. On the other hand, a second protruding portion 34 protrudes downward from the bottom wall of the second cap portion 32, and a second discharge path 34*a* for discharging the ink from the second cap portion 31 is formed to penetrate the second protruding portion 34 in the upward and downward direction.

The base end side (upstream side) of a second discharge tube 37 as a tube having flexibility is connected to the second protruding portion 34, and the other end side (downstream side) of the second discharge tube 37 is inserted into a waste ink tank 36 having a rectangular parallelepiped shape. On the other hand, the base end side (upstream side) of a first discharge tube 35 as a tube having flexibility is connected to the first protruding portion 33, and the other end side (downstream side) of the first discharge tube 35 is connected to a confluence point G provided on the path of the second discharge tube 37 so as to join the second discharge tube 37.

Both the discharge tubes 35 and 37 are lined up and drawn to the confluence point G. In addition, at a position of the second discharge tube 37 at the downstream end from the confluence point G with the first discharge tube 35, a single tube pump 38 is disposed as a suction unit for suctioning the insides of the first and second discharge tubes 35 and 37 from the cap 27 side to the waste ink tank 36 side.

That is, in a case where the tube pump 38 is driven, both the discharge tubes 35 and 37 are suctioned at the same time. Therefore, the first and second discharge tubes 35 and 37 form the suction passages for respectively suctioning the first and second cap internal spaces 31*a* and 32*a*.

In addition, as the tube pump 38 is driven while the cap 27 is raised and abuts on the liquid ejecting head 19, cleaning of the nozzles is performed. That is, thickened ink is suctioned from each of the nozzles constituting the nozzle rows 22A to 22D along with bubbles and the like and is discharged into the waste ink tank 36 via the cap 27 and both the discharge tubes 35 and 37. In addition, in the waste ink tank 36, a waste ink absorbing material 39 that absorbs and holds the ink discharged into the waste ink tank 36 is accommodated.

At positions of both the discharge tubes 35 and 37 on the upstream side from the confluence point G, the selective blocking mechanism 40 that can selectively block the discharge tubes 35 and 37 is disposed. The selective blocking mechanism 40 includes a base 60 and a slider 41 as a movement member that slides with respect to the base 60.

In the slider 41, an engagement portion 42 which is engaged with the carriage 16 in the scanning direction (the left and right direction) by being raised and entering a concave portion 16*h* provided on the lower surface side of the carriage 16 from below, and a blocking member 43 which is axially supported to rotate on the lower surface side of the slider 41 for blocking the suction passage are provided. In addition, a cam member 50 which has a cam surface on one surface is embedded in the base 60, and a surface (upper surface) opposing the blocking member 43 is the cam surface. In addition, with the movement of the slider 41 which is linked with the carriage 16 that moves in the scanning direction as the engagement portion 42 is engaged with the concave portion 16*h* of the carriage 16, the blocking member 43 is guided by the cam surface and moved so as to squeeze the second discharge tube 37 or the first discharge tube 35, such that any one of the suction passages is blocked.

Although not shown in FIG. 2, in the maintenance device 23 of this embodiment, a separation and approach movement unit which is driven by a driving source and moves the slider 41 (the selective blocking mechanism 40) to approach and be separated from the carriage 16 is included. Moreover, a power transmission switching device which switches between a state where power of the driving source is transmitted to the separation and approach movement unit and a state where power is not transmitted is included. The power transmission switching device performs switching to transmit the power of the driving source to the separation and approach movement unit so as to raise and lower the selective blocking mechanism 40, such that the slider 41 is moved by being linked with the carriage 16 in an area on the path of the carriage 16 moving to the maintenance area MA. Hereinafter, the detailed configuration of the maintenance device 23 including the separation and approach unit and the power transmission switching device will be described with reference to the drawings.

Figure 3:
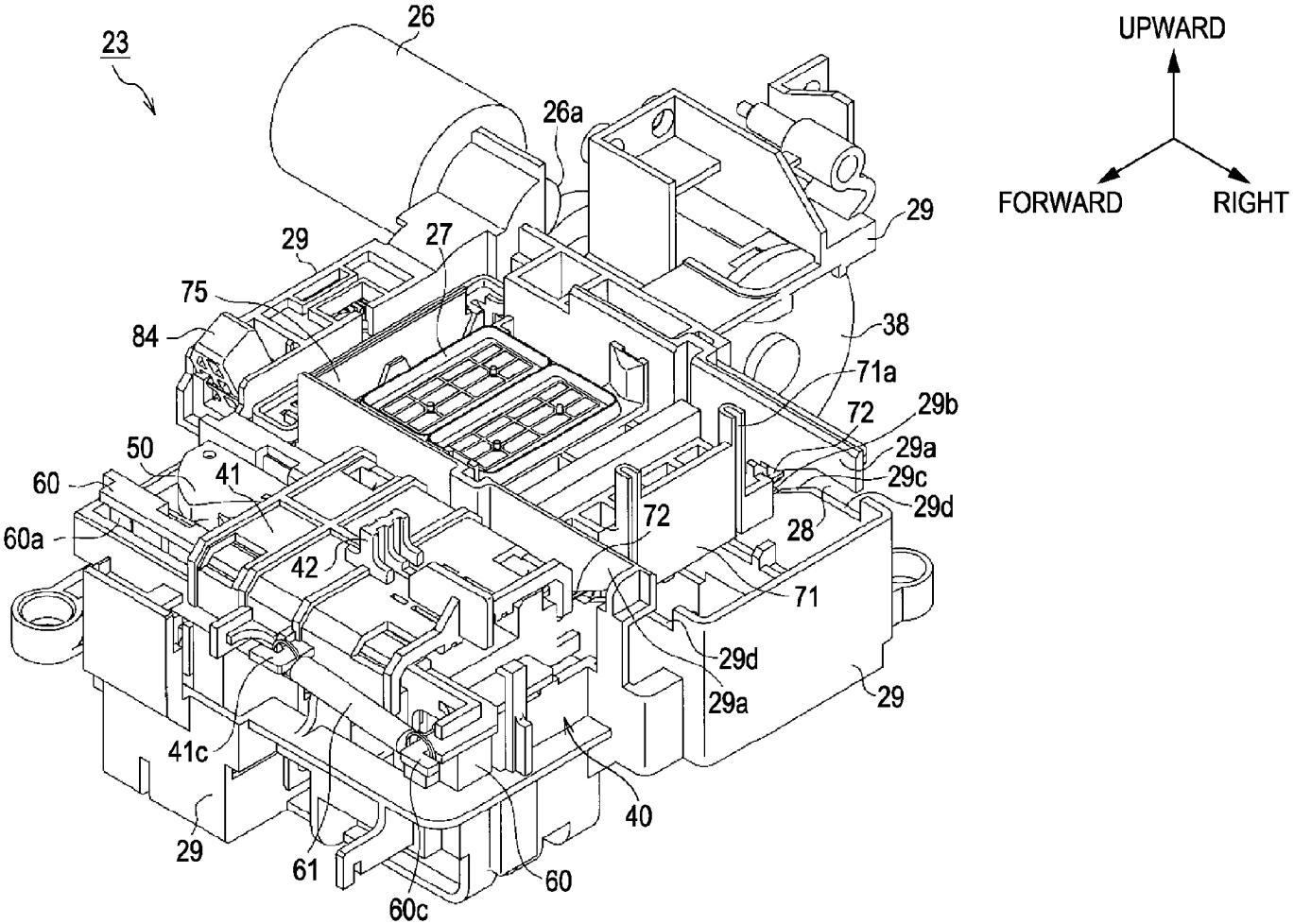
FIG. 3 is a perspective view of the maintenance device of the embodiment.

As illustrated in FIG. 3, the maintenance device 23 of this embodiment includes the cap 27 described above, the selective blocking mechanism 40, the tube pump 38, a wiper 75 that wipes the liquid ejecting head 19, and a lock lever 84 that restricts the movement of the carriage 16. These components are supported or fixed by a frame body 29 that is the base of the apparatus and is made of a resin and are driven by a single motor 26 as a driving source so as to perform their respective predetermined operations in the maintenance device 23. In this embodiment, switching of each of an elevating operation of the cap 27 and a reciprocating operation of the slider 41 are performed according to the movement of the carriage 16. In addition, elevating operations of the wiper 75, the lock lever 84, and the selective blocking mechanism 40 are also performed by the driving force of the motor 26. Moreover, a rotating operation of the tube pump 38 is also performed by the motor 26. Next, structures for performing these operations will be sequentially described.

The cap 27 is held by a substantially box-shaped cap holding member 71 provided substantially at the center part of the maintenance device 23 via an elastic member (not shown). The cap holding member 71 is guided by frame walls 29*a* which are erected in front and rear thereof in the upward and downward direction and extend in the left and right direction, can be moved in the left and right direction, and is raised as it moves from the left to the right.

Specifically, in the frame walls 29*a*, two groups of two penetration grooves 28 which are lined up so as to oppose each other in the forward and rearward direction, a total of four penetration grooves 28, are provided at different positions in the left and right direction. Each of the penetration grooves 28 includes a lower side flat portion 29*b* extending straight from the left to the right, an inclined surface portion 29*c* extending obliquely upward to the right from the right end of the lower side flat portion 29*b*, and an upper side flat portion 29*d* extending straight from the right end of the inclined surface portion 29*c* to the right. In addition, in each of the penetration grooves 28, the lower side flat portion 29*b*, the inclined surface portion 29*c*, and the upper side flat portion 29*d* communicate with each other.

In the cap holding member 71, support bars 72 extending in the forward and rearward direction so as to enter the respective penetration grooves 28, a total of four support bars 27, are provided so as to correspond to the respective penetration grooves 28. In addition, each of the support bars 72 enters and is inserted into the corresponding penetration groove 28 so as to be slidable. Therefore, the cap holding member 71 is configured so that as the cap holding member 71 abuts on the right surface of the carriage 16 and moves from the left to the right, the support bars 72 slide on the penetration grooves 28 from the left to the right, pass through the lower side flat portions 29*b* and the inclined surface portions 29*c*, and move to the upper side flat portions 29*d* so as to be raised.

The cap holding member 71 is always impelled against the right side by a coil spring 74 (see FIG. 5), and in a printing state in which the carriage 16 is not positioned in the maintenance area MA, each of the support bars 72 is positioned at the lower side flat portion 29*b* which is at the left end of the penetration groove 28 by the impelling force of the coil spring 74. Therefore, the cap holding member 71 is in a state of being lowered in the case where the carriage 16 is positioned in the printing area PA. In addition, when the carriage 16 is moved from the left to the right so as to move from the printing area PA toward the maintenance area MA, the right surface of the carriage 16 abuts on a locking portion 71*a* which is at the right end of the cap holding member 71 and in which a convex portion having a concave surface on the left is formed in the upward and downward direction and thereafter moves together with the cap holding member 71 to the right.

With the movement to the right, in a procedure in which each support bar 72 provided in the cap holding member 71 slides to the right on the inclined surface portion 29*c* in the corresponding penetration groove 28, the support bar 72 is gradually raised so that the cap 27 approaches the liquid ejecting head 19 along with the cap holding member 71. In addition, in a stage in which each support bar 72 reaches the upper side flat portion 29*d* of the corresponding penetration groove 28, the cap 27 abuts on the liquid ejecting head 19.

In the cap holding member 71, in the state where the carriage 16 is moved to the maintenance area MA positioned on the right of the support member 13, each support bar 72 is positioned at the upper side flat portion 29*d* in the corresponding penetration groove 28 along with the cap 27. Therefore, a load needed to move the carriage 16 is increased in the procedure in which each support bar 72 slides to the right on the inclined surface portion 29*c* in the corresponding penetration groove 28.

In addition, in the maintenance device 23, the selective blocking mechanism 40 is disposed at a position on the forward side from the cap holding member 71. In the selective blocking mechanism 40, the base 60 is fixed to the frame body 29, and in the base 60, the slider 41 is provided which slides in the left and right direction with respect to the base 60 by being guided by concave groove portions 60*a* provided to extend in the left and right direction at both positions in front and rear of the base 60. In addition, in this embodiment, between a hooking portion 41*c* provided at the midway position in the slider 41 in the left and right direction and a hooking portion 60*c* provided at the right end position in the base 60, a coil spring 61 as an impelling unit is stretched and is impelled so that the slider 41 is positioned at the right end in a slide range in the left and right direction.

In the slider 41, substantially at the center of the upper surface thereof, the engagement portion 42 formed to protrude upward is provided. As the selective blocking mechanism 40 is raised and the engagement portion 42 is engaged with the concave portion 16*h* of the carriage 16, the slider 41 is driven by the carriage 16 and is reciprocated in the left and right direction with respect to the base 60 by being linked with the carriage 16.

In the base 60, the cam member 50 having a cam surface on one surface is embedded so as to oppose the slider 41 which reciprocates on the cam surface. On the other hand, on the lower surface of the slider 41, the blocking member 43 (see FIGS. 20 to 22) is rotatably supported. The blocking member 43 is configured to rotate along with the reciprocation of the slider 41 and squeeze the second discharge tube 37 or the first discharge tube 35 according to a change in the rotation posture. A tube squeezing structure of the blocking member 43 will be described later in detail.

In addition, in the maintenance device 23, the separation and approach movement unit which raises or lowers the slider 41 by raising or lowering the base 60 in the selective blocking mechanism 40 is provided. In this embodiment, a gear train of a plurality of gears which are axially supported by the frame body 29 so as to be rotatable is configured to perform, as well as driving of the separation and approach movement unit, rotation driving of the lock lever 84, elevation driving of the wiper 75, and rotation driving of the tube pump 38 using the rotation power of the motor 26 as driving force.

Figure 4:
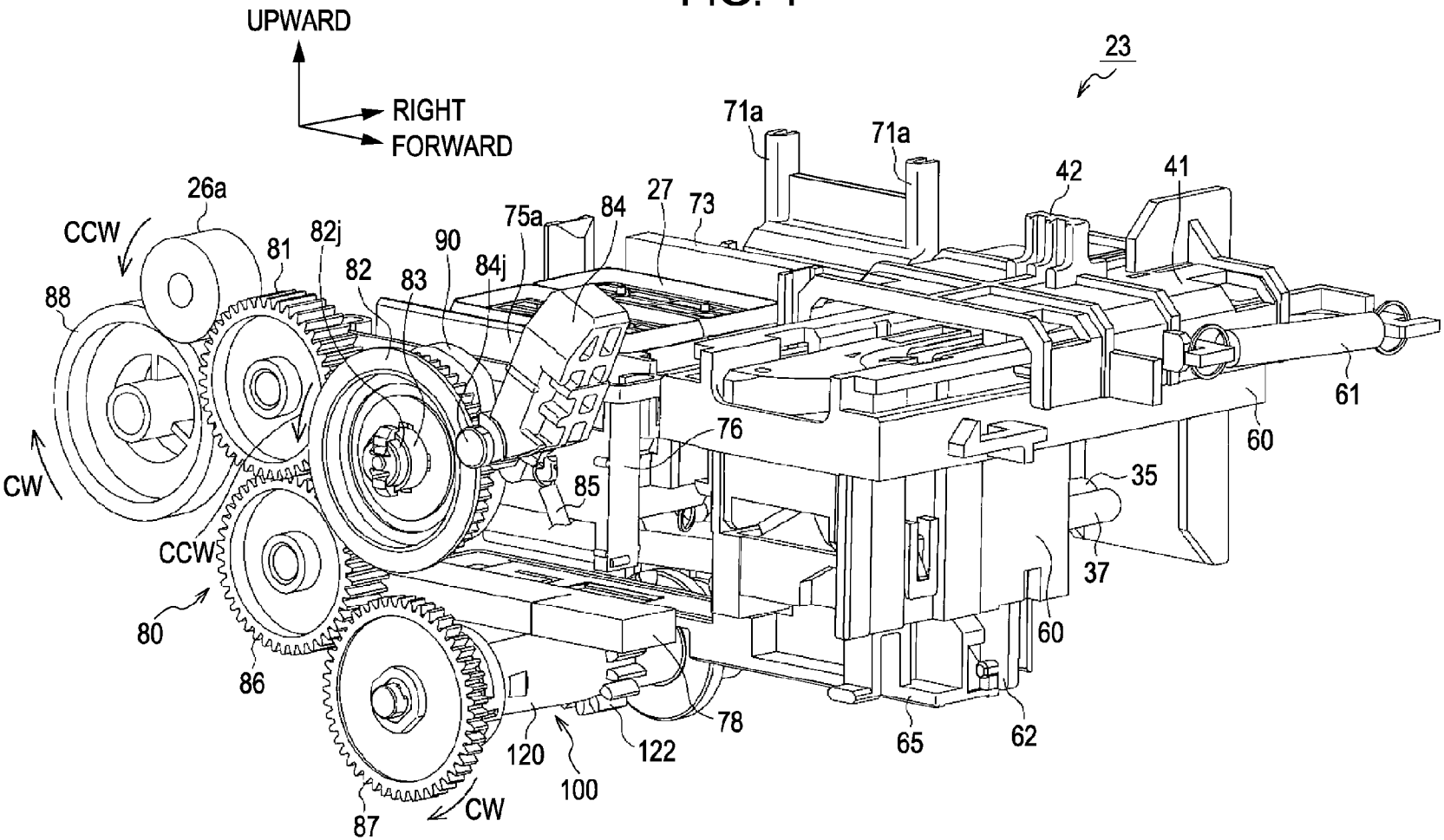
FIG. 4 is a perspective view of the maintenance device viewed obliquely from above in a left forward direction in a state where a frame is excluded.

That is, as illustrated in FIG. 4 in which the maintenance device 23 from which the frame body 29 is detached is viewed from the forward left direction, the gear train is configured so that a pinion 26*a* rotating integrally with the motor 26 is engaged with a first transmission gear 81 and a pump transmission gear 88 so as to transmit rotation of the motor 26.

The pump transmission gear 88 is engaged with a pump gear (not shown) connected to the driving shaft of the tube pump 38 and transmits the rotation power of the motor 26 to the pump gear, thereby driving the tube pump 38. In addition, in this embodiment, the tube pump 38 performs a suction operation as the motor 26 rotates counterclockwise as viewed from the left (hereinafter, this is called "CCW rotation") and does not perform the suction operation in the case where the motor 26 rotates clockwise (hereinafter, this is called "CW" rotation).

On the other hand, the first transmission gear 81 transmits the rotation of the motor 26 to a second transmission gear 82 and a third transmission gear 86 which are engaged with the first transmission gear 81. In addition, the third transmission gear 86 is further engaged with a fourth transmission gear 87 which is an example of a rotation unit and transmits the rotation of the motor 26 to the fourth transmission gear 87. By the configuration of the gear train, in this embodiment, when the motor 26 (the pinion 26*a*) undergoes the CCW rotation, the second transmission gear 82 undergoes the CCW rotation, and the fourth transmission gear 87 undergoes the CW rotation.

The second transmission gear 82 is pressed against a cam gear 90 positioned on the right which is a rear surface side by a spring 83 provided at a rotation shaft portion 82*j*. The cam gear 90 generates a frictional force at the contact surface which comes in contact with the second transmission gear 82 by the pressing, and a frictional clutch mechanism is configured between the cam gear 90 and the second transmission gear 82 so as to rotate in synchronization with the second transmission gear 82 by the generated frictional force.

In this embodiment, the lock lever 84 is typically impelled by a lock spring 85 to undergo the CW rotation around a rotation shaft portion 84*j* and is in an inclined state in which the upper side thereof is slightly inclined forward. In addition, when the cam gear 90 is rotated, the lock lever 84 is rotated around the rotation shaft portion 84*j* according to a cam shape formed in the cam gear 90, and undergoes the CCW rotation against the impelling force of the lock spring 85 and be in a substantially erected state.

In addition, when the cam gear 90 is rotated, the wiper 75 is raised and lowered according to a cam groove formed in the cam gear 90. In this embodiment, the wiper 75 has a wiper blade 75*a* that wipes the liquid ejecting head 19 and a wiper holding member 76 that holds the wiper blade 75*a*, and when the cam gear 90 (the second transmission gear 82) undergoes the CCW rotation, the wiper holding member 76 is raised. In addition, below the wiper holding member 76, an absorbing member 78 is disposed which receives and absorbs ink in the liquid ejecting head 19 which falls down in the direction of gravity along the wiper 75 after being wiped by the wiper blade 75*a*.

Figure 5:
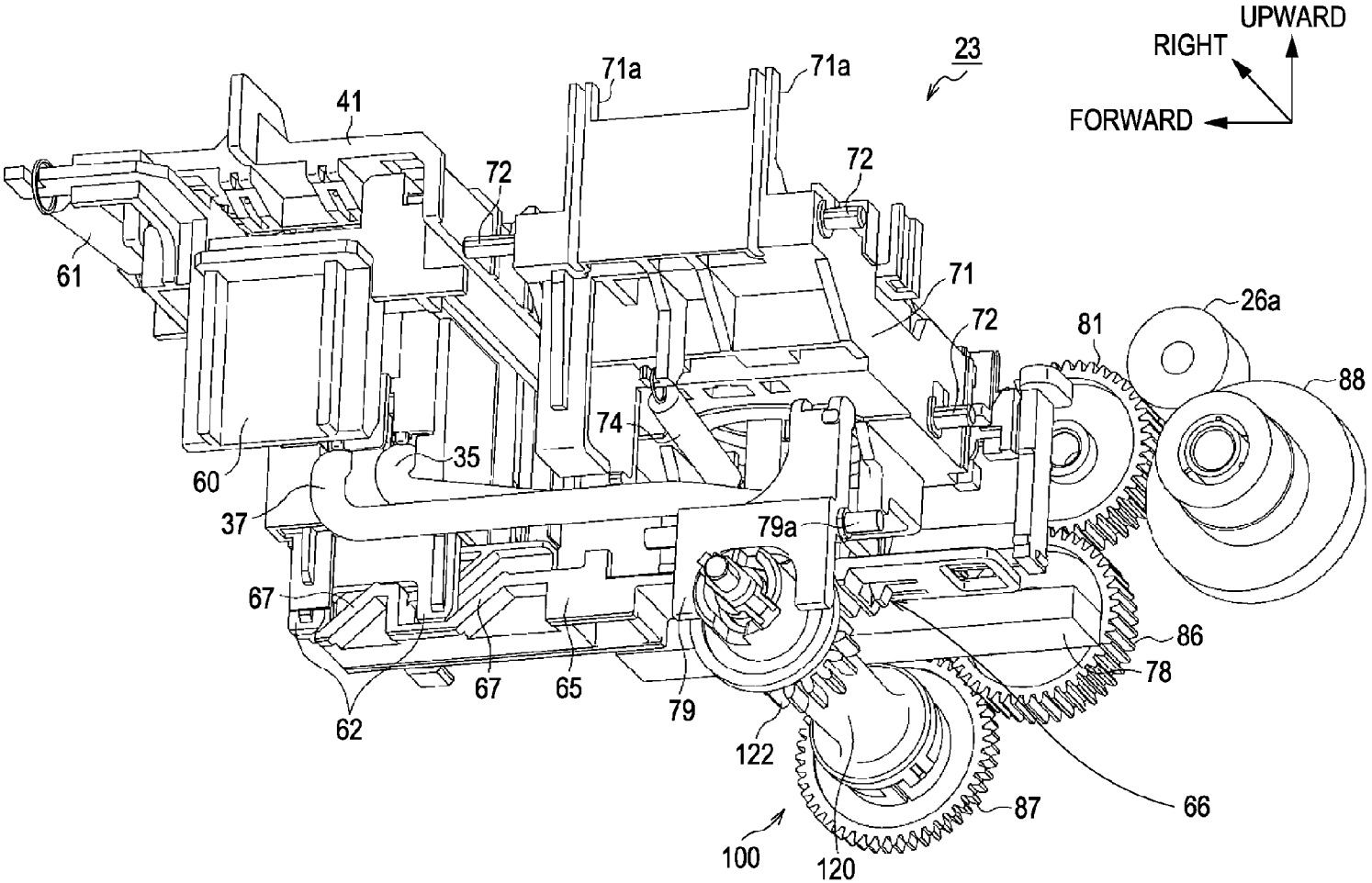
FIG. 5 is a perspective view of the maintenance device viewed obliquely from below in a right rearward direction in the state where the frame is excluded.

On the other hand, the fourth transmission gear 87 is configured to raise and lower the selective blocking mechanism 40 (the base 60). That is, as illustrated in FIGS. 4 and 5, the fourth transmission gear 87 rotates a clutch gear 122 provided in a clutch member 120 (here, the CW rotation) thereby moving a rack slider 65 as a slide member in which a rack 66 is formed in the forward direction. That is, the rack 66 is always engaged with the clutch gear 122, and as the rack 66 is moved forward by the rotation of the clutch gear 122, the rack slider 65 is slid forward.

On the forward side of the rack slider 65, two inclined surface portions 67 which are inclined forward are provided. When the rack slider 65 is moved forward while two protruding portions 62 extending downward from the base 60 with predetermined width are caused to abut on the inclined surface portions 67, the extending portions 62 are raised along the inclined surface portions 67, and consequently the base 60 is also raised. Contrary to this, when the rack slider 65 is moved rearward, the extending portions 62 of the base 60 are lowered along the inclined surface portions 67, so that the base 60 is also lowered. As described above, by the rack slider 65 in which the rack 66 engaged with the clutch gear 122 that rotates along with the fourth transmission gear 87 and the inclined surface portions 67 that come in sliding contact with the extending portions 62 of the base 60 are formed, a part of the separation and approach movement unit which causes the selective blocking mechanism 40 to be separated from or approach the carriage 16 by elevating the base 60 is configured.

In addition, in the separation and approach movement unit, the clutch member 120 is switched between two states including a state of transmitting the rotation of the fourth transmission gear 87 to the sliding movement of the rack slider 65 (this is called an "ON state") and a state of not transmitting the rotation thereof to the sliding movement of the rack slider 65 (this is called an "OFF state"). In this embodiment, as illustrated in FIG. 5, by using a lever member 79 as a displacement member which rotates and is displaced around a rotation shaft portion 79*a* that is axially supported by the frame body 29 so as to be rotatable, the clutch member 120 is switched between the ON state and the OFF state. As such, including the clutch member 120 and the fourth transmission gear 87 as the rotation unit, the clutch mechanism 100 that switches the rotation transmission state between the fourth transmission gear 87 and the clutch member 120 and the lever member 79 as the displacement member constitute the power transmission switching device.

Figure 6:
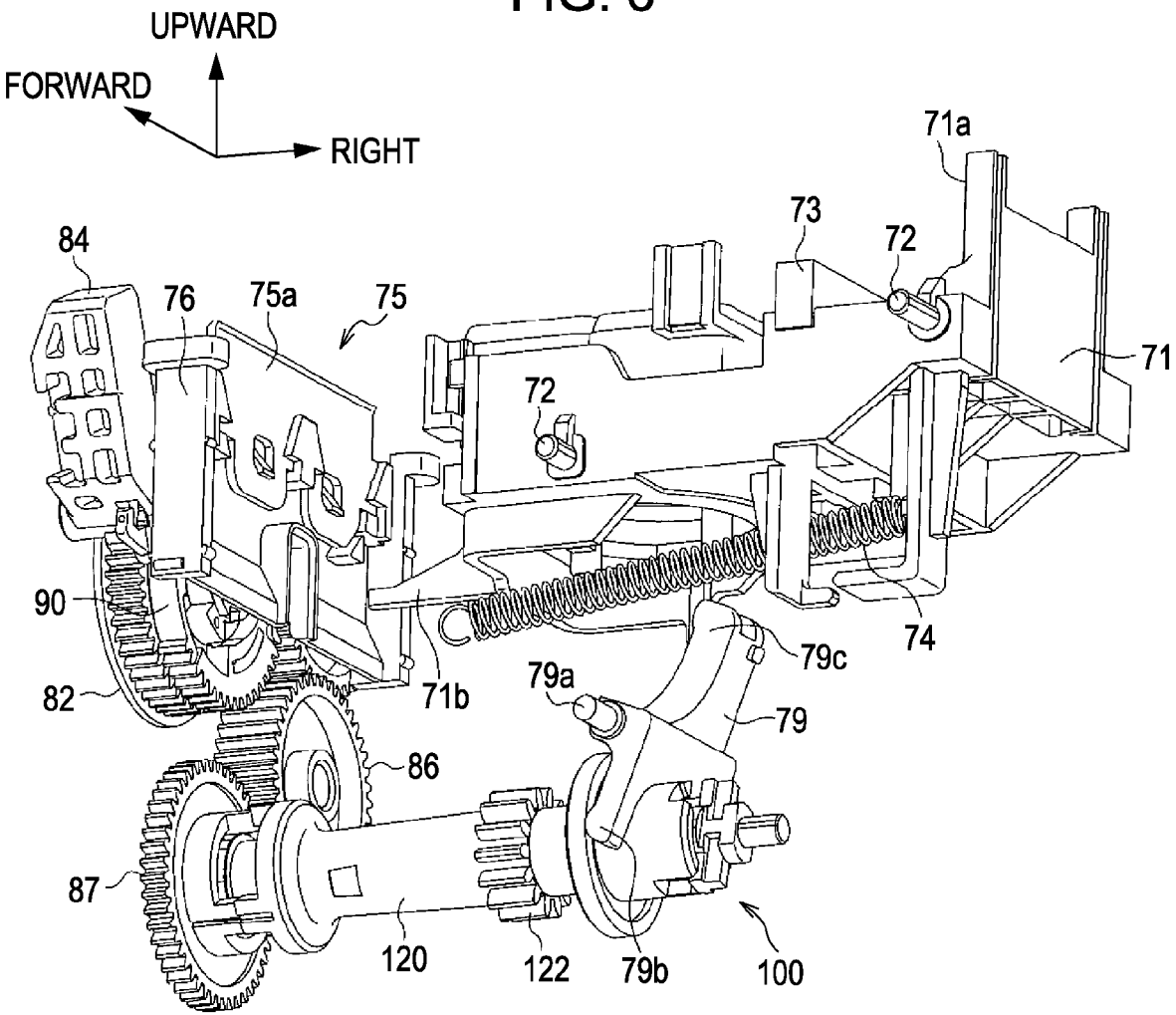
FIG. 6 is a perspective view illustrating the configurations of an elevation mechanism and a clutch mechanism of a wiper and a lock lever.

That is, as illustrated in FIG. 6, in the state where the cap holding member 71 is moved to the right as the carriage 16 is moved to the maintenance area MA, an upper end portion 79*c* which is one end side of the lever member 79 abuts on a lower surface portion 71*c* formed on the lower surface of the cap holding member 71. The lever member 79 rotates around the rotation shaft portion 79*a* by this abutting operation and is displaced so that a lower end portion 79*b* which is the other end side thereof is moved to the left. By the displacement of the lever member 79, switching of the rotation transmission state between the fourth transmission gear 87 and the clutch gear 122 in the clutch mechanism 100 is allowed.

In addition, as illustrated in FIG. 6, in the cap holding member 71, a stopper 71*b* protruding forward from the left end thereof is formed. The stopper 71*b* restricts the rotation by being engaged with the cam gear 90 in the state where each support bar 72 in the cap holding member 71 is positioned on the lower side flat portion 29*b* of the corresponding penetration groove 28 of the frame body 29. On the other hand, in the state where the cap holding member 71 is moved to the right as the carriage 16 is moved to the maintenance area MA, the stopper 71*b* is separated from the cam gear 90 and releases the rotation restriction, thereby entering a state where the elevating movement of the wiper 75 and the rotation of the lock lever 84 are allowed.

Next, the configurations of the cam shape of the cam gear 90 which rotatably drives the lock lever 84 and the cam groove of the cam gear 90 which raises or lowers the wiper 75 will be described with reference to FIGS. 7A to 9C. Thereafter, the configuration for switching between the ON state and the OFF state in the clutch mechanism 100 will be described with reference to FIGS. 10 to 15.

Figures 7A, 7B:
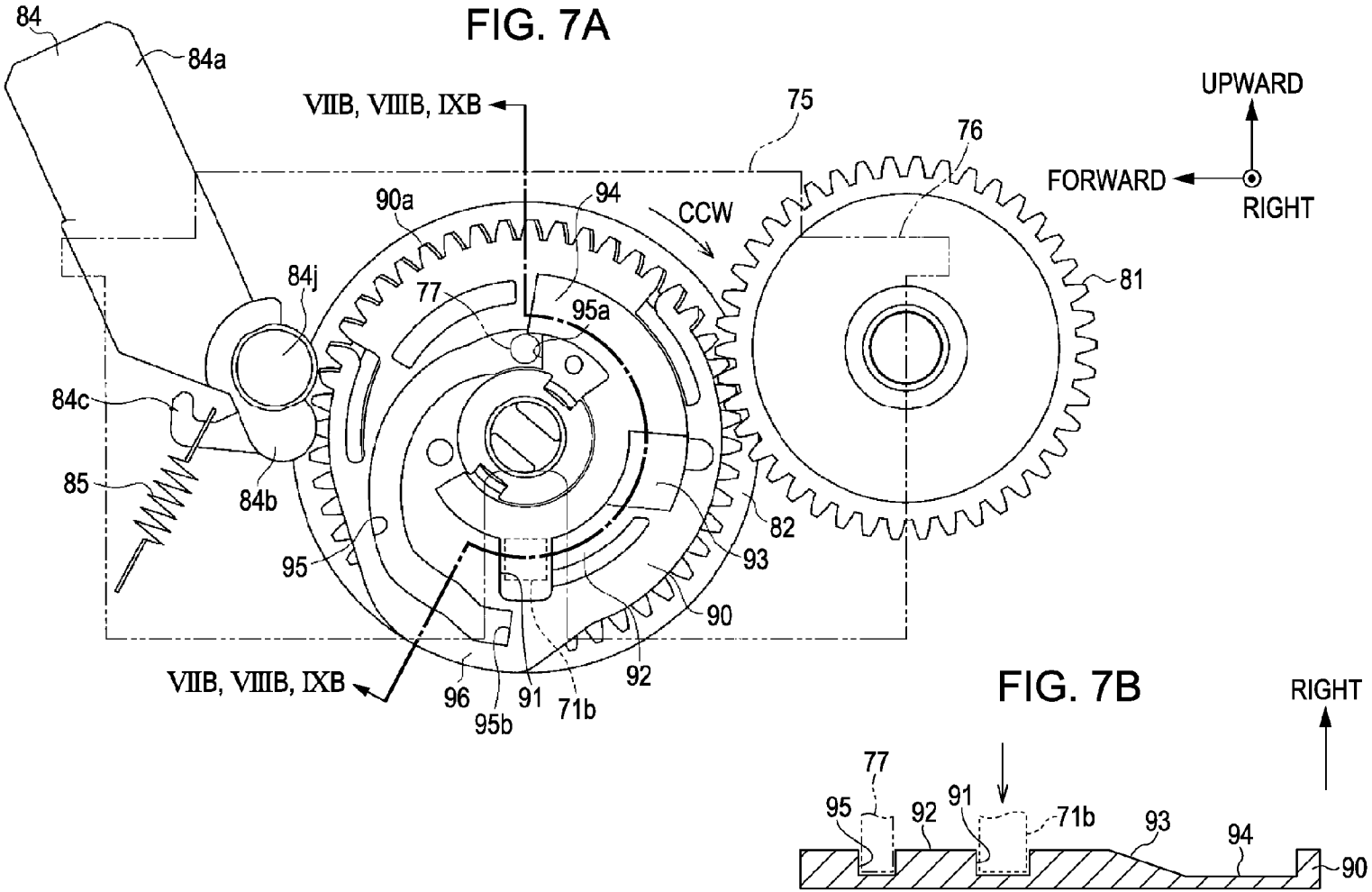
FIG. 7A is a front view illustrating the state of the elevation mechanism where the wiper and the lock lever are at retreat positions.
FIG. 7B is a schematic cross-sectional view taken along the line VIIB-VIIB in FIG. 7A.
Figure 8A:
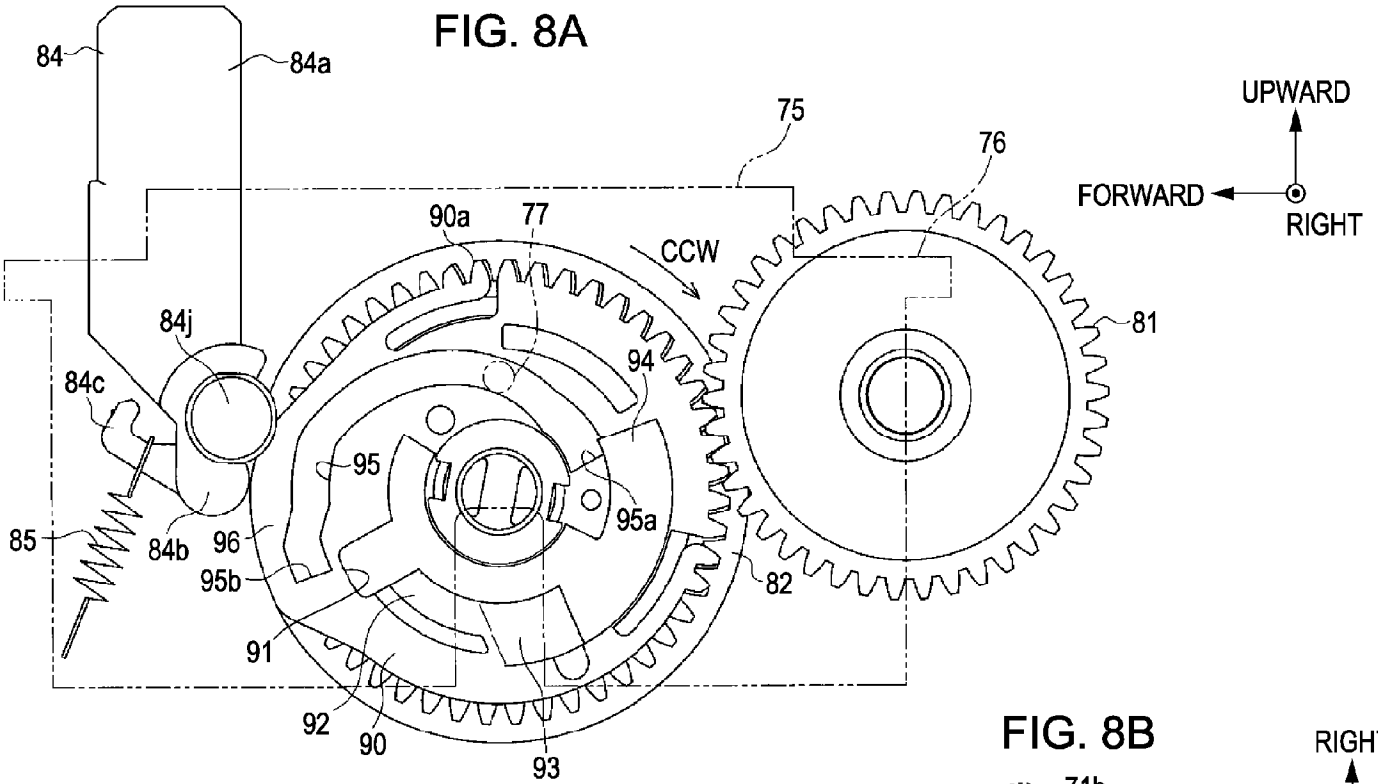
FIG. 8A is a front view illustrating the state of the elevation mechanism where the lock lever is a lock position.
Figure 9A:
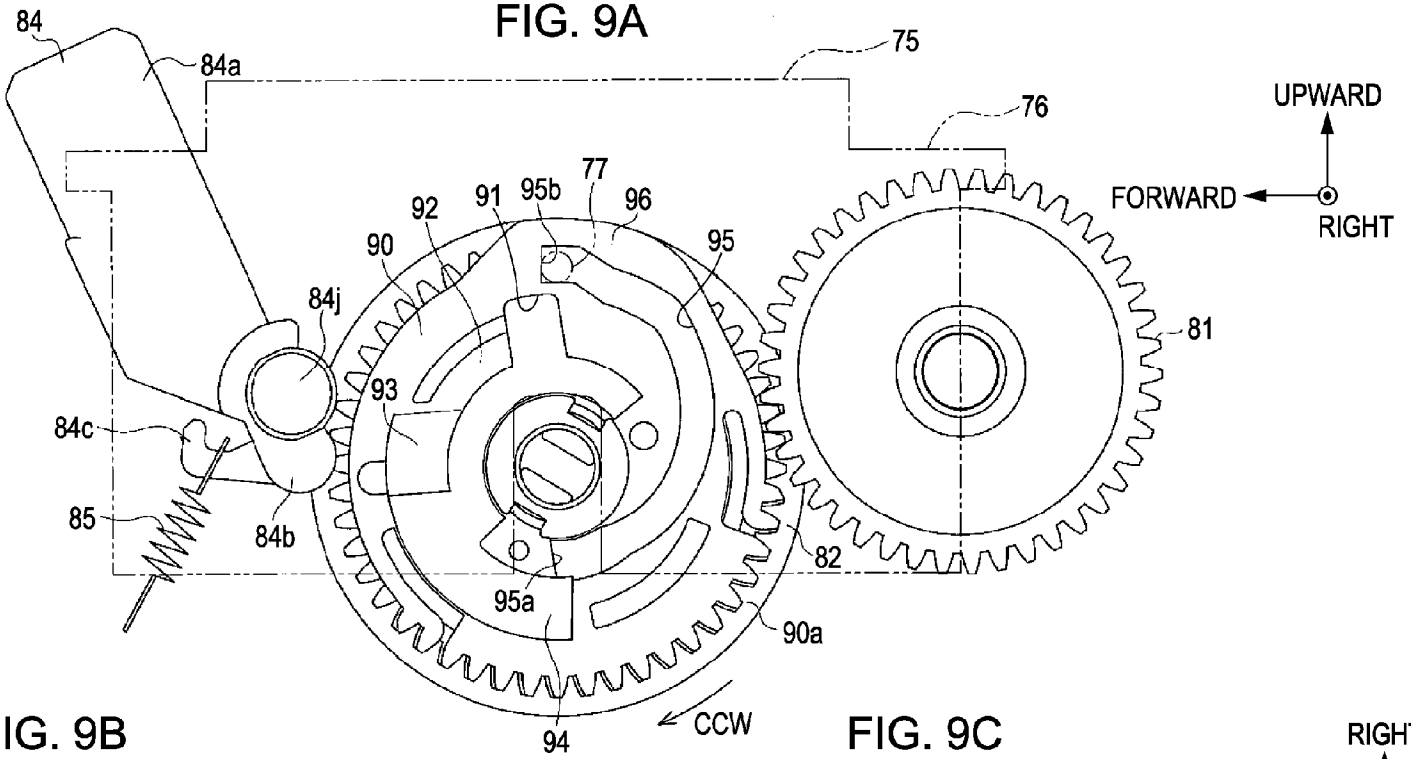
FIG. 9A is a front view illustrating the state of the elevation mechanism where the wiper is at a wiping position and the lock lever is at the retreat position.

As illustrated in FIG. 7A, a part of the outer peripheral surface of the cam gear 90 is a convex portion 96 protruding outward in the diameter direction in a substantially trapezoidal shape. Both end portions of the outer peripheral surface of the convex portion 96 are inclined surfaces of which the distances from the shaft center of the cam gear 90 in the radial direction are gradually changed, and the tip end portion of the outer peripheral surface thereof is an arc surface. Therefore, in a procedure in which the cam gear 90 is rotated in one direction, when the inclined surface on a rotation starting end side of the convex portion 96 is engaged with a protrusion 84*b* on the lower end side of the lock lever 84, an upper end portion 84*a* of the lock lever 84 is raised. In addition, as illustrated in FIG. 8A, in a procedure in which the arc surface of the convex portion 96 is engaged with the protrusion 84*b*, the upper end portion 84*a* is substantially erected and is maintained at a lock position at which the movement of the carriage 16 is restricted. When the cam gear 90 is continuously rotated and the inclined surface on a rotation ending end side of the convex portion 96 is engaged with the protrusion 84*b*, the upper end portion 84*a* is lowered, and as illustrated in FIG. 9A, returns to its original position (retreat position) illustrated in FIG. 7A. In this manner, the convex portion 96 of the cam gear 90 is formed.

In addition, on the end surface of the cam gear 90 which is on the opposite side to the surface (clutch surface) abutting on the second transmission gear 82, a cam groove 95 with which a guide pin 77 protruding from the wiper holding member 76 of the wiper 75 toward the cam gear 90 is engaged is formed. The cam groove 95 is formed on a predetermined path so that the distance from the shaft center of the cam gear 90 to the cam groove 95 in the radial direction is gradually increased as the cam gear 90 undergoes the CCW rotation. In addition, in a procedure in which the guide pin 77 runs from one end to the other end of the cam groove 95, the amount of deviation from the shaft center of the cam gear 90 to the cam groove 95 in the radial direction is the same as the elevation stroke length of the wiper 75. Therefore, as illustrated in FIG. 9A, when the guide pin 77 is moved upward by being guided by the cam groove 95, the wiper 75 is raised by the elevation stroke length from the retreat position and is disposed at a wiping position for wiping the liquid ejecting head 19. Originally, when the cam gear 90 is reversed (here, the CW rotation), the guide pin 77 inserted into the cam groove 95 is moved downward by being guided by the cam groove 95, and thus reaches its original position illustrated in FIG. 7A. Accordingly, the wiper 75 is lowered by the elevation stroke length from the wiping position and is disposed at the retreat position.

In addition, as illustrated in FIG. 7A, in the cam gear 90, a locking concave portion 91 is formed at a position on the opposite side to the cam groove 95 with the shaft center interposed therebetween. The locking concave portion 91 constitutes a locked portion with which the stopper 71*b* protruding forward from the cap holding member 71 when the cap holding member 71 (the cap 27) is lowered and is at the retreat position where the cap 27 is separated from the liquid ejecting head 19 is engaged so as to stop the rotation of the cam gear 90.

That is, as illustrated in FIG. 7B, when the wiper 75 and the lock lever 84 are at the retreat position, the stopper 71*b* is inserted into the locking concave portion 91 of the cam gear 90. Therefore, when the cap 27 is at the retreat position, by the locking operation of the stopper 71*b*, the wiper 75 and the lock lever 84 are in a locked state of being locked at the retreat position. In this state, the rotation of the cam gear 90 is restricted by the locking operation of the stopper 71*b* against a rotating load that exceeds a predetermined load. Therefore, even when the power from the motor 26 is transmitted to the second transmission gear 82 so as to be rotated, slipping occurs in the frictional clutch between the cam gear 90 and the second transmission gear 82, and the second transmission gear 82 enters an idling state.

Figure 8B:
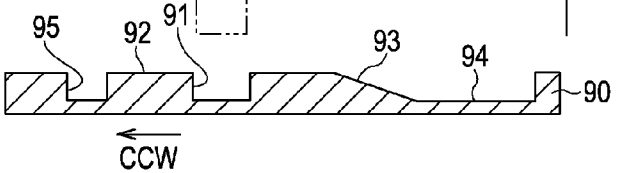
FIG. 8B is a schematic cross-sectional view taken along the line VIIIB-VIIIB in FIG. 7A.

In addition, as illustrated in FIG. 8B, when the stopper 71*b* is disengaged from the locking concave portion 91 as the cap holding member 71 is raised, the cam gear 90 is in a state of being rotated (here, the CCW rotation), so that the wiper 75 can be raised from the retreat position to the wiping position.

Figure 9C:
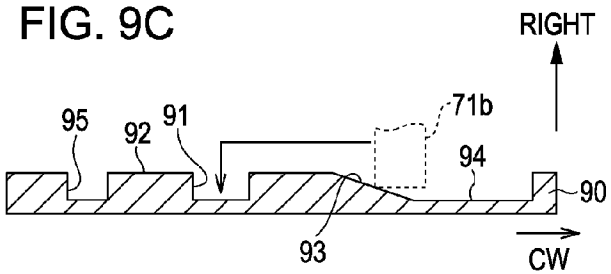
FIGS. 9B and 9C are schematic cross-sectional views taken along the line IXB-IXB in FIG. 7A.
Figure 9B:
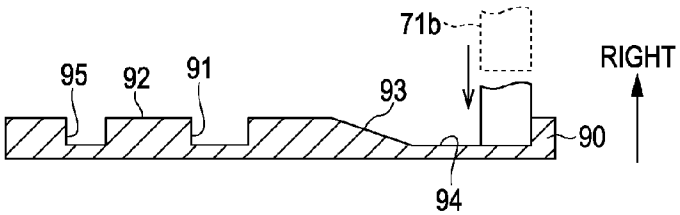

In the cam gear 90, a concave portion 94 is formed at a position opposing the stopper 71*b* returned to the left end position which is the locking position as the carriage 16 is moved to the left from the maintenance area MA and the cap holding member 71 is lowered in a state where the wiper 75 is at the wiping position illustrated by the double-dot-dashed line of FIG. 9A. In a state in which the carriage 16 becomes distant from the maintenance area MA in order to move to the printing area PA from the maintenance area MA after terminating an ink suctioning operation, the cap 27 is lowered before the liquid ejecting head 19 is wiped by the wiper 75, and the stopper 71*b* that moves to the left due to the lowering operation is inserted into the concave portion 94 of the cam gear 90 as illustrated in FIG. 9B.

In addition, an inner wall surface in a movement direction in which the stopper 71*b* inserted into the concave portion 94 moves relative to the cam gear 90 when the cam gear 90 tries to be reversed and undergo the CW rotation in the state where the stopper 71*b* is inserted into the concave portion 94 is formed as an inclined surface 93. The inclined surface 93 is an inclined surface of which the depth is gradually reduced from the same depth as that of the bottom surface of the concave portion 94 toward the relative movement direction of the stopper 71*b* during the CW rotation of the cam gear 90. Therefore, when the motor 26 undergoes the CW rotation in the state illustrated in FIG. 9B, the stopper 71*b* rides on the inclined surface 93 and can escape from the concave portion 94 as illustrated in FIG. 9C, and thus the CW rotation, that is, reversal of the cam gear 90 is allowed. As such, the inclined surface 93 is a movement allowing surface which allows the movement of the stopper 71*b* on the path on which the stopper 71*b* reaches the locking concave portion 91 from the concave portion 94 so as to allow the reversal of the cam gear 90 for moving the wiper 75 from the wiping position to the retreat position.

Moreover, on the outer peripheral surface of the cam gear 90, tooth portions 90*a* are formed substantially on the opposite side to the concave portion 96 at positions reaching a predetermined angle range (in this example, about 90 degrees). The tooth portions 90*a* are formed in a predetermined section on the outer peripheral surface of the cam gear 90 so as to be directly engaged with the first transmission gear 81 when the wiper 75 which is elevated as the guide pin 77 is guided by the cam groove 95 during the rotation of the cam gear 90 is in a midway area of the elevation stroke excluding the retreat position and the wiping position. That is, the tooth portions 90*a* are formed in the predetermined section on the outer peripheral surface of the cam gear 90 so as to be directly engaged with the first transmission gear 81 when the cam gear 90 is in a midway area of a limited rotation range.

Therefore, when the first transmission gear 81 is rotated, since power is directly transmitted to the tooth portions 90*a* from the first transmission gear 81 when the wiper 75 is at the midway area of the elevation stroke, the cam gear 90 is reliably rotated. In addition, a part where the tooth portions 90*a* are not formed on the outer peripheral surface of the cam gear 90 has an arc surface that cannot be engaged with the first transmission gear 81, and thus when the cam gear 90 is at rotation positions at which the guide pin 77 is disposed in the vicinities of both ends of the cam groove 95, the cam gear 90 cannot be engaged with the first transmission gear 81. Therefore, when the first transmission gear 81 is not engaged with the tooth portions 90*a*, rotation is transmitted to the cam gear 90 only through the frictional engagement with the second transmission gear 82.

In addition, when the guide pin 77 abuts on one end surface 95*a* of the cam groove 95, slipping occurs in the frictional clutch and the second transmission gear 82 idles, so that further rotation (CW rotation) of the cam gear 90 is restricted. In addition, even when the guide pin 77 abuts on the other end surface 95*b* of the cam groove 95, similarly, slipping occurs in the frictional clutch and the second transmission gear 82 idles, so that further rotation (CCW rotation) of the cam gear 90 is restricted. As such, the frictional clutch mechanism is configured so that even when the second transmission gear 82 is continuously rotated in a certain direction, the cam gear 90 is reciprocated only in the predetermined angle range.

Consequently, as illustrated in FIG. 7A, in a range at the midway of the rotation range of the cam gear 90 which is reciprocated only in the predetermined angle range, the central angle of the formation position and the formation range of the convex portion 96 with respect to the cam gear (in this example, about 30 degrees) is set so that the concave portion 96 is engaged with the protrusion 84*b* of the lock lever 84. Therefore, after the cam gear 90 undergoes the CCW rotation by a predetermined rotation amount from the initial position illustrated in FIG. 7B, the concave portion 96 starts to be engaged with the protrusion 84*b*. As a result, as illustrated in FIGS. 7A to 9C, in the maintenance device 23, first, the wiper 75 starts to be raised, and the lock lever 84 starts to be raised during the raising operation and reaches the locked position. From this, after the cam gear 90 is further rotated by about 30 degrees, the lock lever 84 is lowered from the locked position and is returned to the retreat position, and thereafter the wiper 75 is operated to reach the wiping position.

Figure 10:
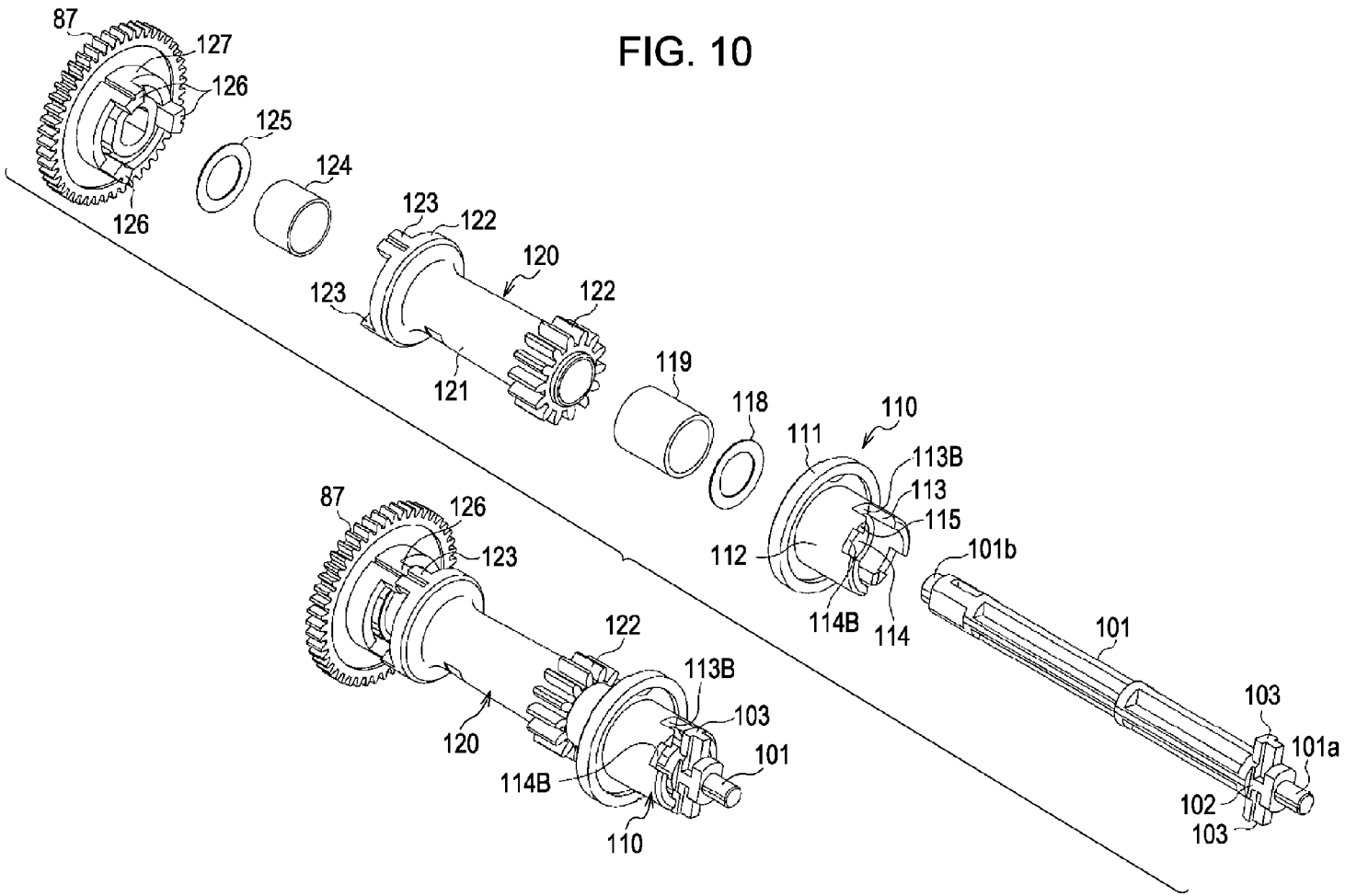
FIG. 10 is an exploded perspective view illustrating constituent components in the clutch mechanism.

Next, the configuration of a mechanism for switching between the ON state and the OFF state in the clutch mechanism 100 will be described. As illustrated in FIG. 10, the clutch mechanism 100 of this embodiment is configured of a clutch shaft 101, a locking portion 102, an engagement member 110, a washer 118, a first coil spring 119 as a first direction impelling member, the clutch member 120, a second coil spring 124 as a second direction impelling member, a washer 125, and the fourth transmission gear 87. In addition, the first direction impelling member and the second direction impelling member exhibit impelling directions in a certain state and are not members that are impelled always in a constant direction.

The clutch shaft 101 functions as a rotation shaft and shaft portions which are axially supported by the frame body 29 to be rotatable are formed at shaft end portions 101*a* and 101*b* on both sides thereof. At the shaft end portion 101*a* on one side, the locking portion 102 having two protruding portions 103 which protrude in a direction intersecting the axial direction by predetermined amounts at positions having an opposite angle with the clutch shaft 101 as the center is provided to rotate integrally with the clutch shaft 101. In addition, in this embodiment, the locking portion 102 is formed integrally with the clutch shaft 101. Originally, the locking portion 102 may be formed as a different body from the clutch shaft 101 and be fixed to the clutch shaft 101 to rotate integrally with the clutch shaft 101.

From the shaft end portion 101*b* side which is the first direction side in the clutch shaft 101, the engagement member 110 is inserted so that the clutch shaft 101 penetrates therethrough. The engagement member 110 has a disk portion 111 formed in an awning shape on the shaft end portion 101*a* side which is the second direction side at the peripheral edge, and a cylindrical portion 112 with a smaller diameter than that of the disk portion 111. In the cylindrical portion 112, a first engagement portion 113 and a second engagement portion 114 which abut on and are engaged with the protruding portions 103 in the axial direction are formed. The first and second engagement portions 113 and 114 have groove shapes that dig out the cylindrical portion 112 from the end surface on the second direction side which is opposite to the first direction, in the first direction along the axial direction of the clutch shaft 101. In addition, in this embodiment, the first engagement portion 113 is formed in a groove shape that is deeper than that of the second engagement portion 114. That is, a groove bottom surface 113B of the first engagement portion 113 and a groove bottom surface 114B of the second engagement portion 114 are formed so that they are at positions separated from each other in the axial direction of the clutch shaft 101, specifically, the groove bottom surface 113B of the first engagement portion 113 is positioned further toward the first direction side than the groove bottom surface 114B of the second engagement portion 114. In addition, the widths of the groove shapes, that is, the dimensions in the rotation direction are slightly greater than those of the protruding portions 103, such that the protruding portion 103 moves to the first engagement portion 113 or the second engagement portion 114 in the axial direction and thus abuts on and is engaged with the groove bottom surface 113B or the groove bottom surface 114B.

In addition, between the groove of the first engagement portion 113 and the groove of the second engagement portion 114, a wall portion 115 having a predetermined height from the end surface in the axial direction of the groove portion of the second engagement portion 114 (the groove bottom surface 114B) in the second direction is formed. The wall portion 115 is provided so as to suppress the protruding portion 103 from rotating and moving between the first and second engagement portions 113 and 114. That is, in the case where the protruding portion 103 rotates along with the clutch shaft 101, during the rotation of the clutch shaft 101 in the state where the protruding portion 103 is engaged with the second engagement portion 114, the wall portion 115 is formed to have a height that maintains the engaged state in the rotation direction.

Subsequently, the clutch shaft 101 penetrates through the washer 118 and the first coil spring 119. Due to the washer 118, relative rotation between the first coil spring 119 and the engagement portion 110 can be smoothly performed.

Next, the clutch shaft 101 penetrates through the clutch member 120. The clutch member 120 has a clutch body 121 which is a shaft portion in a substantially cylindrical shape, and the clutch gear 122 is formed on the outer peripheral surface of the end portion of the clutch body 121 on the first coil spring 119 side. In addition, in the clutch body 121 on the opposite side to the clutch gear 122 in the axial direction, a plurality of (here, three) driven-side protruding portions 123 which protrude from the base end portion of the clutch body 121 along the axial direction of the clutch shaft 101 in the first direction on the opposite side to the first coil spring 119 are formed at predetermined intervals.

Subsequently, the clutch shaft 101 penetrates through the second coil spring 124 and the washer 125. Due to the washer 125, relative rotation between the second coil spring 124 and the fourth transmission gear 87 can be smoothly performed. In addition, the spring force of the second coil spring 124 is smaller than the spring force of the first coil spring 119.

Last, the fourth transmission gear 87 as the rotation unit is mounted to the shaft end portion 101*b* side of the clutch shaft 101 so as to rotate integrally with the clutch shaft 101. The fourth transmission gear 87 has a cylindrical shape portion 127 on the side opposing the clutch member 120. In addition, in the outer periphery of the cylindrical shape portion 127, a plurality of (here, three) driving-side protruding portions 126 which protrude from the base end portion of the cylindrical shape portion 127 along the axial direction of the clutch shaft 101 so as to correspond to the respective driven-side protruding portions 123 of the clutch body 121 are formed at predetermined intervals in the outer peripheral direction.

The clutch mechanism 100 is configured as such. Therefore, the engagement member 110, the washer 118, the first coil spring 119, and the clutch member 120 can be rotated concentrically around the clutch shaft 101 and be moved along the axial direction of the clutch shaft 101. On the other hand, the fourth transmission gear 87 and the clutch shaft 101 are not moved in the axial direction. In addition, the spring force of the second coil spring 124 compressed during the movement is set so that the compression force of the compressed second coil spring 124 is always smaller than the compression force of the first coil spring 119. In addition, the engagement member 110 and the clutch member 120 can be rotated relative to the clutch shaft 101.

However, the maintenance device 23 including the clutch mechanism 100 having such a configuration is configured so that whether or not the rotation of the fourth transmission gear 87 is transmitted to the rotation of the clutch gear 122, that is, whether the ON state or the OFF state is switched to, accords with whether the protruding portion 103 is engaged with the first engagement portion 113 or the second engagement portion 114. Regarding this switching mechanism, the configuration of a mechanism for switching will be described with reference to FIGS. 11 to 15. In addition, for the convenience of description, the clutch mechanism 100 that is initially in the OFF state is described.

Figure 11:
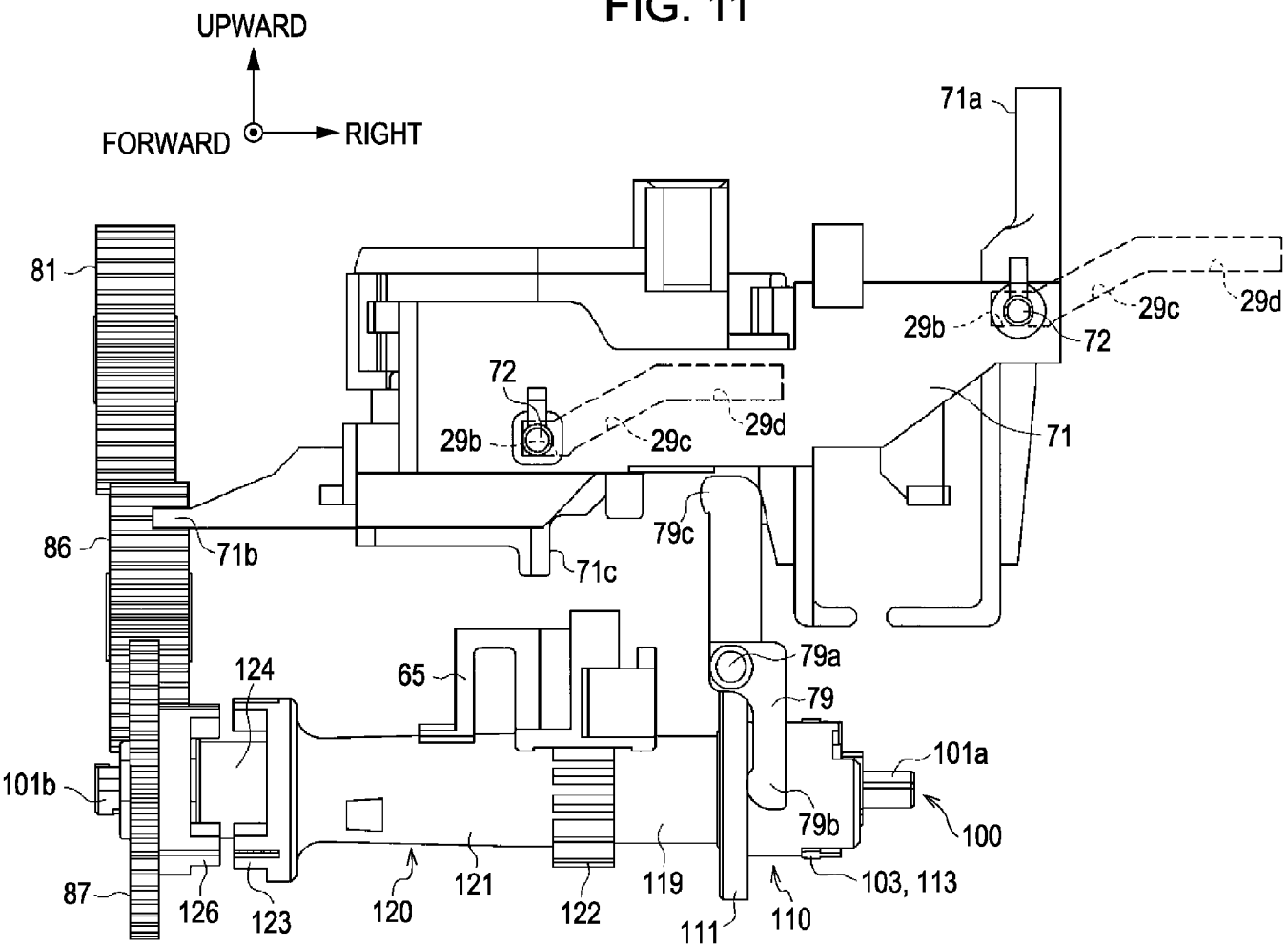
FIG. 11 is a front view illustrating constituent components related to the clutch mechanism in an OFF state as viewed from the front.

As illustrated in FIG. 11, in the state where the carriage 16 is moved to, for example, the printing area PA and does not abut on the cap holding member 71, each support bar 72 is positioned on the lower side flat portion 29*b* in the penetration groove 28. In this state, the lower surface portion 71*c* of the cap holding member 71 is separated from the upper end portion 79*c* of the lever member 79. Therefore, the lower end portion 79*b* of the lever member 79 is in a state of not exerting an external force on the disk portion 111 of the engagement member 110. Accordingly, the clutch member 120 is impelled toward the right by the second coil spring 124 with respect to the fourth transmission gear 87. In addition, the engagement member 110 is impelled toward the right by the first coil spring 119 with respect to the clutch member 120. Here, the protruding portion 103 of the clutch shaft 101 is engaged with the first engagement portion 113 in the cylindrical portion 112 of the engagement member 110. Therefore, the engagement member 110 is at a position that approaches the farthest position on the right with respect to the clutch shaft 101. As a result, the driven-side protruding portion 123 formed in the clutch member 120 is in a state of being separated from the driving-side protruding portion 126 formed in the fourth transmission gear 87 in the axial direction so as not to be engaged, that is, in the OFF state. In addition, here, the first coil spring 119 is in a state of not substantially being compressed, that is, has a substantially free length. In addition, the second coil spring 124 is in a slightly compressed state or has a substantially free length.

Figure 12:
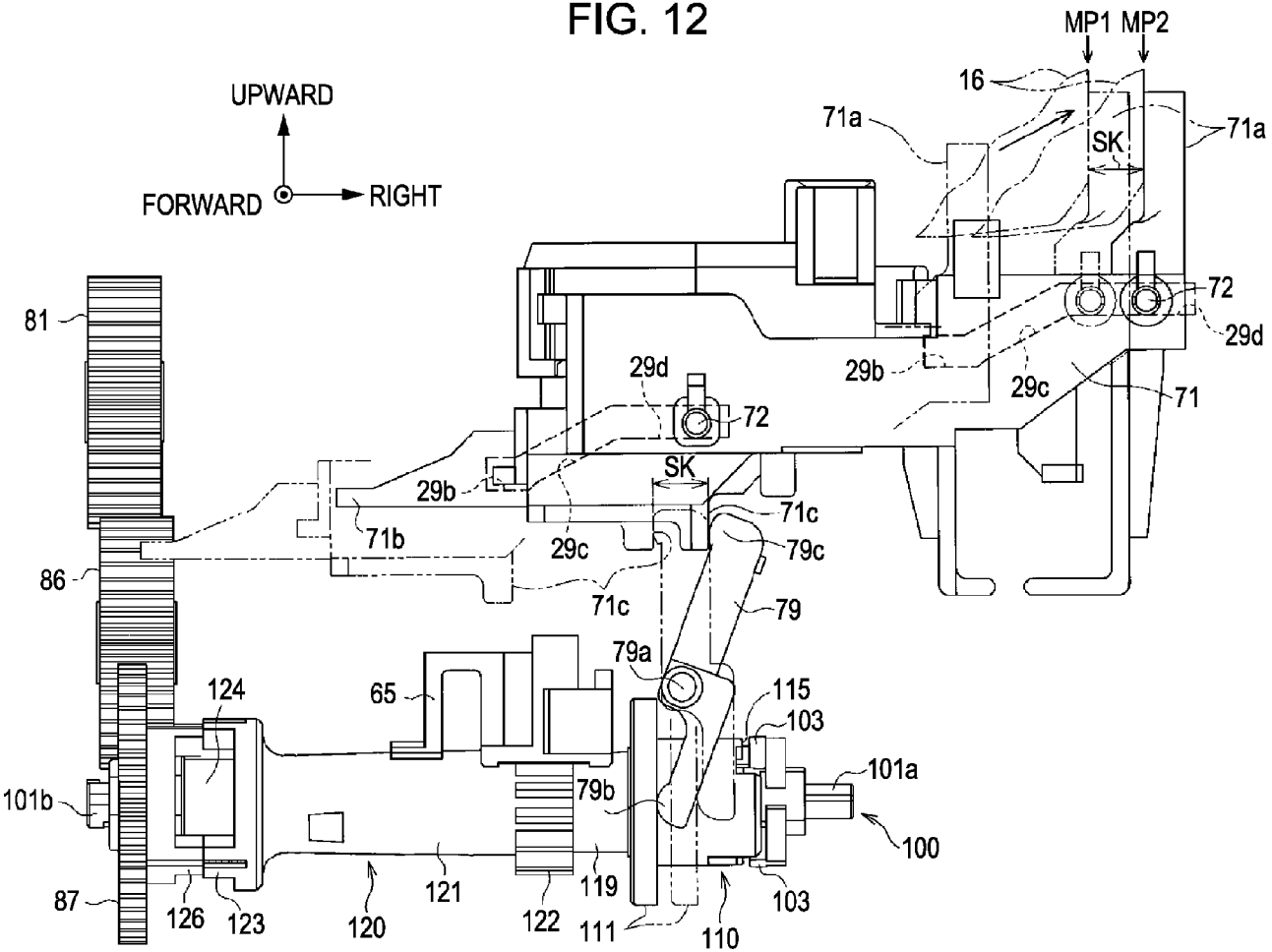
FIG. 12 is a front view illustrating constituent components related to the clutch mechanism in a state of being switched from the OFF state to an ON state as viewed from the front.

Next, as illustrated in FIG. 12, when the carriage 16 is moved to the maintenance area MA, each support bar 72 of the cap holding member 71 is positioned on the upper side flat portion 29*d* in the penetration groove 28. Here, in this embodiment, each support bar 72 is moved to the left end position (this is called a "first maintenance position MP1") in the upper side flat portion 29*d*, and the lower surface portion 71*c* of the cap holding member 71 is in a state of nearly abutting on the upper end portion 79*c* of the lever member 79.

Thereafter, as each support bar 72 is moved to a position separated by a distance SK to the right along the upper side flat portion 29*d* (this is called a "maintenance position MP2"), the upper end portion 79*c* of the lever member 79 is moved to the right. Therefore, by the movement of the distance SK of the cap holding member 71, the lever member 79 rotates and is displaced around the rotation shaft portion 79*c*, and the lower end portion 79*b* of the lever member 79 abuts on and presses the disk portion 111 of the engagement member 110 in the left direction. In addition, the engagement member 110 is in a state of being moved to the left against the impelling forces of the first and second coil springs 119 and 124.

Due to the movement of the engagement member 110 to the left, the first and second coil springs 119 and 124 are compressed. Here, since the compression force of the second coil spring 124 is smaller than that of the first coil spring 119, due to the movement of the engagement member 110 to the left, the compression amount of the second coil spring 124 becomes greater than that of the first coil spring 119. As the second coil spring 124 is compressed, the clutch member 120 is moved to the left. When the clutch member 120 is moved to a position hitting against the fourth transmission gear 87, the first coil spring 119 is compressed. In this state, since the compression force of the first coil spring 119 is greater than that of the second coil spring 124, the clutch member 120 is impelled toward the left. In FIG. 12, the tip ends of the driven-side protruding portion 123 of the clutch member 120 and the driving-side protruding portion 126 of the fourth transmission gear 87 abut on each other (similarly in FIG. 13). From this state, when the fourth transmission gear 87 is rotated, the driven-side protruding portion 123 and the driving-side protruding portion 126 deviate from each other in the rotation direction. In addition, since the clutch member 120 is impelled toward the left, the clutch member 120 is moved to the left. In addition, as in FIG. 14, a predetermined amount of the driven-side protruding portion 123 is engaged with the driving-side protruding portion 126 in the left and right direction. By this engagement in the left and right direction, the rotation of the fourth transmission gear 87 is transmitted to the clutch member 120, thereby rotating the clutch gear 122 of the clutch member 120. Therefore, the fourth transmission gear 87 functions as the rotation unit, and the clutch member 120 functions as a rotation transmission unit.

Figure 13:
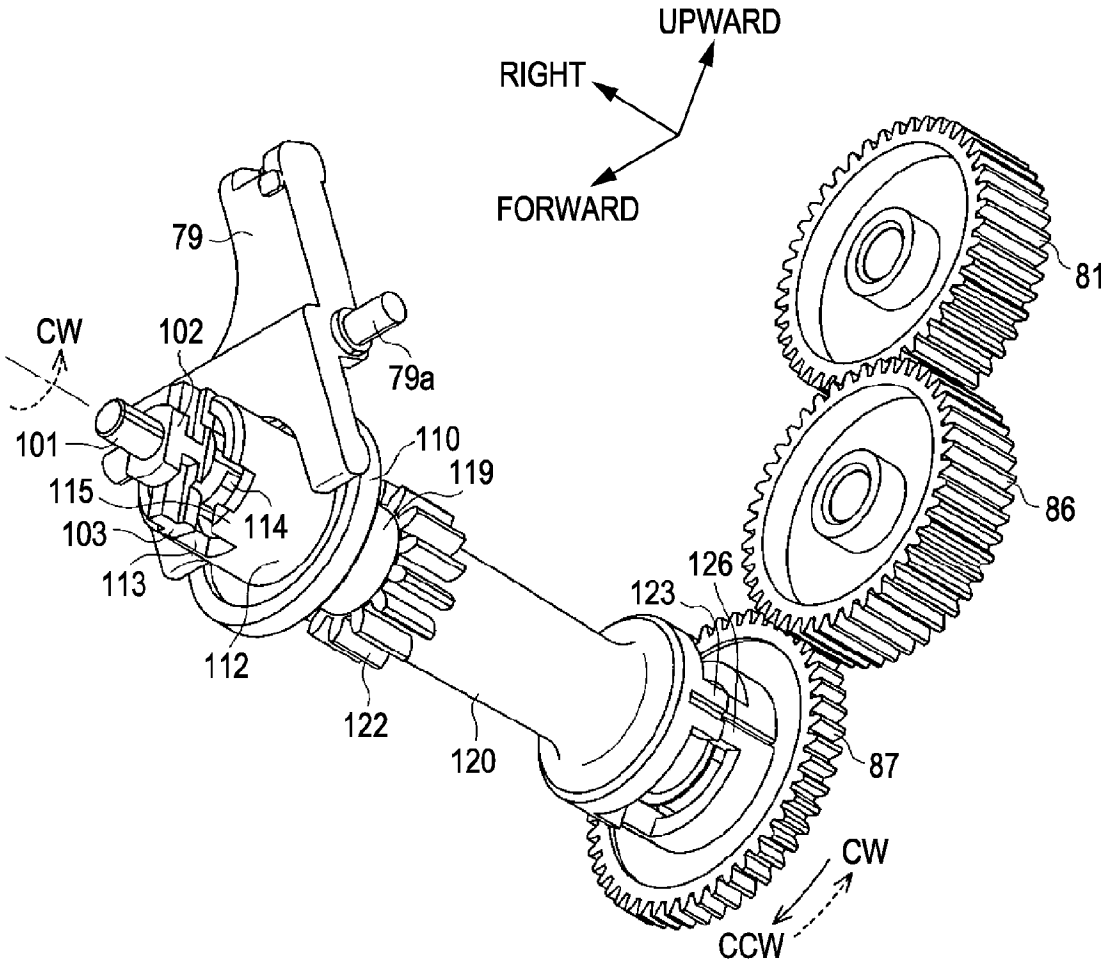
FIG. 13 is a perspective view illustrating the configuration of a mechanism for switching the clutch mechanism from the OFF state to the ON state.
Figure 14:
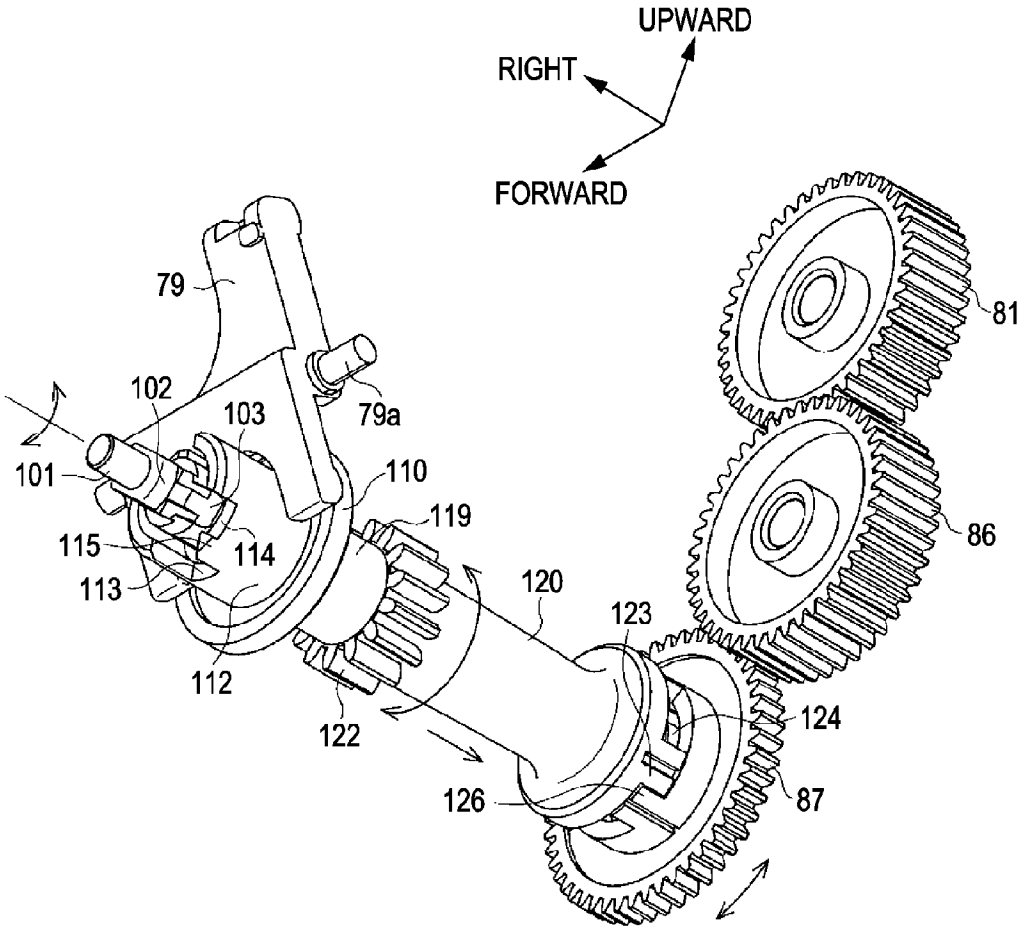
FIG. 14 is a perspective view illustrating a state where the clutch mechanism is switched from the OFF state to the ON state.

However, in the state where the engagement member 110 is moved to the left, as illustrated in FIG. 13, the wall portion 115 of the engagement member 110 is positioned further toward the left than the protruding portion 103. That is, the protruding portion 103 enters a state of being moved between the first engagement portion 113 and the second engagement portion 114 by the rotation of the clutch shaft 101. Therefore, in this embodiment, the left direction along the axial direction is the first direction and the right direction is the second direction. In this state, as the fourth transmission gear 87 is rotated by the motor 26 (here, the CW rotation), the protruding portion 103 is rotated relative to the engagement member 110 by a predetermined angle via the clutch shaft 101 and the locking portion 102. As a result, as illustrated in FIG. 14, the protruding portion 103 is rotated from a position separated from the first engagement portion 113, passes through the right side of the wall portion 115, and is moved to a position facing the second engagement portion 114 in the left and right direction (the axial direction of the clutch shaft 101).

However, when the clutch member 120 is moved to the left, as illustrated in FIGS. 12 and 13, according to the rotation state of the fourth transmission gear 87, there may be cases where the driven-side protruding portion 123 abuts on the driving-side protruding portion 126 in the axial direction, that is, in the left and right direction (that is, the end surfaces thereof come in contact with each other). In such a case, the first coil spring 119 is compressed in the clutch mechanism 100, and the movement of the engagement member 110 which is moved to the left according to the displacement (rotation) of the lever member 79 is not restricted. In addition, in this embodiment, after the fourth transmission gear 87 is rotated so as to release the state where the driven-side protruding portion 123 and the driving-side protruding portion 126 abut on each other, switching from the OFF state to the ON state is performed.

In addition, in this embodiment, the fourth transmission gear 87 is initially rotated by a predetermined amount in a direction so as not to move the rack slider 65 in the forward direction (here, the CCW rotation). The clutch member 120 is in a state of always having a predetermined rotating load since the clutch gear 122 is always engaged with the rack 66 of the rack slider 65. Regarding this, in this embodiment, the frictional resistance that is generated when the abutting surfaces of the driving-side protruding portion 126 of the fourth transmission gear 87 and the driven-side protruding portion 123 of the clutch member 120 move relative to each other, that is, the rotating load is smaller than the rotating load of the clutch member 120.

However, in this embodiment, although not shown in the figure, in the state where the abutting state of the driving-side protruding portion 126 and the driven-side protruding portion 123 is released, a gap is formed between the driving-side protruding portion 126 and the driven-side protruding portion 123 in the CW rotation direction. Therefore, as illustrated in FIG. 14, thereafter, the fourth transmission gear 87 undergoes the CW rotation by a predetermined angle and rotates the protruding portion 103 in a direction in which the driving-side protruding portion 126 and the driven-side protruding portion 123 do not abut on each other, thereby moving the protruding portion 103 from the first engagement portion 113 to a position that faces the second engagement portion 114 in the left and right direction. As a result, since the clutch member 120 does not undergo the CW rotation during the rotating movement of the protruding portion 103, the rack slider 65 is not moved forward.

Figure 15:
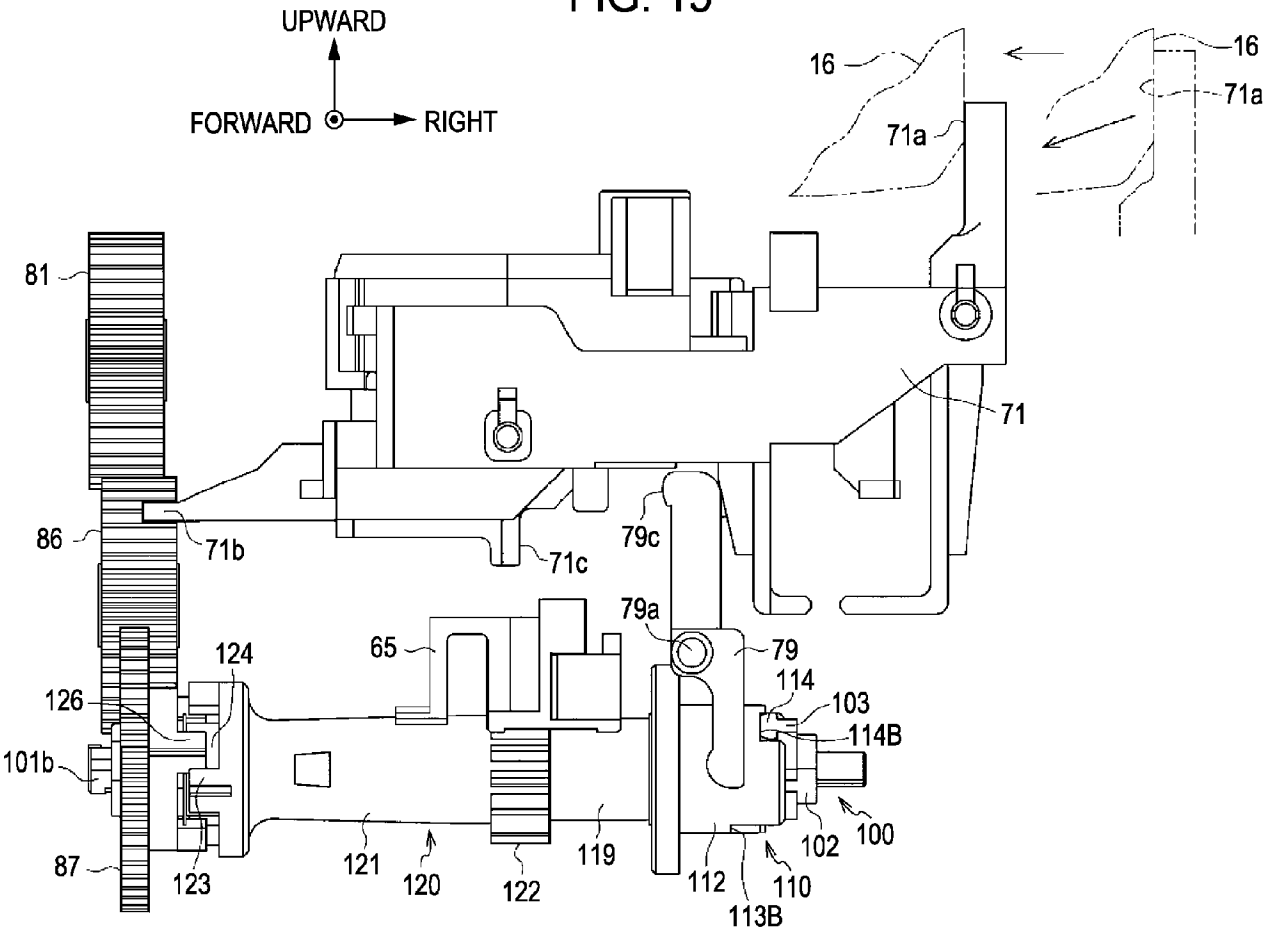
FIG. 15 is a front view illustrating the constituent components related to the clutch mechanism in the ON state as viewed from the front.

Thereafter, as illustrated in FIG. 15, when the carriage 16 is moved to the printing area PA from the second maintenance position MP2, the abutting state of the upper end portion 79*c* of the lever member 79 on the lower surface portion 71*c* of the cap holding member 71 is released. Then, the lower end portion 79*b* of the lever member 79 is moved to the right. Consequently, the engagement member 110 is moved to the right by the impelling force of the first coil spring 119. Here, since the protruding portion 103 faces the second engagement portion 114 in the left and right direction, the protruding portion 103 abuts on and is engaged with the groove bottom surface 114B of the second engagement portion 114 on the left. Since the groove bottom surface 114B of the second engagement portion 114 is positioned further toward the second direction side than the groove bottom surface 113B of the first engagement portion 113, the position of the engagement member 110 in FIG. 15 is positioned further toward the first direction side than the position of the engagement member 110 in FIG. 11. Here, the distance between the engagement member 110 and the clutch member 120 is increased, and thus the first coil spring 119 is in an elongated state, while the second coil spring 124 is compressed. Therefore, the clutch member 120 maintains the state of being impelled toward the left, and the engagement between the driving-side protruding portion 126 of the fourth transmission gear 87 and the driven-side protruding portion 123 of the clutch body 121 in the left and right direction is maintained. As a result, the clutch mechanism 100 can transmit the rotation of the fourth transmission gear 87 to the clutch body 121 as the driving-side protruding portion 126 is engaged with the driven-side protruding portion 123 in the left and right direction so as to abut on each other during rotation. In this manner, the clutch mechanism 100 is set to the ON state of rotating the clutch gear 122 of the clutch body 121 by the fourth transmission gear 87.

On the other hand, in the case where the clutch mechanism 100 is switched to the OFF state from the ON state, as apparent from the above description, the relative rotation direction of the protruding portion 103 to the engagement member 110 may be the reverse direction to the rotation direction of the case of the switching from the OFF state to the ON state. That is, in this embodiment, as illustrated in FIG. 12, the carriage 16 is moved to the second maintenance position MP2 and releases the state of the engagement between the protruding portion 103 and the second engagement portion of the engagement member 110. In addition, by rotating the fourth transmission gear 87 by a predetermined angle (here, the CCW rotation), the protruding portion 103 is moved from the second engagement portion 114 of the engagement member 110 to a position facing the first engagement portion 113. Thereafter, when the carriage 16 is moved from the second maintenance position MP2 to the first maintenance position MP1 or further toward the left, the engagement member 110 and the clutch member 120 are moved to the right by the impelling force of the second coil spring 124, and by this movement, the protruding portion 103 is engaged with the groove portion of the first engagement portion 113. Here, the second coil spring 124 is in an elongated state as illustrated in FIG. 11, and the driven-side protruding portion 123 of the clutch member 120 enters a state of becoming distant from the driving-side protruding portion 126 of the fourth transmission gear 87, so as to enter the OFF state.

In addition, even in the case where the clutch mechanism 100 is switched from the ON state to the OFF state, the rack slider 65 is not moved. Specifically, without the state where the driven-side protruding portion 123 abuts on the driving-side protruding portion 126 in the axial direction, that is, the left and right direction, the driven-side protruding portion 123 and the driven-side protruding portion 126 enter a state of abutting on each other in the rotation direction. Therefore, for example, in a case where switching from the ON state to the OFF state is performed in the state where the clutch member 120 is subjected to the CCW rotation and the rack slider 65 is moved rearward, even though the fourth transmission gear 87 undergoes the CCW rotation by a predetermined angle, the rack slider 65 completes the rearward movement and thus does not move further. In addition, in a case where switching from the ON state to the OFF state in the state where clutch member 120 is subjected to the CW rotation and the rack slider 65 is moved forward, even though the fourth transmission gear 87 is subjected to the CCW rotation by a predetermined angle, the driving-side protruding portion 126 is set so as not to abut on the driven-side protruding portion 123. That is, between the driving-side protruding portion 126 and the driven-side protruding portion 123, each protruding portion is formed to have a gap corresponding to the predetermined angle of the fourth transmission gear 87.

In the maintenance device 23 of this embodiment, as the carriage 16 is moved to the maintenance position as such, the operation state of the clutch mechanism 100 can be set to any of the ON state and the OFF state. In addition, by the clutch mechanism 100 which enters the ON state set by the carriage 16 moving to the second maintenance position MP2, a part of the separation and approach movement unit which causes the selective blocking mechanism 40 to approach or be separated from the carriage 16 is configured.

In addition, in this embodiment, an elevation mechanism that causes the selective blocking mechanism 40 to approach and be separated from the carriage 16 respectively by raising and lowering is configured as a part of the separation and approach movement unit. In addition, the selective blocking mechanism 40 includes a selection mechanism which selects a tube to be squeezed as the slider 41 in which the engagement portion 42 is in a state of being engaged with the carriage 16 by being raised is moved by the movement of the carriage 16. The elevation mechanism of the selective blocking mechanism 40 and the selection mechanism in the selective blocking mechanism 40 will be sequentially described.

Figure 16:
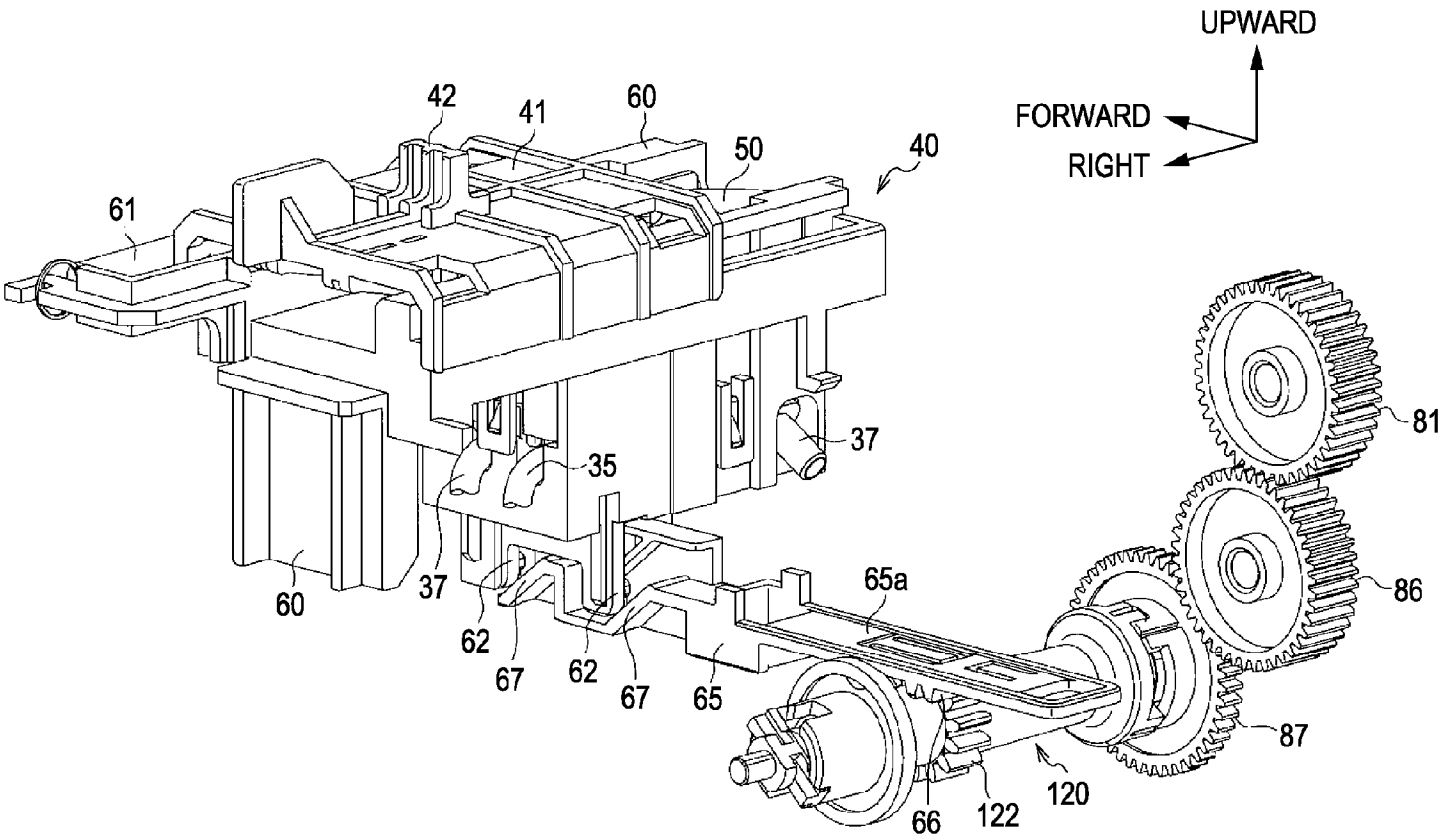
FIG. 16 is a perspective view illustrating an elevation mechanism of a selective blocking unit.

As illustrated in FIG. 16, the elevation mechanism is configured to include the extending portion 62 provided in the base 60 of the selective blocking mechanism 40, the rack slider 65, the clutch member 120 set to the ON state, and the fourth transmission gear 87. In the rack slider 65, the rack 66 formed on the lower surface of a flat plate portion 65*a* on the rear end side thereof is always engaged with the clutch gear 122 formed in the clutch member 120. In addition, as described above, the front end side of the rack slider 65 is provided with the inclined surface portion 67 which is engaged with the extending portion 62 to raise the rack slider 65 along with the forward movement. In addition, here, the selective blocking mechanism 40 is in the lowered state.

Figure 17A:
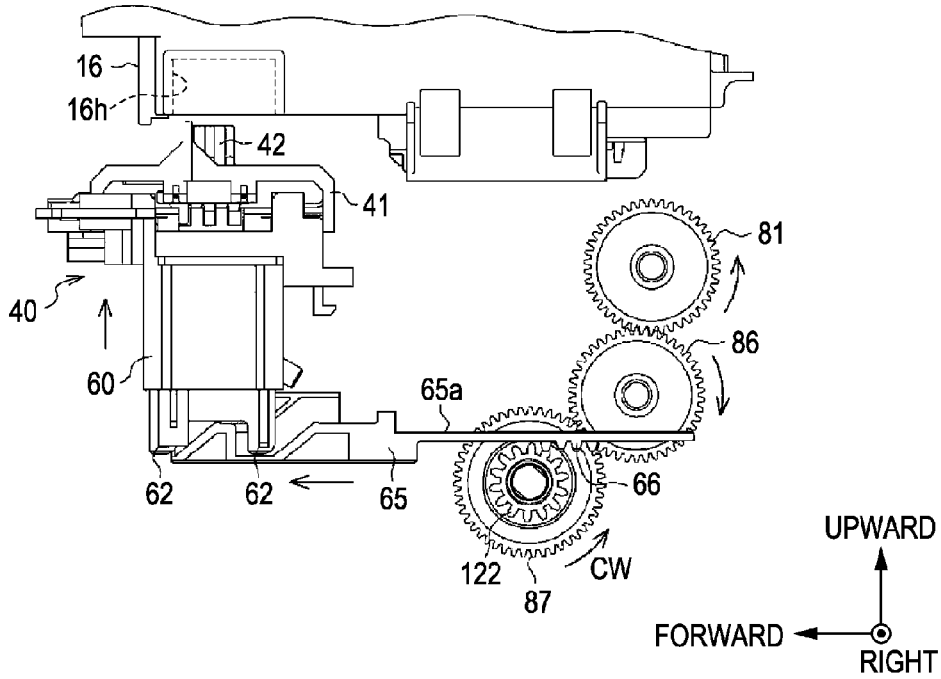
FIGS. 17A and 17B are diagrams illustrating a state where a carriage and the selective blocking unit are engaged, and are front views respectively illustrating the selective blocking unit before being raised and the selective blocking unit after being raised as viewed from the right.
Figure 17B:
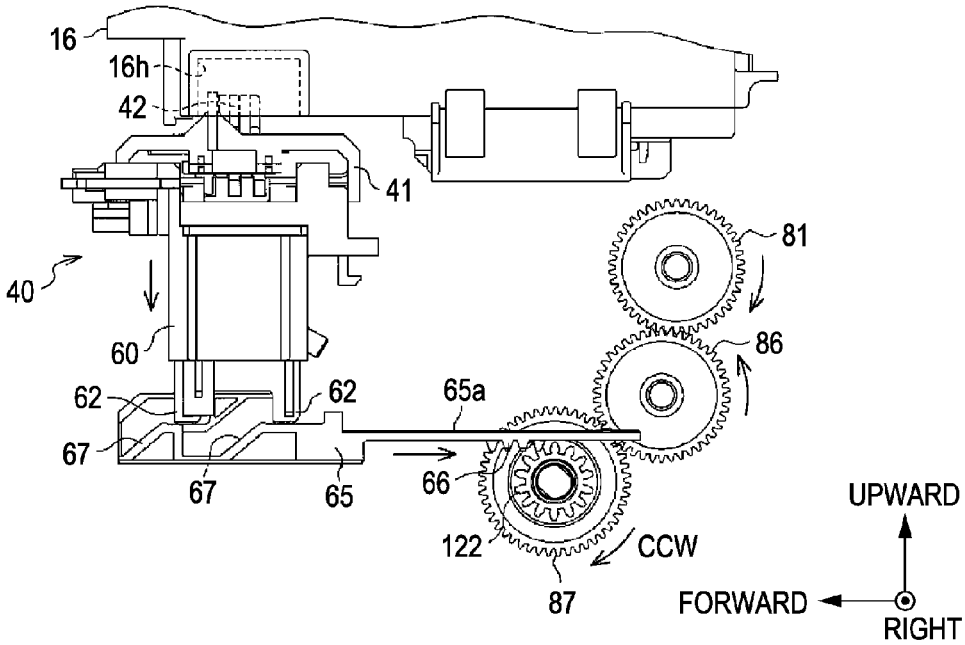

However, as illustrated in FIG. 17A, when the carriage 16 is moved in the left and right direction and the engagement portion 42 of the slider 41 is positioned inside the concave portion 16*h* provided in the carriage 16 in the upward and downward direction, the movement of the carriage 16 is stopped, and the engagement portion 42 is raised from the lowered state. That is, the rotation of the motor 26 is transmitted via the first and third transmission gears 81 and 86 to cause the fourth transmission gear 87 to undergo the CW rotation, such that the clutch gear 122 in the ON state also undergoes the CW rotation. Then, as illustrated in FIG. 17B, the rack slider 65 moves forward and raises the extending portion 62 of the base 60, such that the selective blocking mechanism 40 is raised along with the base 60, and the engagement portion 42 of the slider 41 enters the concave portion 16*h* of the carriage 16. As a result, the slider 41 enters an engagement established state of moving while being linked with the movement of the carriage 16 in the left and right direction.

Originally, as illustrated in FIG. 17B, as the clutch gear 122 is reversed (that is, the CCW rotation) from the state where the rack slider 65 is moved forward as described above and raises the selective blocking mechanism 40, the rack slider 65 is moved rearward and lowers the selective blocking mechanism 40. By lowering the selective blocking mechanism 40, the engagement portion 42 exits the concave portion 16*h*, and the slider 41 enters an engagement released state of not moving by being linked with the carriage 16.

Moreover, in this embodiment, the movement range of the rack slider 65 in the forward and rearward direction is restricted as the rack slider 65 abuts on the frame body 29. In this restricted movement range, as described above, the rack 66 of the rack slider 65 and the clutch gear 122 are always in an engaged state. Therefore, when the clutch gear 122 undergoes the CCW rotation in the state illustrated in FIG. 17A, or when the clutch gear 122 undergoes the CW rotation in the state illustrated in FIG. 17B, engagement between the rack 66 and the clutch gear 122 is maintained in any case. That is, they are configured so that at least one gear is impelled in a direction to be engaged with the other gear, and when any one is rotated, the engagement is deviated, while they are in the engaged state by the impelling when rotation is stopped.

Figures 18A, 18B:
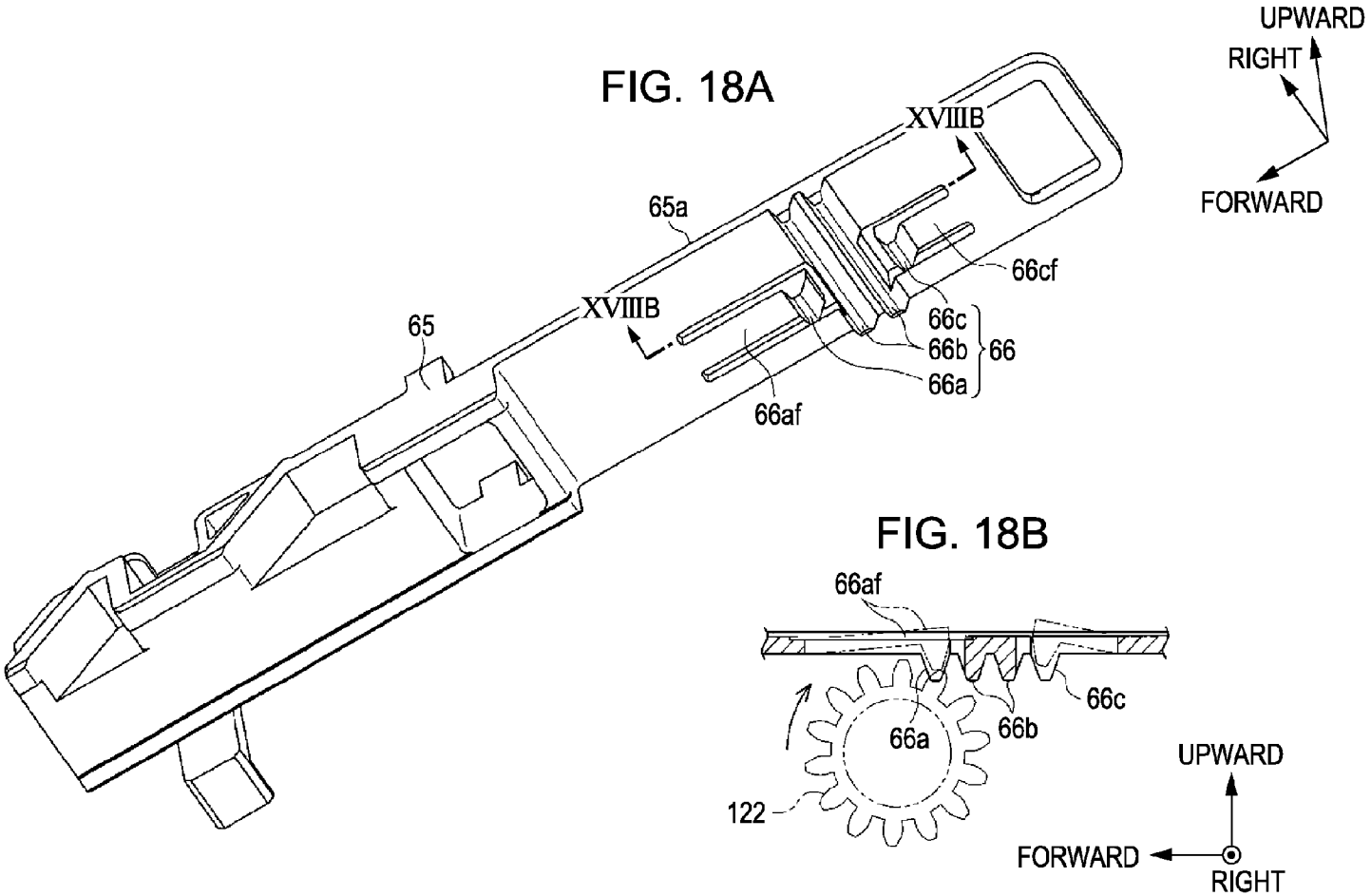
FIG. 18A is a perspective view illustrating the configuration of a rack slider of this embodiment.
FIG. 18B is a cross-sectional view taken along the line XVIIIB-XVIIIB in FIG. 18A.

In this embodiment, as illustrated in FIG. 18A, the rack 66 has four rack teeth 66*a*, 66*b*, 66*b*, and 66*c*. In addition, the rack tooth 66*a* at the forward end and the rack tooth 66*c* on the rearward end are respectively formed at the beam tip ends of a cantilever beam portion 66*af* and a cantilever beam portion 66*cf* each of which is provided with voids on the peripheral three sides in the flat plate portion 65*a* of the rack slider 65. Therefore, the rack teeth 66*a* and 66*c* can be deflected and deformed in the upward and downward direction. In addition, the rack teeth 66*b* are formed integrally with the rack slider 65.

Therefore, as illustrated in FIG. 18B, when the clutch gear 122 undergoes the CCW rotation in the state where the selective blocking mechanism 40 is lowered, the cantilever beam portion 66*af* is deformed upward and deflected as shown by the double-dot-dashed line in the figure, and thus the engagement of the rack tooth 66*a* with the clutch gear 122 is deviated. In addition, when the rotation of the clutch gear 122 is stopped, the clutch gear 122 is impelled by the elasticity of the cantilever beam portion 66*af*, and the deformation shown by the double-dot-dashed line in the figure returns to the original state, so that the rack tooth 66*a* is engaged with the clutch gear 122. In addition, although not described, the rack tooth 66*c* operates in the same manner.

Subsequently, in the selective blocking mechanism 40 which squeezes a tube selected as the slider 41 is moved by being linked with the carriage 16, the selection mechanism of the tube to be squeezed will be described with reference to FIGS. 19 to 22.

Figure 19:
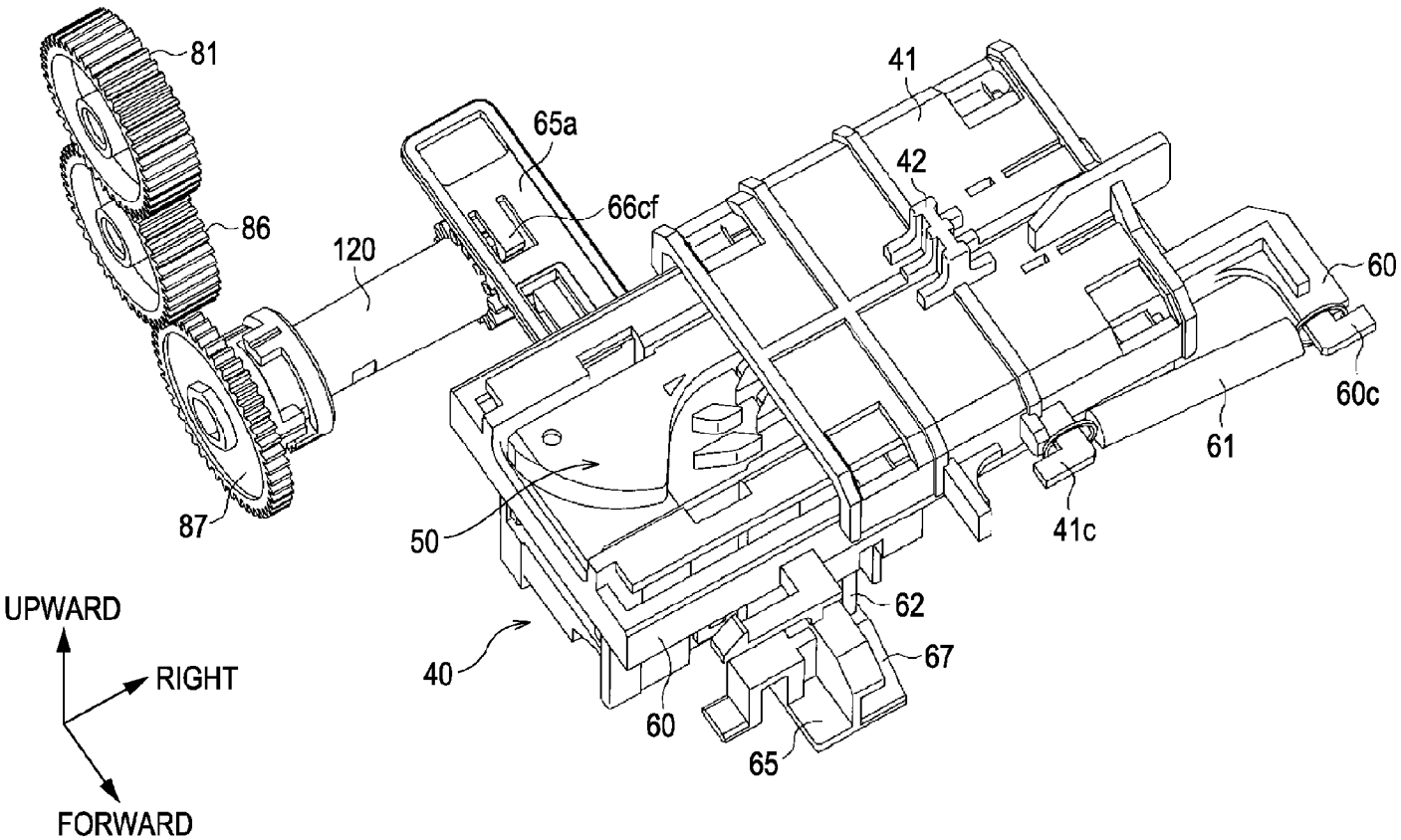
FIG. 19 is a perspective view illustrating the elevation mechanism of the selective blocking unit in a state where the selective blocking unit is raised.

As illustrated in FIG. 19, the selective blocking mechanism 40 raised by the elevation mechanism causes the slider 41 to be pulled in the right direction by the coil spring 61 as described above. Therefore, the engagement portion 42 of the slider 41 is raised to be engaged with the carriage 16 at a determined position in the left and right direction. In addition, the slider 41 which is raised and engaged with the carriage 16 (the concave portion 16*h*) moves on the cam surface of the cam member 50 embedded in the base 60 having a substantially rectangular parallelepiped shape. In this embodiment, by the movement of the slider 41, the second tube 37 or the first discharge tube 35 is selected to be squeezed.

Figure 20:
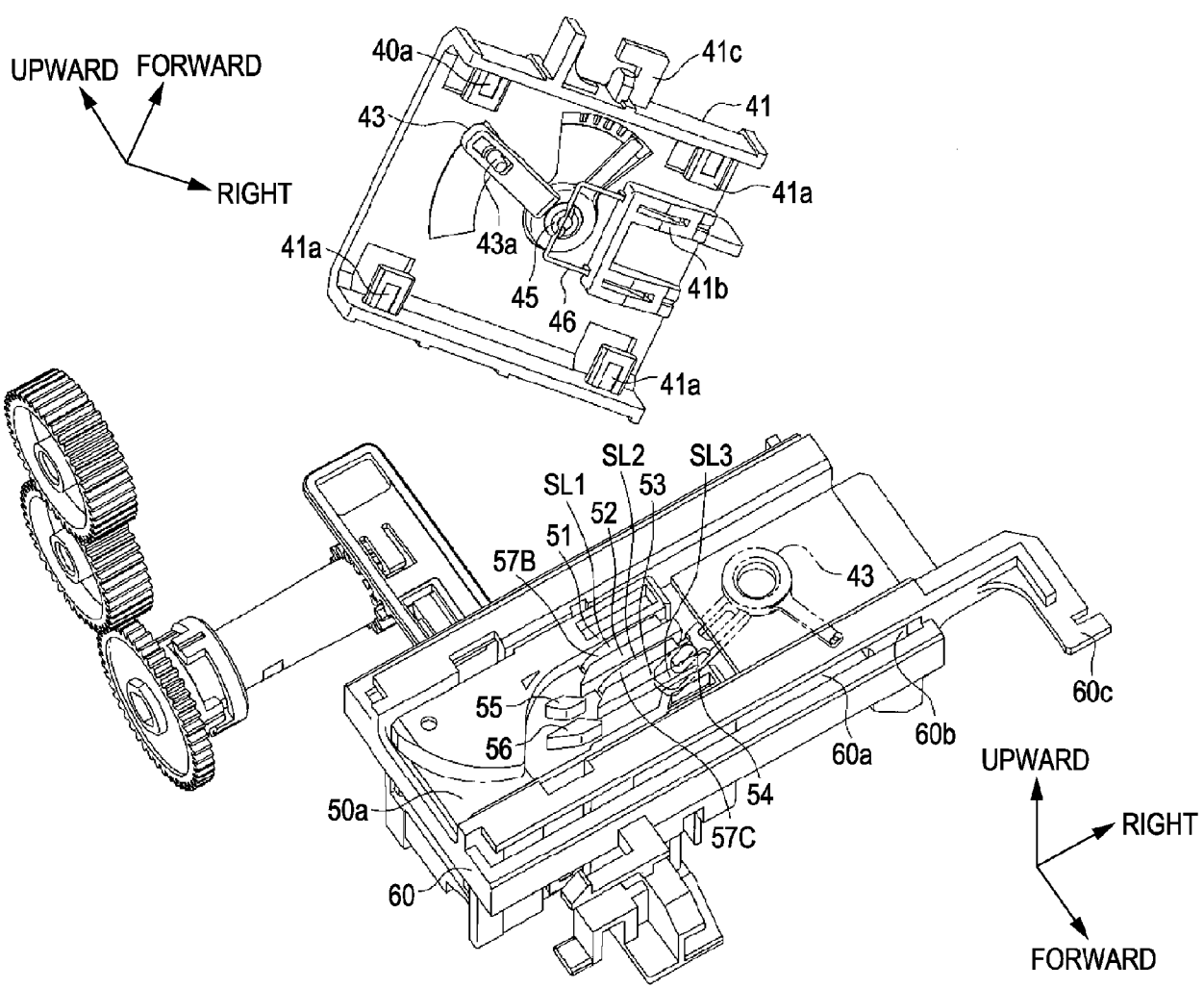
FIG. 20 is a perspective view illustrating the selective blocking unit in a state where a slider is detached.

That is, as illustrated in FIG. 20, the selective blocking mechanism 40 has the base 60 in which the cam member 50 is embedded and the slider 41. In addition, the blocking member 43 which is axially supported so as to be rotatable on the lower surface of the slider 41 opposing the cam surface is guided to a selection position which is a specific position on the cam surface. Hereinafter, including this selection position, a configuration of guiding the blocking member 43 to selection positions in the selective blocking mechanism 40 will be described.

The slider 41 has a substantially rectangular shape in the plan view from above and has a columnar concave portion 45 formed substantially at the center position on the lower surface thereof. A state of the concave portion 45 fitted with the blocking member 43 including an arm portion with a rectangular plate shape extending straight from an annular portion fitted to the concave portion 45 to the left direction which is one of the diameter directions is maintained as the annular portion is impelled upward by a pressing member 46, such that the blocking member 43 is axially supported so as to be oscillated. In addition, on the lower surface in the vicinity of the tip end portion of the arm portion in the blocking member 43, a columnar pin portion 43 protruding downward is formed.

At the end portions of the slider 41 in the forward and rearward direction, side walls are formed in the upward and downward direction, and guide piece portions 41*a* protruding inward from the side walls in plate shapes are formed at four corners on the lower surface side. On the other hand, the base 60 is a case member having a substantially rectangular parallelepiped shape, and at both side walls in front and rear thereof, the concave groove portions 60*a* extend in the left and right direction. The guide piece portions 41*a* of the slider 41 are inserted into the concave groove portions 60*a* from the left, such that the slider 41 can slide in the left and right direction. In addition, the concave groove portion 60*a* is provided with an ending end portion 60*b* in the right direction, so that as the ending end portion 60*b* abuts on the guide piece portion 61*a* on the right of the slider 41, the position of the slider 41 is determined in the left and right direction and the movement thereof to the right is restricted.

The base 60 is configured to include the cam member 50 having a substantially rectangular parallelepiped shape therein and support the intermediate portions of the second discharge tube 37 and the first discharge tube 35 to be lined up in the forward and rearward direction between the base 60 and the cam member 50 (see FIG. 16). The cam member 50 includes a first pressing member 57B and a second pressing member 57B as pressing members capable of respectively pressing a part of the first discharge tube 35 and a part of the second discharge tube 37 from above (see FIG. 22).

On the surface of the cam member 50, over the front end portion from the rear end portion, a first wall 51, a second wall 52, a third wall 53, and a fourth wall 54 are erected with a predetermined height from a base surface 50*a* on the lower side. In addition, on the left of the first to fourth walls 51 to 54, a fifth wall 55 and a sixth wall 56 with island shapes are erected with a predetermined height from the same base surface 50*a*. In addition, the cam member 50 is embedded in the base 60 so that the area where the walls are formed is positioned over the left end from substantially the center portion in the left and right direction in the base 60.

However, due to these walls 51 to 56, a so-called cam surface having a long groove portion mainly in the left and right direction is formed on the upper surface of the cam member 50. The groove portion is widely open to the left end side and is parallel at equal intervals in the forward and rearward direction on the right end side, and as three selection passages having substantially rectangular shapes in the plan view in the left and right direction, guide grooves SL1, SL2, and SL3 are formed. Regarding the guide grooves SL1 to SL3, the guide grooves SL1, SL2, and SL3 are disposed in this order from the rear side, and the widths of the guide grooves SL1 to SL3 in the forward and rearward direction are set to be slightly greater than the outside diameter of the pin portion 43*a* of the blocking member 43. In addition, the first and second pressing members 57B and 57C are respectively disposed in the guide grooves SL1 and SL2 so as to be movable in the upward and downward direction. The blocking member 43 is moved in the left and right direction as the slider 41 is moved by being linked with the reciprocation of the carriage 16, and the pin portion 43*a* is guided to the groove portion formed as described above and is thus guided to a predetermined position in the cam surface.

Figure 21:
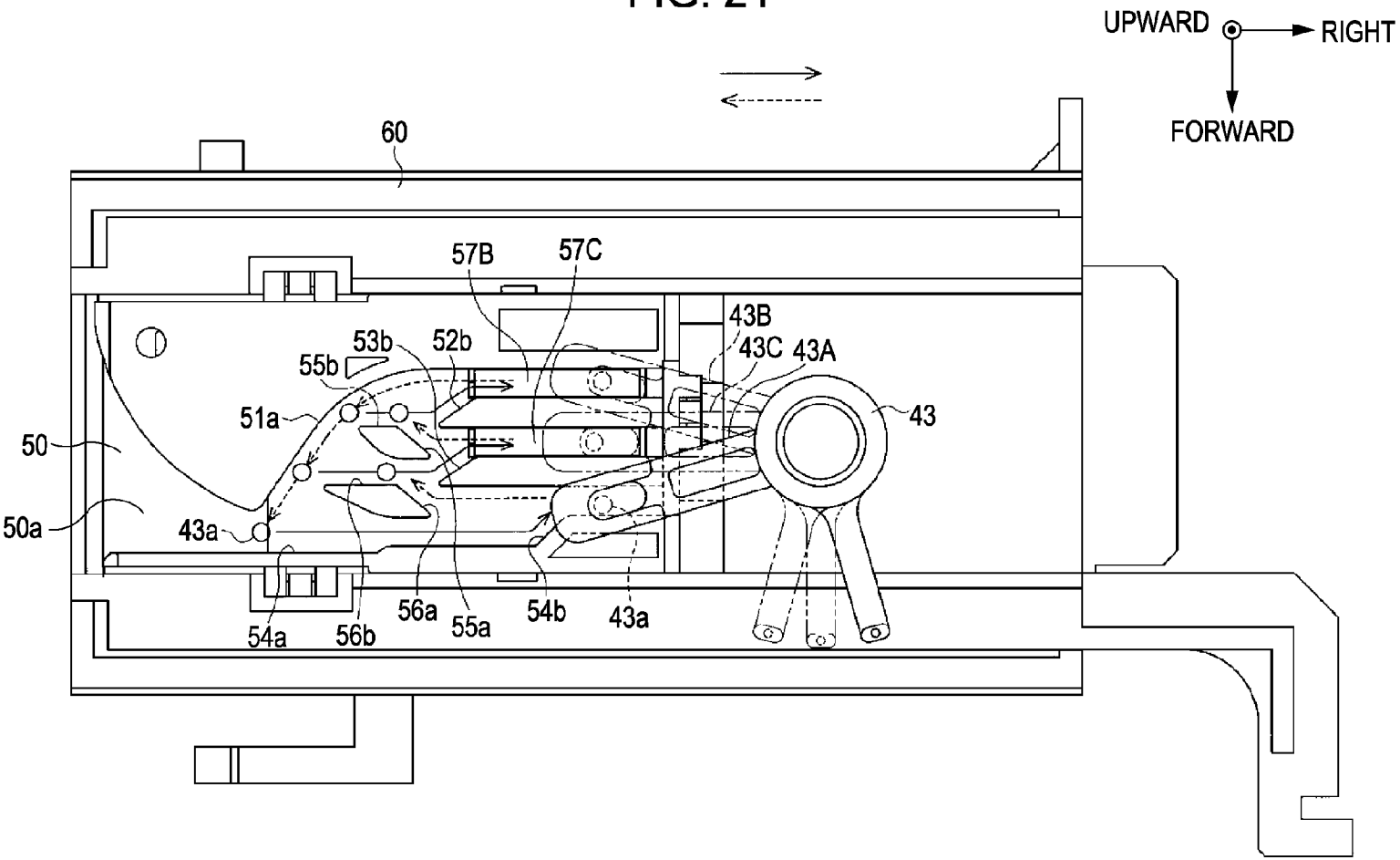
FIG. 21 is a plan view illustrating a rotation state of a blocking member in a cam surface as viewed from above.

That is, as illustrated in FIGS. 20 and 21, on the path of the fourth wall 54 in the extension direction, at a position on the right end side from the midway position of a rear side surface 54*a* extending straight in the left and right direction with a slight difference, an inclined surface 54*b* which is inclined obliquely rearward to the right is formed. On the other hand, the front end side of the third wall 53 that forms the guide groove SL3 with the fourth wall 54 extends straight in the left and right direction. In addition, the first wall 51 that forms the guide groove SL1 with the second wall 52 is formed so that a front side surface 51*a* has a substantially triangular contour shape in which the forward side thereof is convex in the plan view and thus the gap between the first wall 51 and the fourth wall 54 is narrowed in the forward and rearward direction at a position further toward the left end side than the fifth and sixth walls 55 and 56.

By this configuration, when the slider 41 is moved from the left to the right and inserted so as to be assembled with the base 60, the pin portion 43*a* of the blocking member 43 is moved to the forward side along the left portion from the protruding end of the substantially triangular contour portion in the front side surface 51*a* of the first wall 51 and then passes through the gap between the protruding end and the rear side surface 54*a* of the fourth wall 54. In addition, as shown by the solid line arrow in the figure, when the slider 41 is moved to a position where movement to the right is restricted as the pin portion 43*a* abuts on the inclined surface 54*b* and slides, the pin portion 43*a* is guided to a specific position in the guide groove SL3. In this embodiment, this position is called an initial position. In addition, this initial position is one of the selection positions, and the blocking member 43 with the initial value is in a state illustrated by the solid line denoted by reference numeral 43A.

Next, when the slider 41 is moved to the left from the state where the pin portion 43*a* is at the initial position, as shown by the broken line arrow in the figure, the pin portion 43*a* abuts on an inclined surface 56*a* which is inclined rearward to the left in the sixth wall 56, slides on the inclined surface 56*a*, and comes into contact with a rear side surface 56*b* extending straight in the left and right direction of the sixth wall 56. Thereafter, in a case where the slider 41 is continuously moved to the left, the pin portion 43*a* is moved further to the left along the rear side surface 56*b*, abuts on a right portion from the protruding end of the substantially triangular contour portion in the front side surface 51*a* of the first wall 51, and then passes through the gap between the protruding end and the rear side surface 54*a* of the fourth wall 54 to the left. As a result, the pin portion 43*a* is moved again to the position when the slider 41 is inserted into the base 60.

On the other hand, in a case where the slider 41 is reversed and moved to the right in the state where the pin portion 43*a* is positioned to come into contact with the rear side surface 56*b* of the sixth wall 56, as shown by the solid line arrow in the figure, the pin portion 43*a* abuts on an inclined surface 53*b* inclined rearward to the right in the third wall 53 and slides to the right. In addition, when the slider 41 is moved to a position where movement to the right is restricted, the pin portion 43*a* is guided to a specific position in the guide groove SL2. In this embodiment, this position is called a second blocking position. In addition, the second blocking position is one of the selection positions, and the blocking member 43 at the second blocking position is in a state illustrated by the double-dot-dashed line denoted by reference numeral 43C.

Next, when the slider 41 is moved to the left from the state where the pin portion 43*a* is at the second blocking position, as shown by the broken line arrow in the figure, the pin portion 43*a* abuts on an inclined surface 55*a* which is inclined rearward to the left in the fifth wall 55, slides on the inclined surface 55*a*, and comes into contact with a rear side surface 55*b* extending straight in the left and right direction of the fifth wall 55. Thereafter, in a case where the slider 41 is continuously moved to the left, the pin portion 43*a* is moved further to the left along the rear side surface 55*b*, abuts on a right portion from the protruding end of the substantially triangular contour portion in the front side surface 51*a* of the first wall 51, and then passes through the gap between the protruding end and the rear side surface 54*a* of the fourth wall 54 to the left. As a result, the pin portion 43*a* can be moved to a position where the pin portion 43*a* can be moved to the second blocking position or the position when the slider 41 is inserted into the base 60.

On the other hand, in a case where the slider 41 is reversed and moved to the right in the state where the pin portion 43*a* is positioned to come into contact with the rear side surface 55*b* of the fifth wall 55, as shown by the solid line arrow in the figure, the pin portion 43*a* abuts on an inclined surface 52*b* inclined rearward to the right in the second wall 52 and slides to the right. In addition, when the slider 41 is moved to a position where movement to the right is restricted, the pin portion 43*a* is guided to a specific position in the guide groove SL1. In this embodiment, this position is called a first blocking position. In addition, the first blocking position is one of the selection positions, and the blocking member 43 at the first blocking position is in a state illustrated by the double-dot-dashed line denoted by reference numeral 43B.

Next, when the slider 41 is moved to the left from the state where the pin portion 43*a* is at the first blocking position, as shown by the broken line arrow in the figure, the pin portion 43*a* abuts on the front side surface 51*a* in the first wall 51 and slides on the front side surface 51*a* to the right. That is, the pin portion 43*a* abuts on a right portion from the protruding end of the substantially triangular contour portion in the front side surface 51*a* of the first wall 51, and then passes through the gap between the protruding end and the rear side surface 54*a* of the fourth wall 54 to the left. As a result, the pin portion 43*a* can be moved again to the position where the pin portion 43*a* can be moved to the second blocking position or the position when the slider 41 is inserted into the base 60.

As described above, the blocking member 43 is guided to the groove portion formed as described above as the slider 41 is moved in the left and right direction by being linked with the reciprocation of the carriage 16, and the pin portion 43*a* is guided to any of the initial position, the first blocking position, and the second blocking position (collectively called the selection positions). In addition, in the state where the pin portion 43*a* is positioned at the first blocking position, the first pressing member 57B is pressed downward by the pin portion 43*a* and thus squeezes the first discharge tube 35, and in the state where the pin portion 43*a* is positioned at the second blocking position, the second pressing member 57C is pressed downward by the pin portion 43*a* and thus squeezes the second discharge tube 37.

Next, the structures of the first and second pressing members 57B and 57C will be described. In addition, in this embodiment, the first and second pressing members 57B and 57C have shapes which are symmetrical with respect to a vertical plane that widens in the upward and downward direction and the left and right direction as a symmetry plane. Therefore, here, the second pressing member 57C is described representatively.

Figure 22:
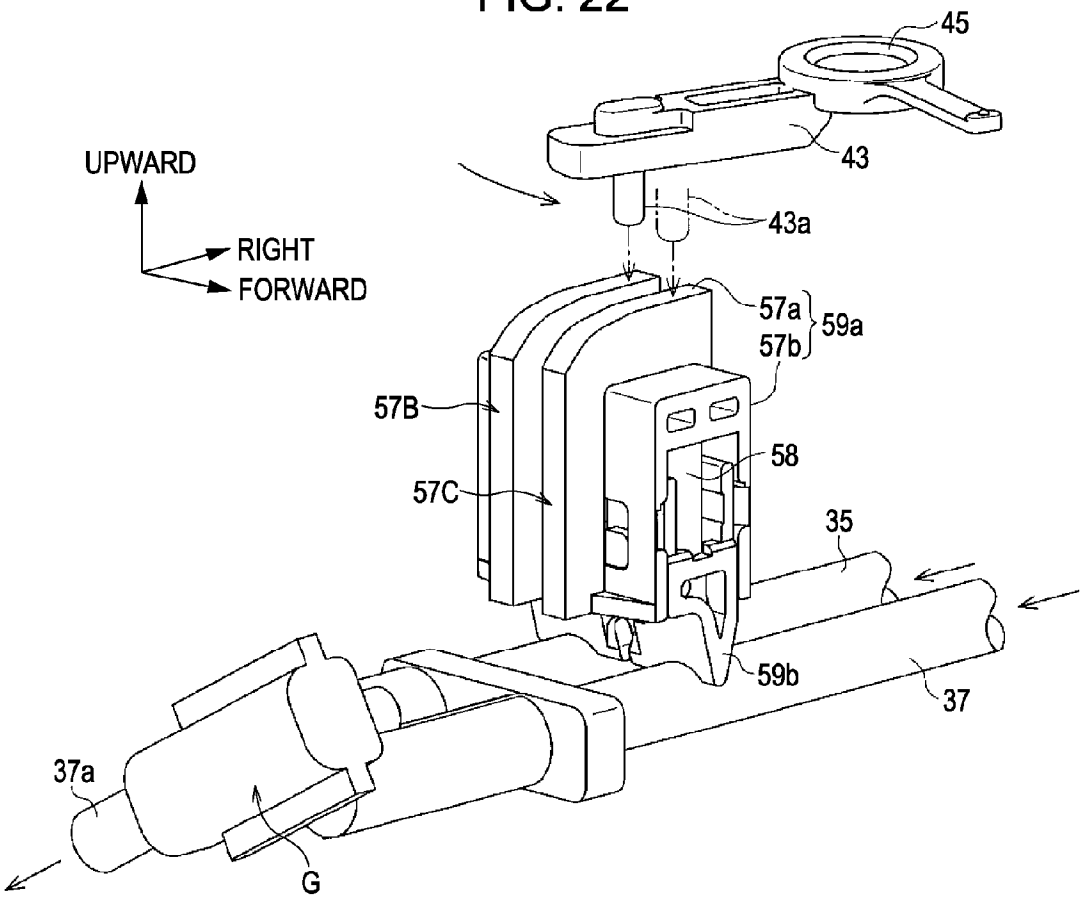
FIG. 22 is a perspective view illustrating a blocking mechanism of a tube.

As illustrated in FIG. 22, the second pressing member 57C is provided to be movable in the upward and downward direction with respect to the cam member 50 in the selective blocking mechanism 40 not illustrated in the same figure. In addition, the second pressing member 57C includes a base portion 59*a* having an inclined surface portion 57*a* of which the upper end is exposed to the guide groove SL2 and which is inclined in the upper right direction and a block shape portion 57*b* in which a compression spring 58 is embedded, and a tube pressing portion 59*b*. The tube pressing portion 59*b* can slide in the upward and downward direction with respect to the base portion 59*a* via the compression spring 58.

The tube pressing portion 59*b* has a predetermined width in the forward and rearward direction, the width thereof in the left and right direction is gradually narrowed toward the tip end portion (lower end portion), and the tip end (lower end) has roundness. In addition, the tip end is disposed to abut on the upper surface of the first discharge tube 35 in the selective blocking mechanism 40.

Therefore, when the pin portion 43*a* of the blocking member 43 is moved as the arm portion is oscillated and is guided to the second blocking position, the inclined surface portion 57*a* at the upper end in the second pressing member 57C can be pressed down by the pin portion 43*a*. When the base portion 59*a* is pressed by this downward pressing, the compression spring 58 is compressed, and the tube pressing portion 59*b* squeezes the second discharge tube 37 by the compression of the compression spring 58. In addition, as the slider 41 maintains a state without movement, the state of squeezing the second discharge tube 37 is maintained.

As such, in the selective blocking mechanism 40, the blocking member 43 is rotated by reciprocating the slider 41 so as to move the pin portion 43*a* to the selection position, thereby selecting the discharge tube to be squeezed. As such, any of the second discharge tube 37 and the first discharge tube 35 is squeezed in front of the confluence point G provided on the path of the first discharge tube 35. Originally, in the case where the selection position of the pin portion 43*a* is the initial position, both the second discharge tube 37 and the first discharge tube 35 are not in the squeezed state.

The suction operation of the ink performed in the printer 11 using the maintenance device 23 configured as described above will be described with reference to FIGS. 23 to 25.

Figure 23:
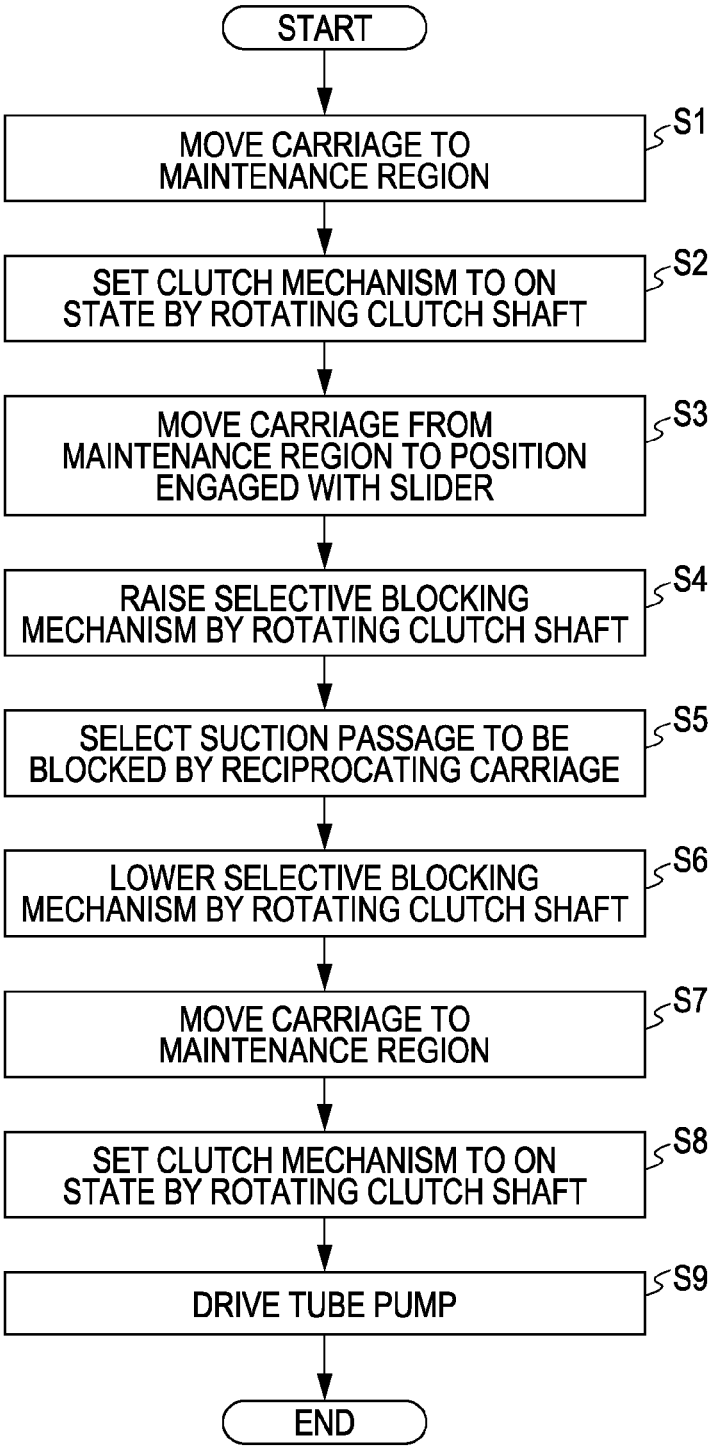
FIG. 23 is a process flowchart showing a switching process of the clutch mechanism in the embodiment.
Figure 24:
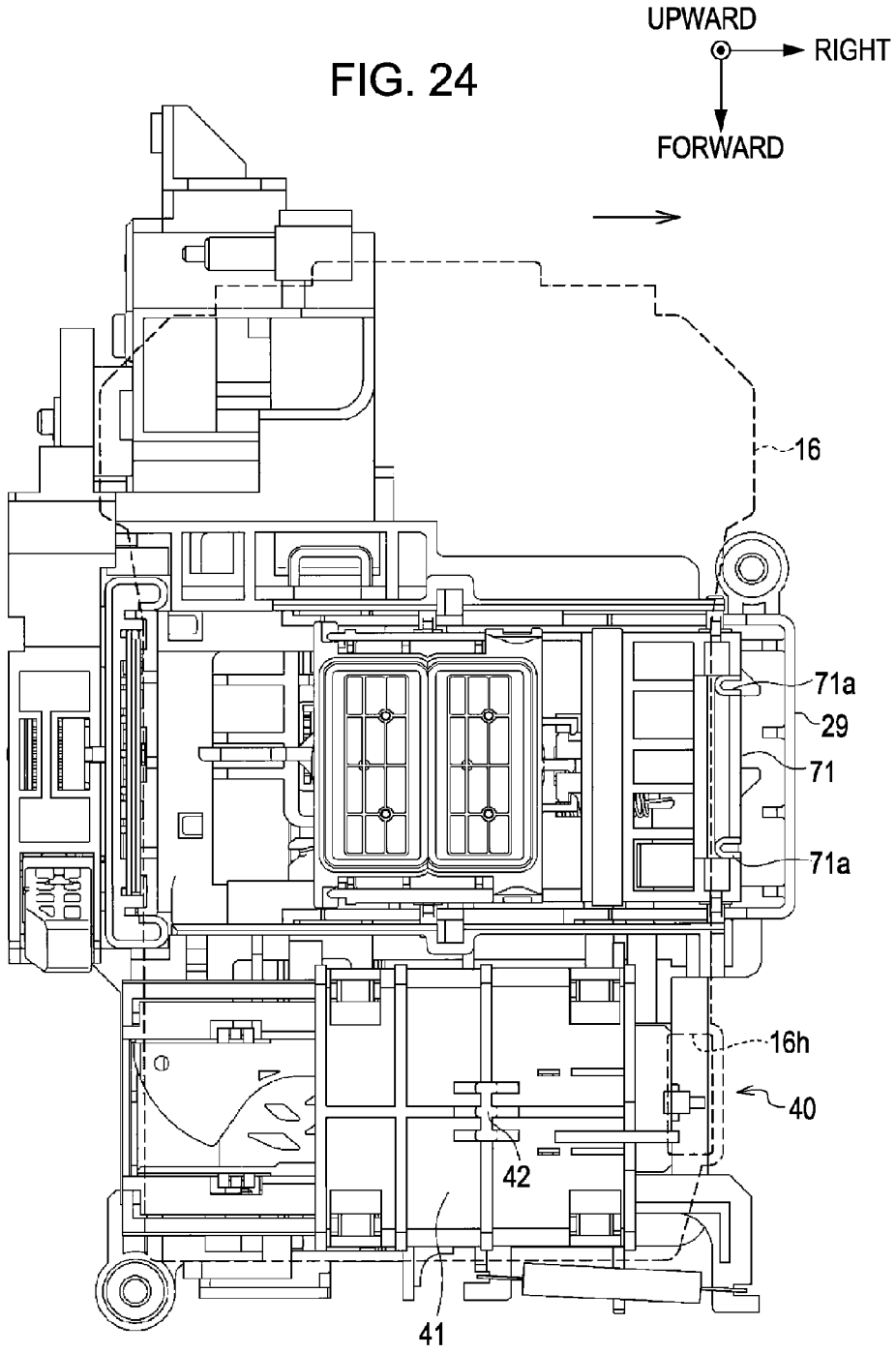
FIG. 24 is a plan view illustrating a movement position of the carriage with respect to the maintenance device in a state where power transmission can be switched in the clutch mechanism as viewed from above.

As shown in FIG. 23, first, the carriage 16 is moved to the maintenance area MA (second maintenance position MP2) (Step S1). That is, the carriage 16 is moved to the left by rotating the carriage motor 18 (see FIG. 1), and as illustrated in FIG. 24, the lever member 79 is rotated by moving the cap holding member 71 to the left, thereby moving the engagement member 110 in the clutch mechanism 100 to the left. In addition, in this state, the selective blocking mechanism 40 is in the lowered position, and thus the engagement portion 42 of the slider 41 is not engaged with the concave portion 16*h* of the carriage 16 and does not impede the movement of the carriage 16.

Next, by rotating the fourth transmission gear 87 in the forward and reverse directions in a predetermined order through the rotation of the motor 26, the clutch shaft 101 is rotated to set the clutch mechanism 100 to the ON state (Step S2). That is, the protruding portion 103 is rotated to the state of being engaged with the first engagement portion 113 to the state of being engaged with the second engagement portion 114.

Figure 25:
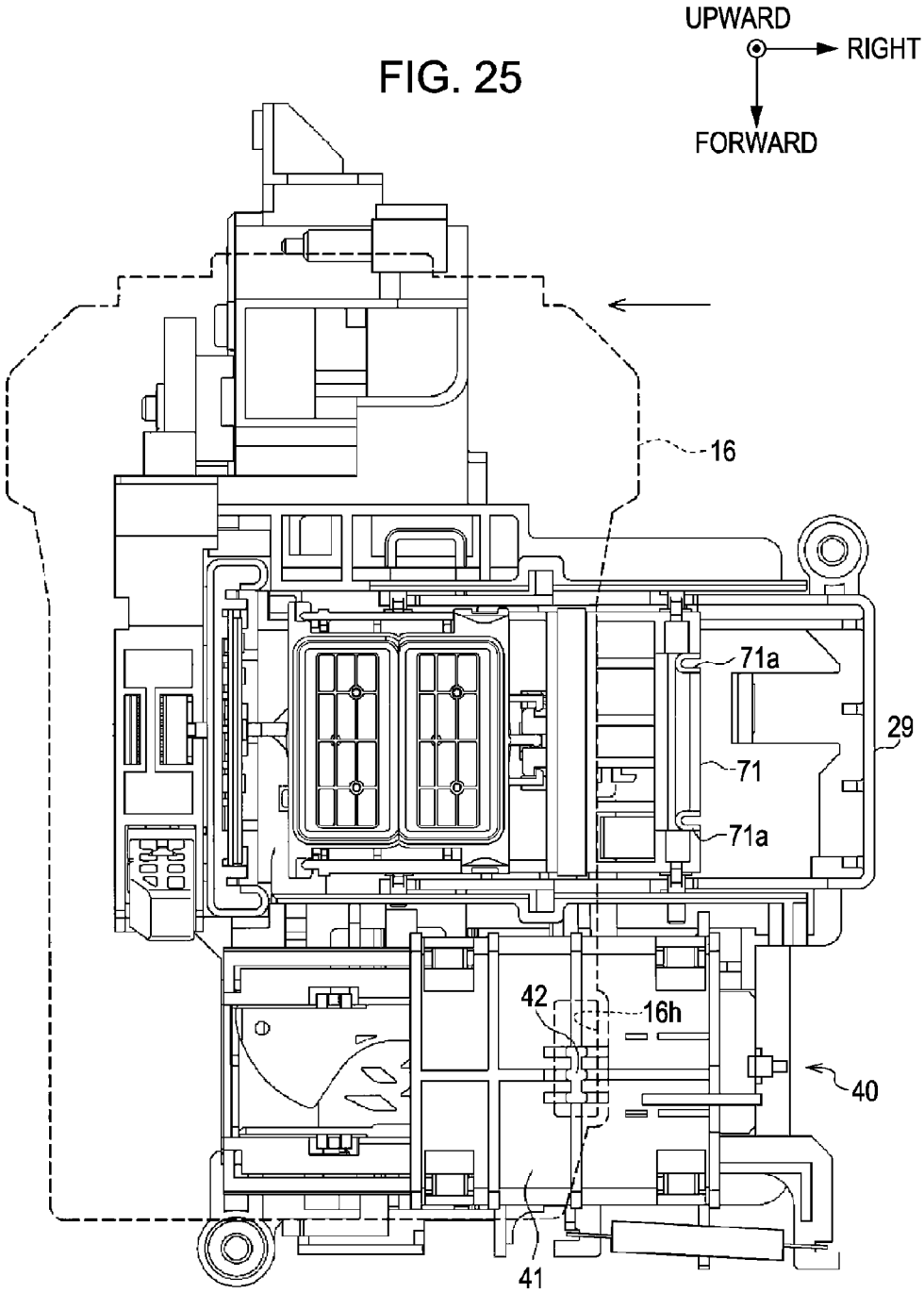
FIG. 25 is a plan view illustrating a movement position of the carriage with respect to the maintenance device in a state where an engagement portion of the slider and a concave portion of the carriage are engaged as viewed from above.

Next, the carriage 16 is moved to the left from the maintenance area MA (the second maintenance position MP2) to the position engaged with the slider 41 (Step S3). Specifically, as illustrated in FIG. 25, in a plan view from above, the carriage 16 is moved to enter the state where the engagement portion 42 of the slider 41 is positioned in the area of the concave portion 16*h* of the carriage 16 in the plan view. In addition, in this embodiment, the concave portion 16*h* is formed at the left end portion of the carriage 16 such that the carriage 16 is at least engaged with the engagement portion 42 of the slider 41 at a position separated from the locking portion 71*a* of the cap holding member 71 to the left.

Since the cap holding member 71 is moved to the left by this movement of the carriage 16, pressing of the lever member 79 against the upper end portion 79*c* is released, so that the engagement member 110 in the clutch mechanism 100 is moved to the right on the basis of the impelling force of the second coil spring 124. As a result, the protruding portion 103 abuts on the groove bottom surface 114B of the second engagement portion 114 and is in the state of being engaged with the second engagement portion 114 (that is, the ON state). Originally, during the movement of the carriage 16, the lock lever 84 is at the retreat position that does not restrict the movement of the carriage 16.

Next, the selective blocking mechanism 40 is raised by rotating the clutch shaft 101 (Step S4). That is, by causing the fourth transmission gear 87 to undergo the CW rotation by rotating the motor 26, the clutch shaft 101 is rotated, such that the rack slider 65 is moved forward via the clutch gear 122. Accordingly, the selective blocking mechanism 40 is raised.

Next, the suction passage to be blocked is selected by reciprocating the carriage 16 (Step S5). For example, in the case where the nozzle row 22A that ejects black ink is suctioned, the cap internal space to be suctioned in the printer 11 is the first cap internal space 31*a*, so that the second discharge tube 37 other than the first discharge tube 35 communicating with the first cap internal space 31*a* needs to be squeezed. Consequently, the slider 41 is reciprocated so that the selection position of the pin portion 43*a* of the blocking member 43 is the second blocking position so as to squeeze the second discharge tube 37.

Next, the selective blocking mechanism 40 is lowered by rotating the clutch shaft 101 (Step S6). That is, by rotating the clutch shaft 101 by causing the fourth transmission gear 87 to undergo the CCW rotation through the rotation of the motor 26, the rack slider 65 is moved rearward via the clutch gear 122. Accordingly, the selective blocking mechanism 40 is lowered. In this manner, the engagement of the carriage 16 with the engagement portion 42 of the slider 41 is released, and in the selective blocking mechanism 40, the pin portion 43*a* of the blocking member 43 is in the state of being maintained at the selection position (for example, the second blocking position).

Next, the carriage 16 is moved to the maintenance area MA (the second maintenance position MP2) again (Step S7). Then, the carriage 16 is moved to the left by the carriage motor, and as illustrated again in FIG. 24, the cap holding member 71 is moved to the left, such that the lever member 79 is rotated and the engagement member 110 in the clutch mechanism 100 is moved to the left. At the same time, the cap 27 is in a state of surrounding and abutting on the nozzle rows 22A to 22D in the liquid ejecting head 19.

Next, by causing the fourth transmission gear 87 to undergo the CCW rotation and rotating the clutch shaft 101 through the rotation of the motor 26, the clutch mechanism 100 is caused to be in the OFF state (Step S8). By this operation, the rotation of the motor 26 is not transmitted to the rotation of the clutch member 120. Therefore, the selective blocking mechanism 40 is maintained in the lowered state regardless of the rotation of the motor 26. In addition, in this state, here, the carriage 16 is moved to the first maintenance position MP1 from the second maintenance position MP2. In this manner, the clutch mechanism 100 is in the OFF state while the cap 27 is maintained in the state of abutting on the liquid ejecting head 19.

Next, the tube pump is driven (Step S9). That is, by causing the motor 26 to undergo the CCW rotation, the tube pump 38 is subjected to a suction operation so as to suction the cap internal space. As a result, the cap internal space to be suctioned (for example, the first cap internal space 31*a*) is suctioned.

According to the embodiments described above, the following effects can be obtained.

(1) In an area which is on the path of the movement to the maintenance area MA (the first maintenance position MP1) where suction is performed by causing the cap 27 to abut thereon, the internal space of the cap 27 is selected to be in a negative pressure state, and the carriage 16 can be moved to the maintenance area MA while maintaining the blocked state of the suction passage corresponding to the selected internal space. As a result, maintenance of the liquid ejecting head 19 can be appropriately performed without a reduction in the suction characteristics of the cap 27. In addition, the movement midway area where the suction passage to be blocked is selected is caused not to overlap with an area where the carriage 16 abuts on and moves the cap holding member 71, so that an increase in the load caused by the movement of the carriage 16 can be suppressed.

(2) Since the position of the slider 41 in the case where the engagement between the carriage 16 and the slider 41 is released is specified to be any selection position of the initial position, the first blocking position, and the second blocking position, when the engagement portion 42 of the slider 41 is engaged with the carriage 16 thereafter, the carriage 16 (the concave portion 16*h*) can be easily engaged with the engagement portion 42. In addition, by switching the suction passage to be blocked by reciprocation, the initial position, the first blocking position, and the second blocking position can be the same position in the movement direction of the slider 41. Therefore, regardless of the selected state of the suction passage, the carriage 16 and the slider 41 can be engaged with each other so as to be linked with each other at a fixed position in the movement midway area.

(3) When the engagement between the carriage 16 and the slider 41 is released, the slider 41 is impelled so that the blocking member 43 is moved to the initial position, the first blocking position, or the second blocking position by the coil spring 61. As a result, for example, in the case where the engagement between the carriage 16 and the slider 41 is released on the path of the movement of the carriage 16, the position of the slider 41 is moved to a position that can be specified such as the initial position by the coil spring 61, so that in the case where the engagement portion 42 of the slider 41 is engaged with the carriage 16, the carriage 16 can be easily engaged with the engagement portion 42.

(4) During the process of ejecting ink onto a sheet P, using the moving operation of the carriage 16, the internal space of the cap 27 to be suctioned can be selected in advance. Therefore, after ending printing, nozzles which are objects of maintenance can be immediately suctioned for maintenance.

(5) By displacing the lever member 79, the clutch member 120 can be caused to be rotatably driven or not to be rotatably driven by the driving force from the motor 26. Therefore, for example, when the clutch member 120 is moved in the axial direction by moving the lever member 79 using the moving operation of the carriage 16, whether or not the power of the motor 26 is transmitted can be switched between by absence or presence of the rotation of the clutch member 120. In addition, the engagement member 110 is impelled so that the state of engagement between the protruding portion 103 and any of the first and second engagement portions 113 and 114 is always maintained by the second coil spring 124 via the clutch member 120. Therefore, the power transmission state of the switched motor 26 can be maintained regardless of the movement position of the carriage 16.

(6) For example, the engagement member 110 can be pressed using the moving operation of the carriage 16 that is moved at a position distant from the clutch mechanism 100 by the lever member 79. In addition, the engagement member 110 can be moved in the reverse direction to the movement direction of the carriage 16. Moreover, in the case where the upper end portion 79*c* is moved by the movement of the carriage 16, an increase in the load that occurs when the carriage 16 is moved with respect to the load of the lower end portion 79*b* for moving the engagement member 110 can be suppressed. Otherwise, the movement amount of the engagement member 110 with respect to the movement amount of the carriage 16 can be increased.

(7) The clutch member 120 is moved by being linked with the movement of the engagement member 110 via the first coil spring 119, and the clutch member 120 and the engagement member 110 can be caused to approach each other by the compression of the first coil spring 119. Therefore, for example, even in the case where before the driven-side protruding portion 123 of the clutch member 120 is moved to the engagement position so as to rotate integrally with the driving-side protruding portion 126 during the movement to the left, the end surfaces thereof abut on each other and the driven-side protruding portion 123 cannot be moved to the left, the driven-side protruding portion 123 and the driving-side protruding portion 126 can be engaged with each other so as to rotate integrally with each other. That is, when the engagement member 110 is moved to the left so as to approach the clutch member 120 by the lever member 79 and the clutch member 120 and the fourth transmission gear 87 are caused to rotate relative each other, the state of the driving-side protruding portion 126 and the driven-side protruding portion 123 abutting on each other is released. As a result, by elongating the first coil spring 119, the clutch member 120 can be moved to the left to cause the driving-side protruding portion 126 and the driven-side protruding portion 123 to be engaged with each other.

(8) Through the movement of the clutch member 120 to the left, the driven-side protruding portion 123 is moved in the axial direction of the clutch shaft 101 so as to be engaged with the driving-side protruding portion 126 in the rotation direction, so that driving transmission between the driving-side protruding portion 126 and the driven-side protruding portion 123 can be performed. Therefore, since the movement amount in the axial direction is enough for the occupied space needed for the engagement, the space needed for the engagement is suppressed, and rotation is transmitted by the engagement between the protruding portions, so that the possibility that rotation is stably transmitted is increased.

(9) The transmission of the motor 26 is transmitted as needed by the rotation of the clutch member 120, so that the rack slider 65 can be reliably moved. Therefore, for example, in the case where the selective blocking mechanism 40 is moved upward and downward by the rack slider 65, the rack slider 65 can be reliably moved so as to move the selective blocking mechanism 40 upward and downward without being limited by the movement position of the carriage 16.

(10) The rack slider 65 is formed in one body without an impelling unit being configured as an additional component, so that the clutch mechanism 100 can be suppressed from being complicated.

In addition, the above-described embodiments may be modified to other embodiments as follows.

Figure 26:
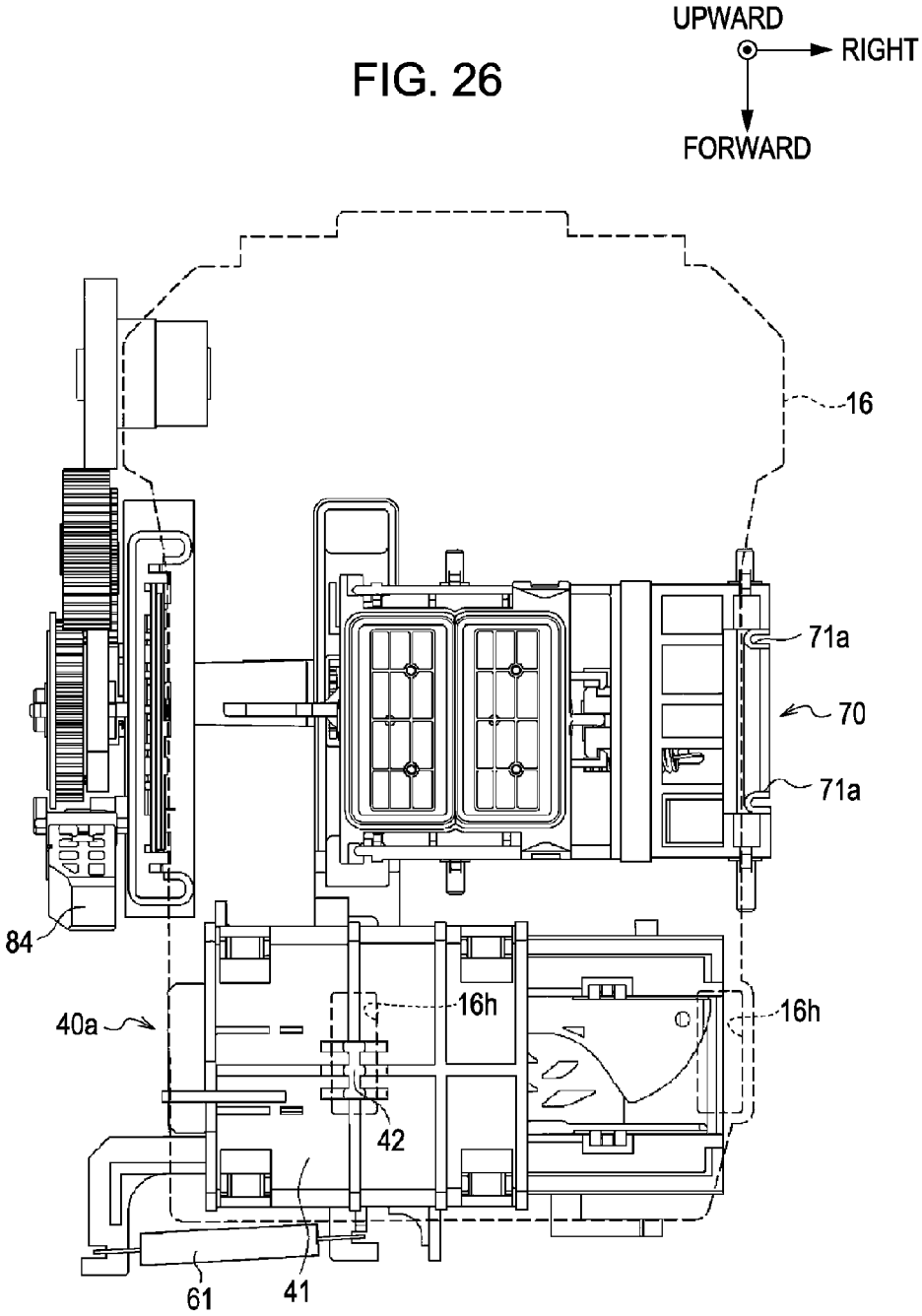
FIG. 26 is a plan view of the maintenance device including a selective blocking unit of a modified example as viewed from above.

In the embodiments, for example, as illustrated in FIG. 26, a selective blocking mechanism 40*a* may have a shape which is symmetrical with respect to the vertical plane in the upward, downward, forward, and rearward directions. That is, the movement of the slider 41 to the left is restricted, and in the state where the movement is restricted, the pin portion 43*a* of the blocking member 43 may be positioned at the initial position, the first blocking position, or the second blocking position.

In addition, when this selective blocking mechanism 40*a* is used, a concave portion 16*h* is provided at a position where the engagement portion 42 of the slider 41 is included in a plan view from above in the state where the carriage 16 is moved to the maintenance area MA to be subjected to maintenance. That is, in the carriage 16, in addition to the concave portion 16*h* engaged with the engagement portion 42 when the slider 41 is reciprocated, another concave portion 16*h* is provided. In addition, in the state where the carriage 16 is moved to the maintenance area MA so as to be subjected to maintenance, when the selective blocking mechanism 40*a* is raised, the engagement portion 42 of the slider 41 in the state where the movement thereof to the left is restricted is engaged with the concave portion 16*h* in the upward and downward direction. By this engagement, the engagement portion 42 of the slider 41 functions as a movement restriction unit that restricts the movement of the carriage 16.

According to this modified example, in addition to the effects (1) to (4) of the above-described embodiments, the following effects are exhibited.

(5) By engaging the carriage 16 moved to the specific position (for example, the first maintenance position MP1) in the maintenance area MA with the engagement portion 42 of the slider 41 in the movement restricted state in the selective blocking mechanism 40*a*, the carriage 16 can be restricted so as not to move in a direction from the maintenance area MA to the printing area PA. Therefore, since the engagement portion 42 of the slider 41 can be caused to function as a lock unit of the carriage, for example, the lock lever 84 in the embodiment becomes unnecessary.

In the embodiment, without the use of the reciprocation of the carriage 16, the discharge tube to be squeezed may be selected according to a position of the carriage 16 in the left and right direction. An example of this modified example will be described with reference to FIGS. 27A and 27B.

Figure 27A:
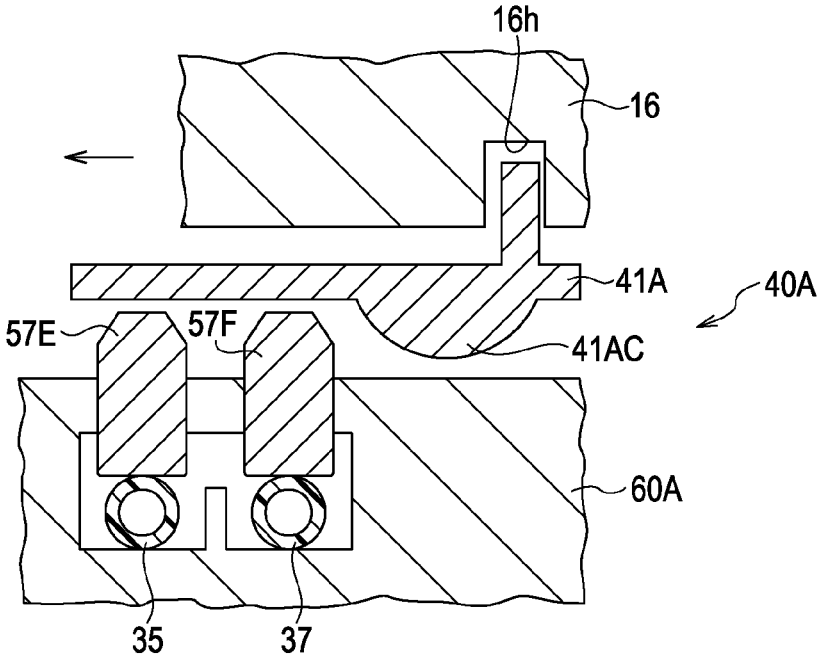
FIG. 27A is a schematic view illustrating a modified example of the selective blocking unit.

As illustrated in FIG. 27A, a selective blocking mechanism 40A of this modified example includes a movement body 41A which is engaged with the concave portion 16*h* of the carriage 16 and is moved in the left and right direction, a base 60A in which the first and second discharge tubes 35 and 37 are arranged, a first pressing member 57E, and a second pressing member 57F. On the lower surface of the movement body 41A, an overhung portion 41AC having a substantially semicircular shape in a front view is formed. In addition, the first pressing member 57E is disposed so as to be movable in the upward and downward direction in the base 60A, the lower end surface thereof abuts on the upper side of the first discharge tube 35, and the upper end portion of which angular portions in the left and right direction are chamfered protrudes upward from the base 60A. Similarly, the second pressing member 57F is disposed so as to be movable in the upward and downward direction in the base 60A, the lower end surface thereof abuts on the upper side of the second discharge tube 37, and the upper end portion of which angular portions in the left and right direction are chamfered protrudes upward from the base 60A.

Figure 27B:
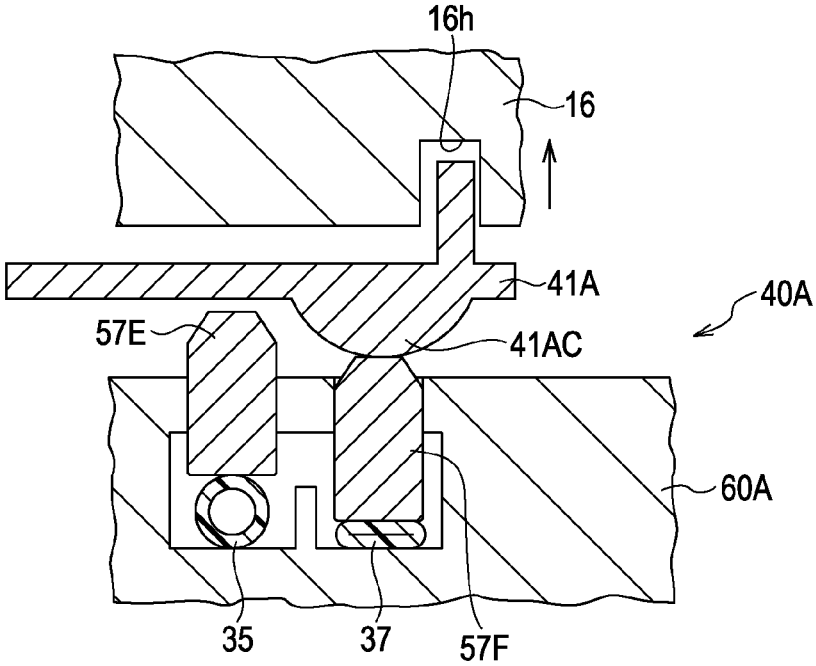
FIG. 27B is a schematic view illustrating a blocked state of a tube in FIG. 27A.

Therefore, as illustrated in FIG. 27B, in the selective blocking mechanism 40A of this modified example, for example, as the movement body 41A is engaged with the concave portion 16*h* of the carriage 16 and is moved in the left and right direction (in the figure, in the left direction), the overhung portion 41AC is positioned at the disposition position of the second pressing member 57F. Then, the second pressing member 57F is pressed downward, and the lower end surface thereof squeezes the second discharge tube 37. In this state, as the movement body 41A is separated from the carriage 16 to release the engagement with the carriage, the state where the second discharge tube 37 is squeezed by the selective blocking mechanism 40A is maintained.

In addition, although not shown in the figure, when the overhung portion 41AC is moved to the disposition position of the first pressing member 57E from the disposition position of the second pressing member 57F, the second pressing member 57F is in a state of not being squeezed by the overhung portion 41AC. Therefore, the second pressing member 57F is raised by the restoring force of the second discharge tube 37, and the second discharge tube 37 returns substantially to its original state before being squeezed from the squeezed state by the restoring force. This is similar to the first pressing member 57E and the first discharge tube 35.

Therefore, according to the configuration of this modified example, the discharge tube to be squeezed can be selected without the reciprocation of the carriage 16, so that the carriage 16 is less moved and a load caused by the movement of the carriage 16 is reduced.

In this embodiment, another example of the modified example in which the discharge tube to be squeezed is selected according to the position of the carriage 16 in the left and right direction without the use of the reciprocation of the carriage 16 will be described with reference to FIG. 28.

Figure 28:
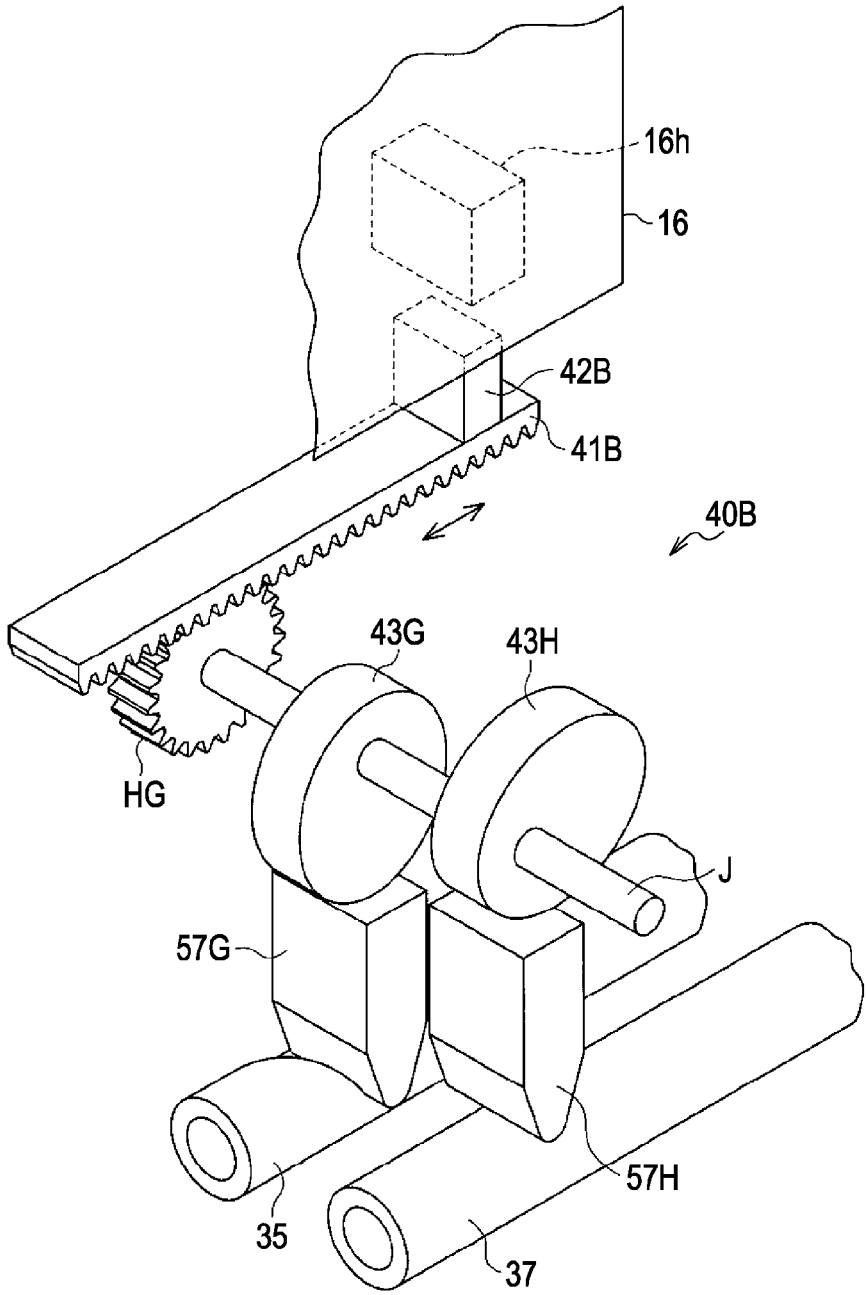
FIG. 28 is a perspective view schematically illustrating another modified example of the selective blocking unit.

As illustrated in FIG. 28, a selective blocking mechanism 40B of this modified example includes a rack member 41B which is reciprocated, and a first cam 43G and a second cam 43H which are rotated integrally with a rotation shaft portion J of a pinion HG engaged with the rack of the rack member 41B. Furthermore, a first pressing member 57G which is moved downward as the upper end surface thereof is pressed by the first cam 43G during the rotation of the rotation shaft portion J, and a second pressing member 57H which is moved downward as the upper end surface thereof is pressed by the second cam 43H are included. In addition, the lower end surface of the first pressing member 57G is disposed to abut on the upper side of the first discharge tube 35 and the lower end surface of the second pressing member 57H is disposed to abut on the upper side of the second discharge tube 37. Moreover, the first and second cams 43G and 43H are mounted to the rotation shaft portion J so as not to press the first and second pressing members 57G and 57H at the same time.

Therefore, in the selective blocking mechanism 40B of this modified example, for example, as an engagement portion 42B provided in the rack member 41B is engaged with the concave portion 16*h* of the carriage 16 and thus the rack member 41B is moved in the left and right direction (in the figure, in the left direction), the pinion HG is rotated. Then, the rotation shaft portion J is rotated and thus the first and second cams 43G and 43H are rotated, so that any of the discharge tubes can be squeezed. For example, as illustrated in FIG. 28, when the first pressing member 57G is pressed downward by the first cam 43G, the lower end surface thereof squeezes the first discharge tube 35. In this state, by releasing the engagement between the rack member 41B and the carriage, the state of the first discharge tube 35 being squeezed in the selective blocking mechanism 40B is maintained.

In addition, although not shown in the figure, when the first cam 43G is rotated and the first pressing member 57G is in the state of not being pressed downward, the first pressing member 57G is raised by the restoring force of the first discharge tube 35, and the first discharge tube 35 returns substantially to its original state before being squeezed from the squeezed state by the restoring force. This is similar to the second pressing member 57H and the second discharge tube 37. Therefore, according to the configuration of this modified example, the discharge tube to be squeezed can be selected without the reciprocation of the carriage 16, so that the carriage 16 is less moved and a load caused by the movement of the carriage 16 is reduced.

In this embodiment, as a structure in which the engagement between the rack 66 of the rack slide 65 and the clutch gear 122 of the clutch member 120 is maintained, an elastic deformation portion which is impelled so that the displacement thereof is returned in the movement direction of the rack slider 65 is formed in the rack slider 65. This modified example will be described with reference to FIG. 29.

Figure 29:
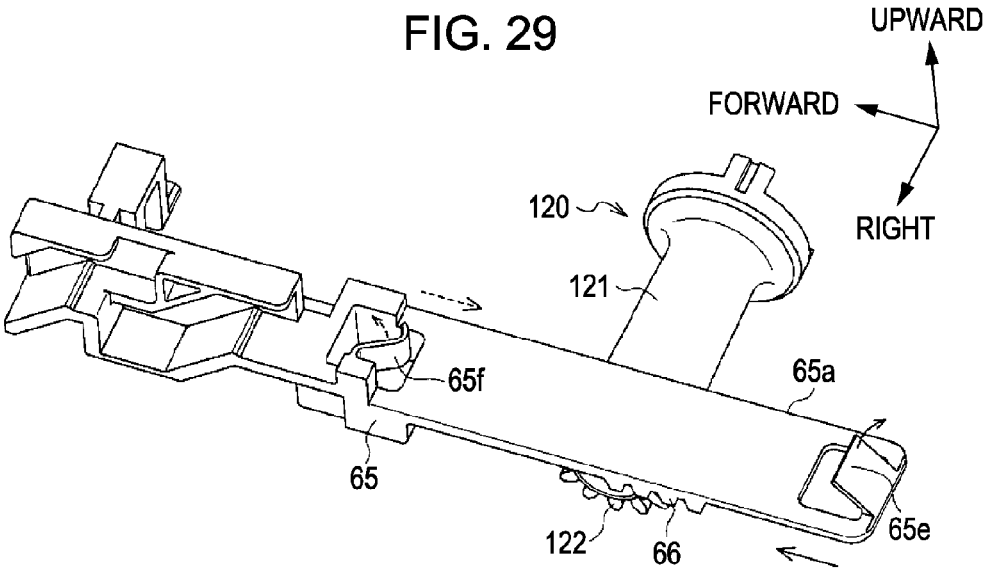
FIG. 29 is a perspective view illustrating a rack slider of a modified example.

As illustrated in FIG. 29, the rack slider 65 of this modified example, at positions at both ends of the movement range thereof when the selective blocking mechanism 40 is elevated, a flexible shape portion 65*e* and a flexible shape portion 65*f* which can be elastically deformed are provided. As shown by the solid line arrow in the figure, the flexible shape portion 65*e* has a cantilever beam shape cut and raised from the flat plate portion 65*a* having a substantially flat plate shape, at the rear end portion of the rack slider 65 so that during the forward movement of the rack slider 65, the flexible shape portion 65*e* abuts on the frame body 29 (not shown in the same figure) and is thus displaced rearward in the upward direction. In addition, as shown by the broken line arrow in the figure, the flexible shape portion 65*f* has a substantially S-shaped cantilever beam shape which uses the right portion in the rack slider 65 as the base end portion so that the front end portion thereof is displaced forward as the flexible shape portion 65*f* abuts on the frame 29 (not shown in the same figure).

Therefore, when the rack slider 65 is moved forward in order to raise the selective blocking mechanism 40, the flexible shape portion 65*e* is displaced at the ending end of the movement range to impel the rack slider 65 rearward, so that the rack 66 and the clutch gear 122 always maintain the engagement. In addition, when the rack slider 65 is moved rearward in order to lower the selective blocking mechanism 40, the flexible shape portion 65*f* is displaced at the ending end of the movement range to impel the rack slider 65 forward, so that the rack 66 and the clutch gear 122 always maintain the engagement.

In the embodiment, as a structure in which the engagement between the rack 66 of the rack slider 65 and the clutch gear 122 of the clutch member 120, the clutch gear 122 in the clutch member 120 may be configured as two gears. For example, as illustrated in FIG. 30, the clutch gear 122 may be configured of a clutch gear 122*a* formed in the clutch body 121, and a clutch gear 122*b* formed separately from the clutch body 121.

In this modified example, in the clutch body 121 in which the clutch gear 122*a* is formed, a convex portion 121*c* is formed to protrude from the right end in the left direction in a trapezoidal shape, and in the clutch gear 122*b*, a convex portion 122*c* is formed to protrude from the left side in a trapezoidal shape in the left direction so as to be engaged with the convex portion 121*c* in the rotation direction. In addition, the clutch gear 122*b* is impelled to the left by the first coil spring 119, and the clutch gear 122*a* (the clutch body 121) is impelled to the right by the second coil spring 124 having a compression force which is weaker than the first coil spring. In addition, in this impelled state, the clutch gear 122*b* is disposed at a position engaged with the four rack teeth 66*a*, 66*b*, 66*b*, and 66*c* by the first coil spring 119, and the clutch gear 122*a* is disposed at a position engaged with the two rack teeth 66*b*.

Figure 30:
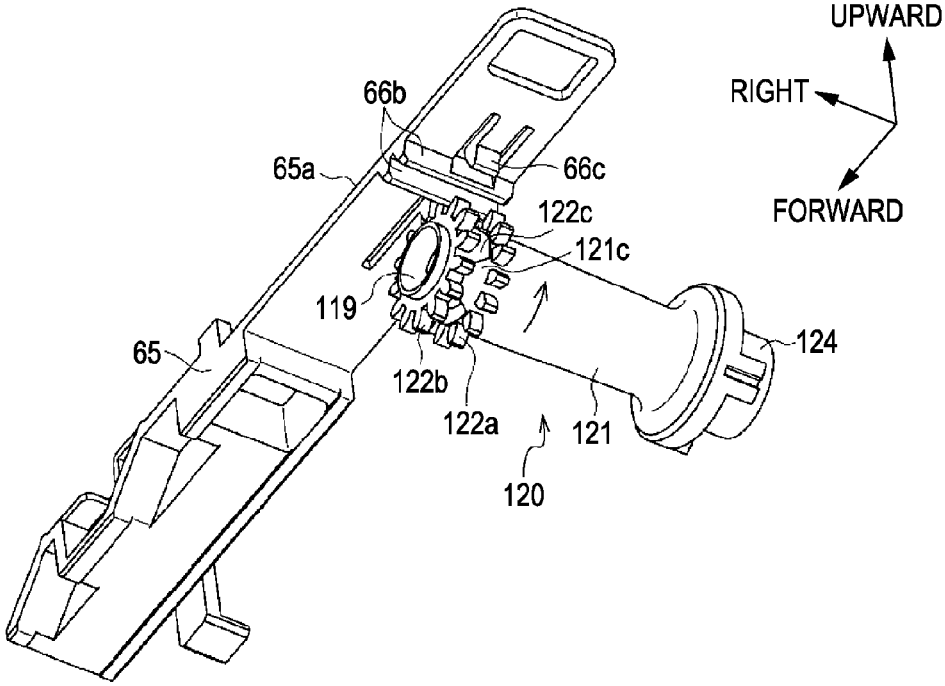
FIG. 30 is a perspective view illustrating a clutch body of a modified example.

With this configuration, for example, in the case where the rack slider 65 is moved forward, as illustrated in FIG. 30, the clutch gears 122*a* and 122*b* are rotated together by the convex portions 121*c* and 122*c* in the engaged state in the rotation direction (the arrow in the figure), thereby moving the rack slider 65. In addition, the clutch gear 122*a* is in the state of not being engaged with the rack tooth 66*c* at the ending end in the movement range. In this state, when the rotation of the clutch body 121 is continued, the second coil spring 124 which has a weaker compression force than the first coil spring 119 is subjected to compression deformation, so that the convex portion 121*c* is moved to the left along the inclined surface portion of the trapezoid and rides over the convex portion 122*c*. As a result, the clutch gear 122*a* idles, and the clutch gear 122*b* enters a state to which the rotation of the clutch body 121 is not transmitted, and thus the state of being engaged with the rack 66 (the rack tooth 66*c*) is maintained.

Figure 31:
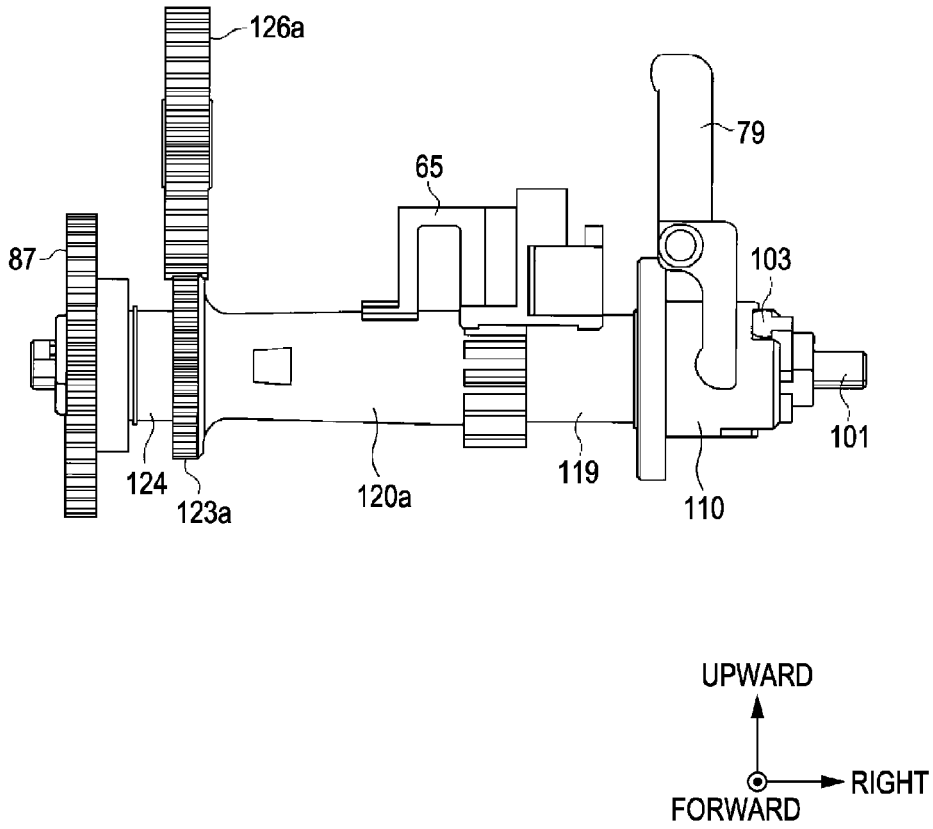
FIG. 31 is a front view illustrating a clutch mechanism of a modified example as viewed from the front.

In the embodiment, during the ON state of the clutch mechanism 100, rotation may be transmitted to the clutch member 120 from a rotation unit engaged in a direction intersecting the axial direction of the clutch shaft 101 may be transmitted. For example, as illustrated in FIG. 31, the clutch member 120*a* of this modified example has, at the left end portion thereof, a spur gear 123*a* with teeth extending on the outer peripheral surface in the left and right direction. In addition, a spur gear 126*a* as a rotation unit is disposed which is engaged with the spur gear 123*a* when the clutch member 120*a* is biased to the left and the clutch mechanism 100 enters the ON state, and of which engagement with the spur gear 123*a* is deviated when the clutch member 120*a* is biased to the right and the clutch mechanism 100 enters the OFF state. Therefore, the spur gear 126*a* functions as the driving-side protruding portion in the embodiment, and the slur gear 123*a* functions as the driven-side protruding portion in the embodiment.

According to the configuration of this modified example, the engagement with the spur gear 126*a* which is on the driving side can be selected by the movement amount of the clutch member 120*a* in the left and right direction. Therefore, for example, when a plurality of spur gears 126*a* on the driving side are provided, by controlling the movement amount of the clutch member 120*a*, the spur gear 126*a* that has to transmit the rotation to the clutch member 120*a* can be caused to be engaged.

In the embodiment, the elevation driving of the selective blocking mechanism 40 may be performed using the power of the paper feeding motor 14 (see FIG. 1). During maintenance of the liquid ejecting head, since printing is not performed, the power of the paper feeding motor 14 may be used in a state where a load caused by a paper feeding operation is reduced.

In the embodiment, the coil spring 61 may not be necessarily included. For example, in a case where there is a high possibility that the slider 41 is positioned at the initial position, the first blocking position, or the second blocking position when the reciprocation of the slider 41 is ended and the engagement portion 42 is lowered to release the engagement with the carriage 16, this can be realized.

In the embodiment, a forward and rearward movement mechanism which causes the selective blocking mechanism 40 to be moved rearward with respect to the carriage 16 so as to approach or to be moved forward so as to be separated may be configured as a separation and approach movement unit. In this case, the engagement portion 42 of the slider 41 may be configured to protrude rearward, and the concave portion 16*h* of the carriage 16 may be configured to have an opening portion in the forward direction.

In the embodiment, the clutch mechanism 100 may not necessarily have the first coil spring 119. For example, when the clutch mechanism 100 is switched from the OFF state to the ON state as the driving-side protruding portion 126 and the driven-side protruding portion 123 have triangular shapes or the like, in a case where the driven-side protruding portion 123 and the driving-side protruding portion 126 do not abut on each other in the left and right direction, the first coil spring 119 is unnecessary.

In the embodiment, a displacement member may not necessarily be the lever member 79. For example, in the clutch mechanism 100, in a case where the engagement member 110 is moved in the same direction as the carriage 16 (the cap holding member 71), a slide member may be employed. In this case, although not shown, in the lever member 79, the rotation shaft portion 79*a* may be provided so that the point of effort and the point of action are positioned on the same side.

In the embodiment, the clutch gear 122 may rotate, other than a slide member such as the rack slider 65, a rotation member (for example, a pump transmission gear 88 or the like). In this manner, the tube pump 38 can be rotated as needed.

In the embodiment, as the rotation unit, a rotation body other than the fourth transmission gear 87 may be included. For example, a pulley other than the gear may be included as the rotation body, or the pinion 26*a* of the motor 26 may be included as the rotation unit.

In the embodiment, in the maintenance area MA, the first maintenance position MP1 and the second maintenance position MP2 may be the same position. For example, in a case of a configuration in which the tube pump can perform the suction driving without raising of the selective blocking mechanism 40 in the state where the clutch mechanism 100 in the ON state or can be switched between the ON state and the OFF state, there is no need to cause the positions of the first and second maintenance positions MP1 and MP2 to be different from each other.

In the embodiment, the liquid ejecting apparatus is embodied as the ink jet type printer 11 as an example and may also be embodied as a liquid ejecting apparatus which ejects or discharges a liquid other than ink. The liquid ejecting apparatus may also be used as various liquid ejecting apparatuses having liquid ejecting heads and the like which discharge a minute amount of liquid droplets. In addition, the liquid droplets represent liquid states discharged from the liquid ejecting apparatus, the liquid states including granular, tear-like, and thread-like shapes with trails. The liquid mentioned herein may be any material that can be ejected by the liquid ejecting apparatus. For example, the materials may be in a liquid phase, and may include liquid materials with high or low viscosities, sol, gel water, fluid-state materials such as inorganic solvents, organic solvents, solutions, liquid resins, and liquid metal (metallic melt), and in addition to liquids as a state of the material, a material in which particles of functional materials made of solids such as pigments or metallic particles are dissolved, dispersed, or mixed with the solvent. In addition, as a representative example of the liquid, there is the ink described above in the embodiment or a liquid crystal. Here, the ink may include various kinds of liquid compositions such as general water-based ink, oil-based ink, gel ink, hot-melt ink, and the like. Specific examples of the liquid ejecting apparatus may include liquid crystal displays, EL (electroluminescence) displays, surface light-emitting displays, and liquid ejecting apparatuses for ejecting liquid in which materials such as electrode materials used for manufacturing color filters and color materials are dispersed or dissolved. Otherwise, the liquid ejecting apparatus may be liquid ejecting apparatuses for ejecting biological organic materials used for manufacturing biochips, liquid ejecting apparatuses which are used as precision pipettes and eject liquids as specimens, printing apparatuses, and microdispensers. Moreover, liquid ejecting apparatuses for ejecting lubricating oil to precision machinery such as watches or cameras with pinpoint precision, liquid ejecting apparatuses for ejecting transparent resin liquids such as ultraviolet curable resin on substrates to form micro-hemispherical lenses (optical lenses) or the like used for optical communication elements or the like, and liquid ejecting apparatuses for ejecting acidic or alkaline etchants for etching substrates or the like may be employed. In addition, the invention can be applied to any kind of liquid ejecting apparatus therefrom.

What is claimed is:

1. A maintenance device comprising:

a carriage which is provided to support a liquid ejecting head that ejects a liquid from a plurality of nozzles and to be reciprocated;

a cap which approaches the liquid ejecting head as the carriage is moved to a maintenance position where maintenance of the liquid ejecting head is performed, abuts on the liquid ejecting head so as to surround the nozzles, and forms a plurality of internal spaces between the cap and the liquid ejecting head;

a suction unit which suctions each of the internal spaces of the cap via a suction passage corresponding to each of the internal spaces;

a selective blocking unit which has a movement member which is moved by being linked with the carriage in a state of being engaged with the carriage in a movement midway area positioned on the path of the carriage moving to the maintenance position, selectively blocks the suction passages according to movement of the movement member, and releases engagement between the movement member and the carriage while maintaining a blocked state of the selected suction passage; and a separation and approach movement unit which establishes or releases the engagement between the movement member and the carriage by moving the movement member so as to approach or be separated from the carriage.

2. The maintenance device according to claim 1, wherein the movement member is provided with an engagement portion that is able to be engaged with the carriage in the movement midway area of the carriage and a blocking member that is displaced so as to selectively block the suction passages, the selective blocking unit includes a cam member having a cam surface formed to guide the blocking member to a selection position corresponding to the selection of the suction passage to be blocked according to reciprocation of the movement member, and the separation and approach movement unit drives the selective blocking unit to approach or be separated from the carriage in a state where the blocking member is positioned at the selection position.

3. The maintenance device according to claim 2, further comprising an impelling unit which impels the movement member so as to guide the blocking member toward the selection position.

4. The maintenance device according to claim 2, wherein, in the selective blocking unit, a movement restriction unit which restricts the movement of the movement member in a direction in which the carriage is moved from the maintenance area to the movement midway area is formed at the selection position to which the blocking member is guided.

5. A liquid ejecting apparatus comprising:

a liquid ejecting head which ejects a liquid onto a medium; and the maintenance device according to claim 2.

6. A liquid ejecting apparatus comprising:

a liquid ejecting head which ejects a liquid onto a medium; and the maintenance device according to claim 3.

7. A liquid ejecting apparatus comprising:

a liquid ejecting head which ejects a liquid onto a medium; and the maintenance device according to claim 4.

* * * * *